US010974526B2

(12) United States Patent
Taniguchi et al.

(10) Patent No.: US 10,974,526 B2
(45) Date of Patent: Apr. 13, 2021

(54) PRINTING APPARATUS FOR CONTROLLING OVERLAP OF A PRECEDING SHEET AND A SUCCEEDING SHEET, AND A RELATED CONTROL METHOD

(71) Applicant: CANON KABUSHIKI KAISHA, Tokyo (JP)

(72) Inventors: Hisashi Taniguchi, Yokohama (JP); Syunichi Kunihiro, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/372,045

(22) Filed: Apr. 1, 2019

(65) Prior Publication Data

US 2019/0224996 A1 Jul. 25, 2019

Related U.S. Application Data

(60) Continuation of application No. 15/650,153, filed on Jul. 14, 2017, now Pat. No. 10,279,606, which is a (Continued)

(30) Foreign Application Priority Data

Aug. 25, 2014 (JP) ..... 2014-170897

(51) Int. Cl.
*B41J 13/00* (2006.01)
*B41J 11/00* (2006.01)

(52) U.S. Cl.
CPC ..... *B41J 13/0009* (2013.01); *B41J 11/0095* (2013.01); *B41J 13/0018* (2013.01); *B41J 13/0027* (2013.01)

(58) Field of Classification Search
CPC ..... B41J 13/0009; B41J 13/0027; B41J 13/0018; B41J 11/0095
See application file for complete search history.

(56) References Cited

U.S. PATENT DOCUMENTS 6,629,795 B2 10/2003 Kinoshita et al.
9,333,773 B2 5/2016 Taniguchi et al.
(Continued)

FOREIGN PATENT DOCUMENTS

JP H06-262831 A 9/1994
JP 2000-015881 A 1/2000
(Continued)

OTHER PUBLICATIONS

IP.com No. 000026995, Gooray, Arthur, M., et al., Wet Paper Handling of Ink Jet Images to Allow Passive Drying, Sep./Oct. 1994, Xerox Disclosure Journal—vol. 19, No. 5, pp. 417-418.
(Continued)

*Primary Examiner* — Sharon Polk
(74) *Attorney, Agent, or Firm* — Venable LLP

(57) ABSTRACT

A printing apparatus includes a feeding roller configured to feed sheets, including at least a preceding sheet and a succeeding sheet, a conveyance roller configured to convey the sheets fed by the feeding roller, and a printing unit configured to print on at least one sheet, of the sheets conveyed by the conveyance roller. A conveyance control unit controls the conveying of the sheets by the conveyance roller to form an overlap state, in which a leading edge of the succeeding sheet overlaps with the preceding sheet. In a case in which the conveyance roller conveys the succeeding sheet to a printing start position at which a printing operation is started by the printing unit, and the conveyance control unit forms the overlap state, the printing unit is configured to print on an overlapping area in which the preceding sheet and the succeeding sheet overlap.

14 Claims, 48 Drawing Sheets

Related U.S. Application Data division of application No. 15/132,194, filed on Apr. 18, 2016, now Pat. No. 10,065,438, which is a continuation of application No. 14/816,571, filed on Aug. 3, 2015, now Pat. No. 9,333,773.

(56) References Cited

U.S. PATENT DOCUMENTS

| | | | | |
|---|---|---|---|---|
| 9,427,985 | B2 | 8/2016 | Taniguchi et al. | |
| 10,065,438 | B2 | 9/2018 | Taniguchi et al. | |
| 10,279,606 | B2 | 5/2019 | Taniguchi et al. | |
| 2004/0113356 | A1 | 6/2004 | Stemmle | |
| 2008/0181701 | A1 | 7/2008 | Fukasawa et al. | |
| 2011/0286828 | A1 | 11/2011 | Iwata et al. | |
| 2012/0299990 | A1 | 11/2012 | Kohnotoh et al. | |
| 2013/0001851 | A1 | 1/2013 | Kiriyama | |
| 2015/0353306 | A1* | 12/2015 | Saito | B65H 7/08 271/265.01 |
| 2015/0355592 | A1 | 12/2015 | Sugiyama et al. | |

FOREIGN PATENT DOCUMENTS

| | | | |
|---|---|---|---|
| JP | 2000-062975 | A | 2/2000 |
| JP | 2001-324844 | A | 11/2001 |
| JP | 2001-331074 | A | 11/2001 |
| JP | 2002-160849 | A | 6/2002 |
| JP | 2004-025605 | A | 1/2004 |
| JP | 2007-203546 | A | 8/2007 |
| JP | 2010-082828 | A | 4/2010 |
| JP | 2010-116239 | A | 5/2010 |
| JP | 2010-271405 | A | 12/2010 |
| JP | 2012-162366 | A | 8/2012 |
| JP | 2016-044058 | A | 4/2016 |

OTHER PUBLICATIONS

IP.com No. 000088371, Korte, EC, et al., Sheet Feed Sensing, Jun. 1, 1977, IBM TDB 06-77, pp. 25-26.

Office Action dated Jun. 14, 2019, issued in Japanese Patent Application No. 2018-149660.

Japanese Office Action dated Feb. 22, 2021, in related Japanese Patent Application No. 2020-029703.

* cited by examiner

FIG. 13
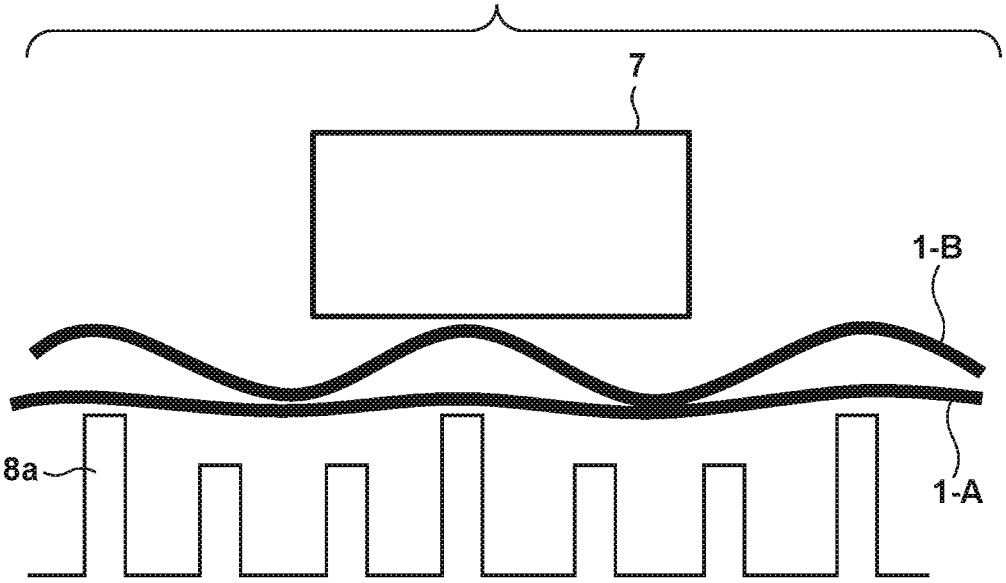
FIG. 14
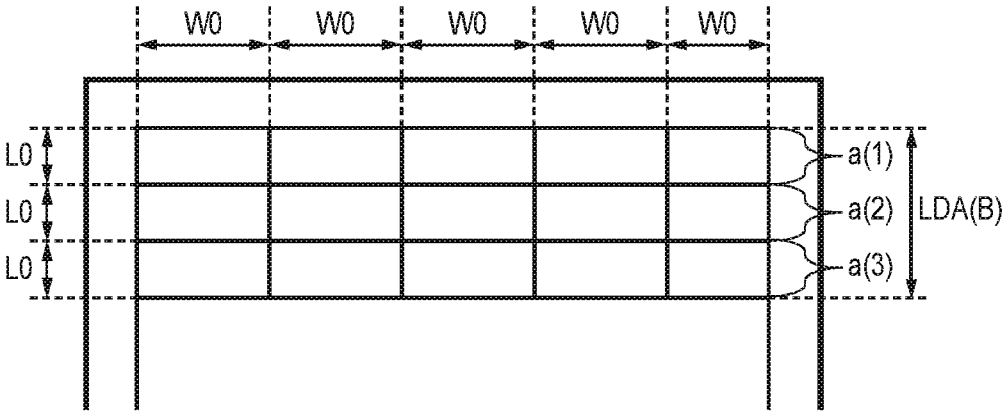
FIG. 15
| PRINTING PASS COUNT | 1 | 2 | 4 |
|---|---|---|---|
| d0 | 50 | 30 | 20 |

FIG. 21
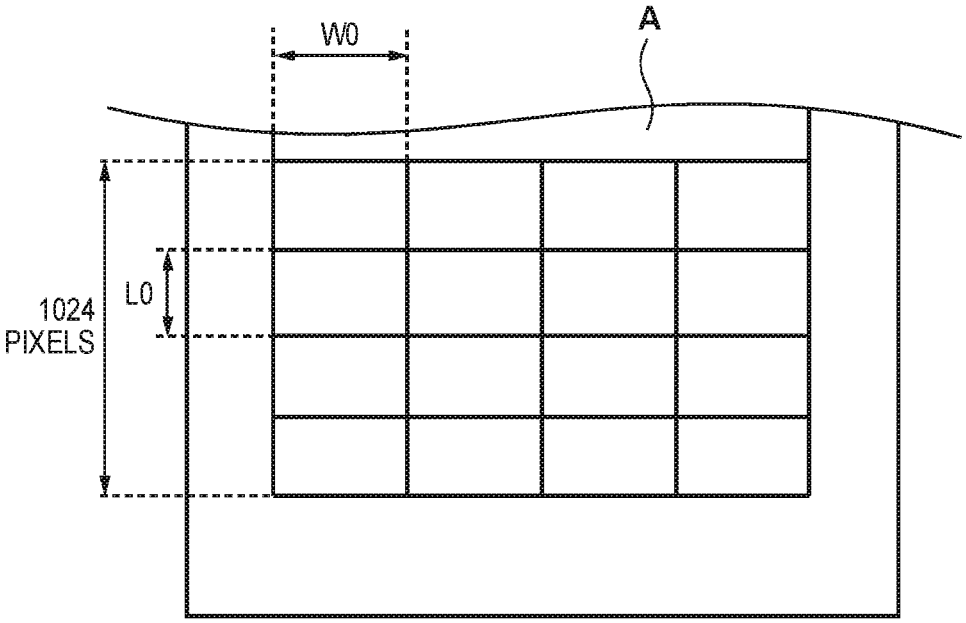
FIG. 22
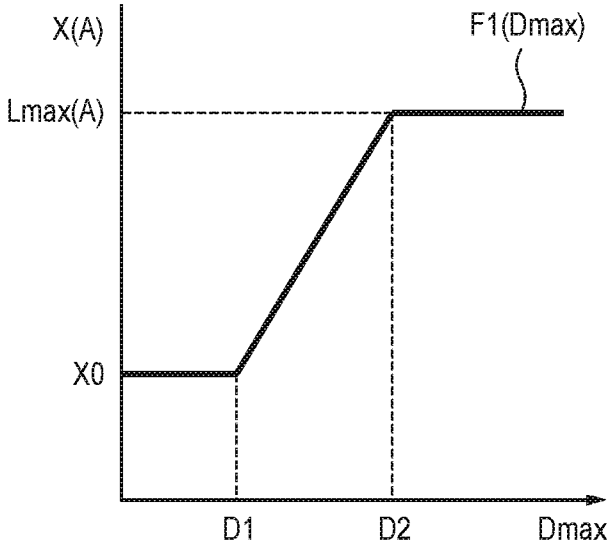
FIG. 23
| PRINTING PASS COUNT | 1 | 2 | 4 |
|---|---|---|---|
| D1 | 25 | 15 | 10 |
| D2 | 50 | 30 | 20 |

FIG. 26

| ENVIRONMENTAL TEMPERATURE[°C] | ~15 | ~ | 22.5 | ~ | 30~ |
|---|---|---|---|---|---|
| t1 | 1.1 | ~ | 1 | ~ | 0.9 |
| t2 | 1.1 | ~ | 1 | ~ | 0.9 |

| ENVIRONMENTAL HUMIDITY[%] | ~10 | ~ | 50 | ~ | 90~ |
|---|---|---|---|---|---|
| h1 | 0.75 | ~ | 1 | ~ | 1.25 |
| h2 | 0.75 | ~ | 1 | ~ | 1.25 |

| PRINTING PASS COUNT | 1 | 2 | 4 |
|---|---|---|---|
| p1 | 1 | 0.6 | 0.4 |
| p2 | 1 | 0.6 | 0.4 |

| ENVIRONMENTAL TEMPERATURE[°C] | ~15 | ~ | 22.5 | ~ | 30~ |
|---|---|---|---|---|---|
| t3 | 1.1 | ~ | 1 | ~ | 0.9 |

| ENVIRONMENTAL HUMIDITY[%] | ~10 | ~ | 50 | ~ | 90~ |
|---|---|---|---|---|---|
| h3 | 0.75 | ~ | 1 | ~ | 1.25 |

| PRINTING PASS COUNT | 1 | 2 | 4 |
|---|---|---|---|
| p3 | 1 | 0.6 | 0.4 |

FIG. 27

PRINTING APPARATUS FOR CONTROLLING OVERLAP OF A PRECEDING SHEET AND A SUCCEEDING SHEET, AND A RELATED CONTROL METHOD

This application is a continuation of U.S. patent application Ser. No. 15/650,153, filed Jul. 14, 2017, which is a divisional of U.S. patent application Ser. No. 15/132,194, filed Apr. 18, 2016, now U.S. Pat. No. 10,065,438, which is a continuation of U.S. patent application Ser. No. 14/816,571, filed Aug. 3, 2015, now U.S. Pat. No. 9,333,773, which claims the benefit of Japanese Patent Application No. 2014-170897, filed Aug. 25, 2014, each of which is hereby incorporated by reference herein in its entirety.

BACKGROUND OF THE INVENTION

Field of the Invention

The present invention relates to a sheet conveyance technique in a printing apparatus having a printhead.

Description of the Related Art

In recent years, a printing apparatus is expected to increase the speed of printing to improve the productivity. As one method of increasing the speed, an interval between printing sheets to be continuously fed is shortened. As a technique of shortening the interval between printing sheets, in addition to a method of simply shortening the interval between a preceding sheet and a succeeding sheet, there is provided a method of conveying sheets by making the marginal area of the leading edge of the succeeding sheet overlap the marginal area of the trailing edge of the preceding sheet, and forming images while the sheets overlap each other (see Japanese Patent Laid-Open No. 2001-324844). This means that images are formed by excluding unnecessary portions (the interval between printing sheets and the marginal portion of each printing sheet) as much as possible except for image forming areas. This is a very effective method to increase the speed of printing.

If an inkjet printing apparatus executes high-density printing on an area in which printing sheets overlap each other using a large amount of ink, however, wavy wrinkles called cockling can occur on the printing sheet due to moisture of the ink. For example, when a partial area of the leading edge of the succeeding sheet is made to overlap the marginal area of the trailing edge of the preceding sheet, the reverse surface of the sheet is constrained by a flat plate. When cockling occurs, therefore, the printing sheet may unwantedly float, and graze against the printhead, thereby causing a stain on the printing sheet, or disabling conveyance to a discharge roller, or the like, to cause a sheet jam. In addition, when the distance between the printhead and the obverse surface of the printing sheet becomes unstable, an ink landing position may shift to degrade the image quality.

SUMMARY OF THE INVENTION

The present invention has been made in consideration of the aforementioned problems, and realizes a technique capable of increasing the speed of printing while suppressing inconvenience caused when sheets are conveyed by making the succeeding sheet overlap the preceding sheet and high-density printing is performed.

In order to solve the aforementioned problems, one aspect of the present invention provides a printing apparatus comprising a feeding unit configured to feed a printing sheet stacked on a stacking unit, a conveyance unit configured to convey the printing sheet fed by the feeding unit, a printing unit configured to print the printing sheet conveyed by the conveyance unit, and a control unit configured to control conveyance of printing sheets so that a trailing edge of a preceding sheet as a printing sheet precedingly fed from the stacking unit and a leading edge of a succeeding sheet as a printing sheet succeedingly fed from the stacking unit overlap each other, wherein, based on an ink amount to be applied to an area of a predetermined range from at least one of the leading edge of the succeeding sheet and the trailing edge of the preceding sheet, the control unit decides an overlapping amount of an area in which the trailing edge of the preceding sheet and the leading edge of the succeeding sheet overlap each other.

In addition, in order to solve the aforementioned problems, another aspect of the present invention provides a method of controlling a printing apparatus including feeding unit configured to feed a printing sheet stacked on a stacking unit, a conveyance unit configured to convey the printing sheet fed by the feeding unit, and a printing unit configured to print the printing sheet conveyed by the conveyance unit, the method comprising a control step of controlling conveyance of printing sheets so that a trailing edge of a preceding sheet as a printing sheet precedingly fed from the stacking unit and a leading edge of a succeeding sheet as a printing sheet succeedingly fed from the stacking unit overlap each other, wherein, in the control step, an overlapping amount of the preceding sheet and the succeeding sheet is decided based on an ink amount to be applied to an area of a predetermined range from at least one of the leading edge of the succeeding sheet and the trailing edge of the preceding sheet.

Further, in order to solve the aforementioned problems, another aspect of the present invention provides a computer-readable storage medium storing a program for causing a computer to execute a control method of a printing apparatus including feeding unit configured to feed a printing sheet stacked on a stacking unit, a conveyance unit configured to convey the printing sheet fed by the feeding unit, and a printing unit configured to print the printing sheet conveyed by the conveyance unit, the method comprising a control step of controlling conveyance of printing sheets so that a trailing edge of a preceding sheet as a printing sheet precedingly fed from the stacking unit and a leading edge of a succeeding sheet as a printing sheet succeedingly fed from the stacking unit overlap each other, wherein, in the control step, an overlapping amount of the preceding sheet and the succeeding sheet is decided based on an ink amount to be applied to an area of a predetermined range from at least one of the leading edge of the succeeding sheet and the trailing edge of the preceding sheet.

According to the present invention, it is possible to increase the speed of printing while suppressing a stain on a sheet, a sheet jam, a deterioration in image quality, or the like, that can be caused when sheets are conveyed by making the succeeding sheet overlap the preceding sheet and high-density printing is performed.

Further features of the present invention will become apparent from the following description of exemplary embodiments, with reference to the attached drawings.

BRIEF DESCRIPTION OF THE DRAWINGS

FIG. 13 is a schematic view showing cockling of the succeeding sheet overlapping the preceding sheet according to the first embodiment.

FIG. 14 is a view for explaining division of a printing density detection area according to the first embodiment.

FIG. 15 is a table showing a threshold table for obtaining the succeeding sheet caused overlapping reducing amount Y(B) according to the first embodiment.

FIG. 21 is a schematic view showing a printing density detection area and unit areas according to the second embodiment.

FIG. 22 is a graph showing a function of obtaining the preceding sheet caused overlapping reducing amount X(A) according to the second embodiment.

FIG. 23 is a table for deciding a function of obtaining the preceding sheet caused overlapping reducing amount X(A) according to the second embodiment.

FIG. 26 shows tables that are changed for each printing condition to decide a function of obtaining a preceding sheet caused overlapping reducing amount X(A) according to the third embodiment.

FIG. 27 shows tables that are changed for each printing condition to decide a threshold for obtaining a succeeding sheet caused overlapping reducing amount Y(B) according to the third embodiment.

DESCRIPTION OF THE EMBODIMENTS

Embodiments of the present invention will be described in detail below with reference to the accompanying drawings.

Figure 1:
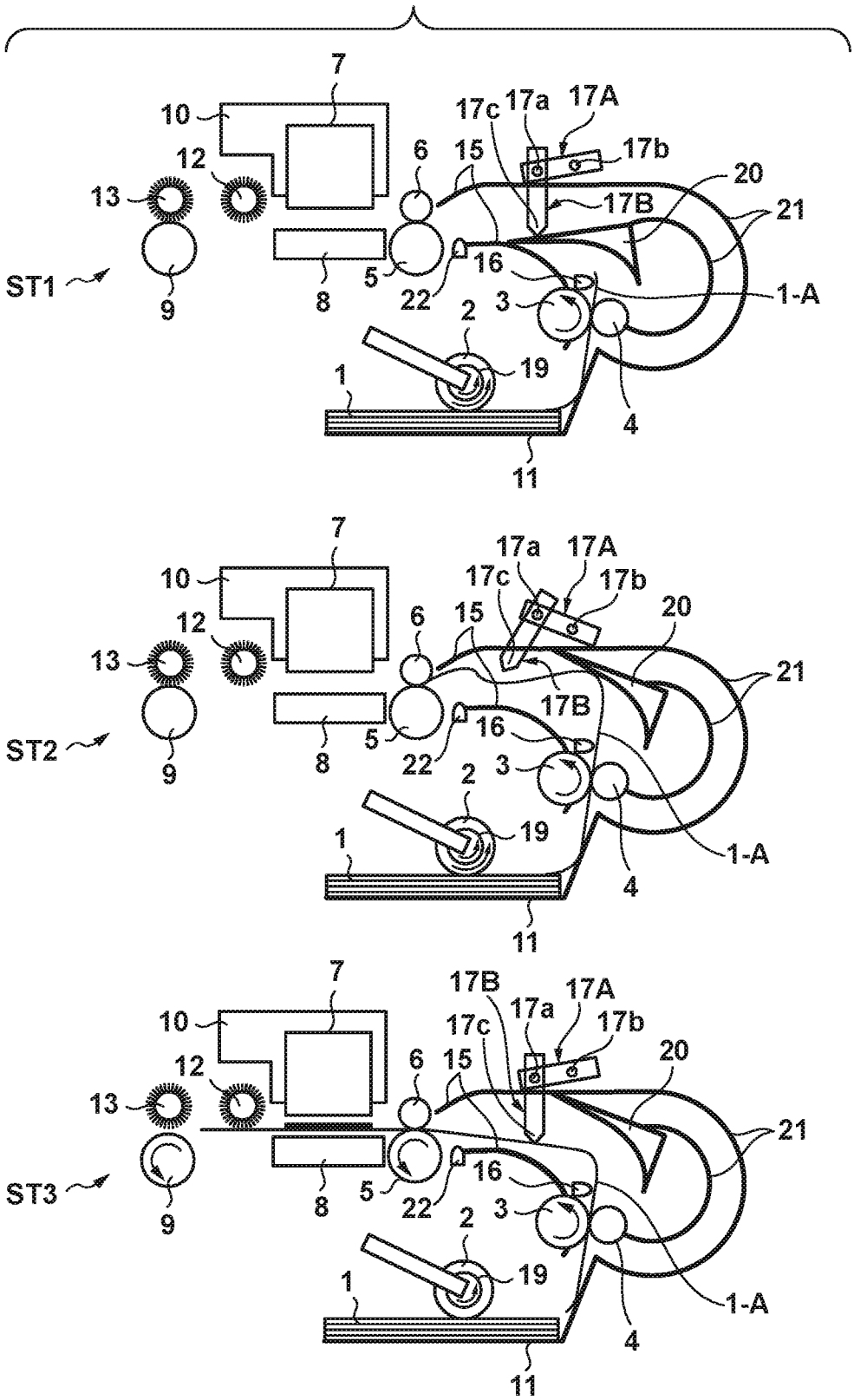
FIGS. 1 to 3 are views for explaining an overlap continuous feeding operation in a printing apparatus according to the present invention.
Figure 2:
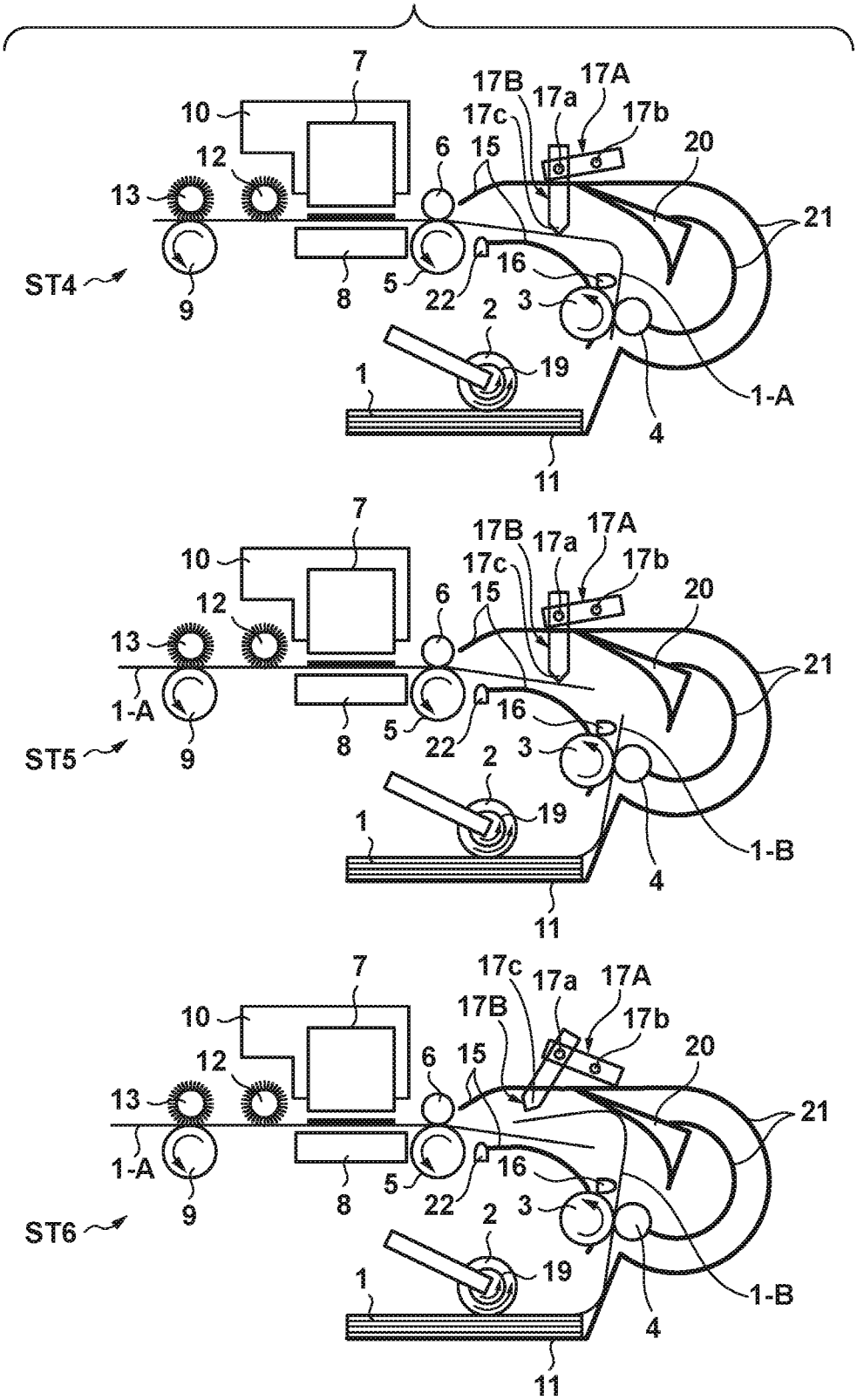
Figure 3:
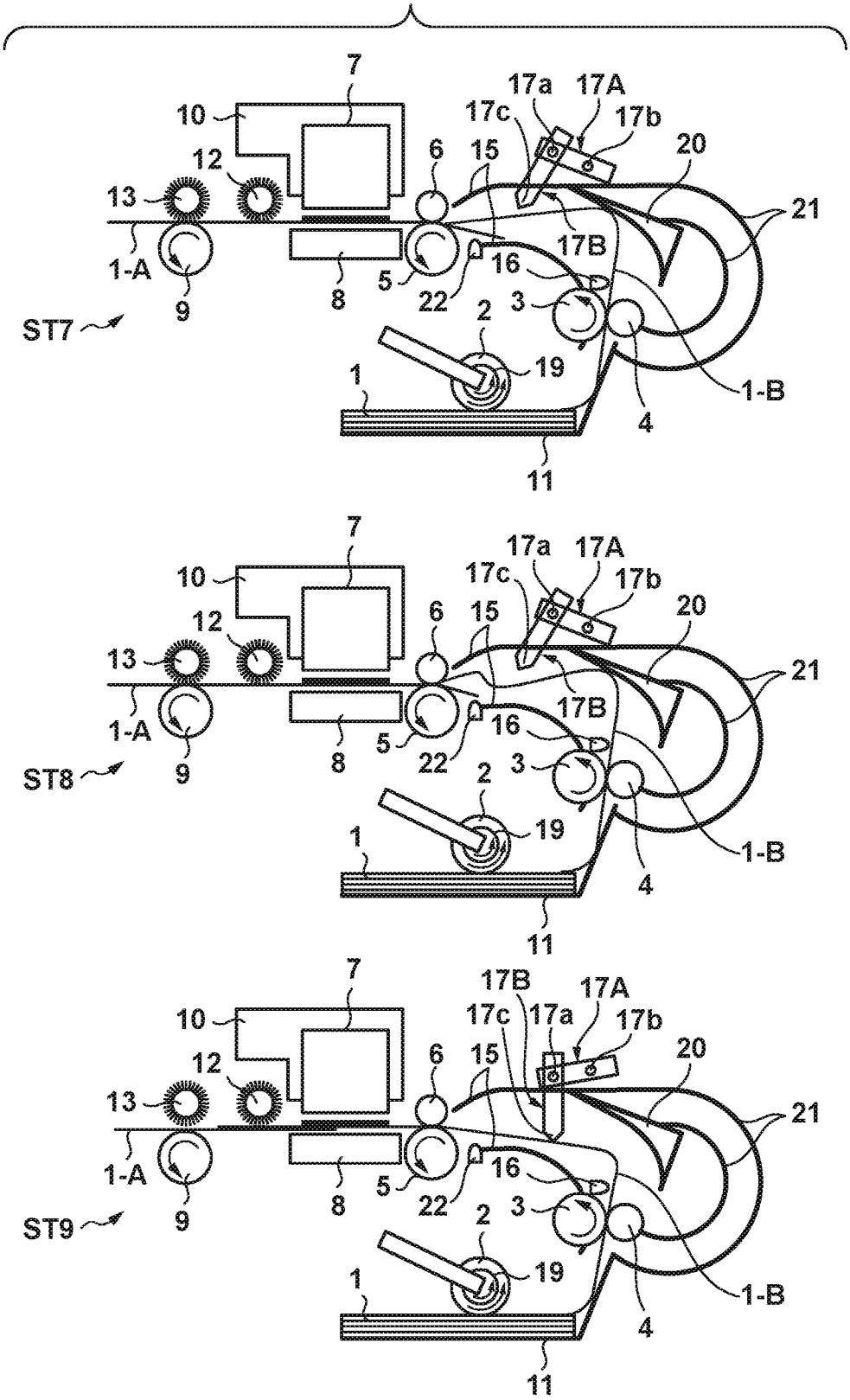

FIGS. 1 to 3 are side cross-sectional views that schematically show a principal component of a printing apparatus and an overlap continuous feeding operation in the printing apparatus according to one embodiment of the present invention. The schematic arrangement of the printing apparatus according to the embodiment will first be described with reference to FIG. 1.

In ST1 of FIG. 1, reference numeral 1 denotes printing sheets. The plurality of printing sheets 1 are stacked on a feeding tray 11 (a stacking unit). A pickup roller 2 abuts against the top printing sheet 1 stacked on the feeding tray 11 to pick up the top printing sheet 1. A feeding roller 3 feeds the printing sheet 1 picked up by the pickup roller 2 toward a downstream side of a sheet conveyance direction. A feeding driven roller 4 is biased against the feeding roller 3 to sandwich the printing sheet 1 with the feeding roller 3, thereby feeding the printing sheet 1.

A conveyance roller 5 conveys the printing sheet 1 fed by the feeding roller 3 and the feeding driven roller 4 to a position facing a printhead 7. A pinch roller 6 is biased against the conveyance roller 5 to sandwich the printing sheet 1 with the conveyance roller 5, thereby conveying the printing sheet 1.

The printhead 7 prints the printing sheet 1 conveyed by the conveyance roller 5 and the pinch roller 6. In the present embodiment, an inkjet printhead that prints the printing sheet 1 by discharging ink from the printhead 7 will be exemplified. A platen 8 supports the reverse surface of the printing sheet 1 at the position facing the printhead 7. A carriage 10 mounts the printhead 7 and moves in a direction intersecting the sheet conveyance direction.

A discharge roller 9 discharges the printing sheet 1 printed by the printhead 7 to the outside of the apparatus. Spurs 12 and 13 rotate while they are in contact with the printing surface of the printing sheet 1 printed by the printhead 7. The spur 13 on the downstream side is biased against the discharge roller 9, and no discharge roller 9 is arranged at a position facing the spur 12 on the upstream side. The spur 12 is used to prevent the floating of the printing sheet 1, and is also referred to as a pressing spur.

Conveyance guides 15 and a flapper 20 guide the printing sheet 1 between a feeding nip portion, formed by the feeding roller 3 and the feeding driven roller 4, and a conveyance nip portion, formed by the conveyance roller 5 and the pinch roller 6. The flapper 20 is pivotable by the reaction force of the printing sheet 1 conveyed by the feeding roller 3. A sheet detection sensor 16 detects a leading edge and a trailing edge of the printing sheet 1. The sheet detection sensor 16 is provided downstream of the feeding roller 3 in the sheet conveyance direction. A sheet pressing lever 17 makes the leading edge of a succeeding sheet overlap the trailing edge of a preceding sheet. A first lever portion 17A of the sheet pressing lever 17 is biased by a spring around a rotating shaft 17*b* in a counterclockwise direction in FIG. 1 by setting the state shown in ST1 of FIG. 1 as a neutral point. A second lever portion 17B at the distal end of the first lever portion 17A, that is, a distal end 17*c* of the second lever portion 17B that is in contact with the printing sheet 1 is biased by the spring around the rotating shaft 17*a* in a clockwise direction in FIG. 1. A sheet detection sensor 22 detects the leading edge and the trailing edge of the printing sheet 1. The sheet detection sensor 22 detects the timing at which the leading edge of the printing sheet 1 enters the conveyance nip portion formed by the conveyance roller 5 and the pinch roller 6, and the timing at which the trailing edge of the printing sheet 1 currently undergoing a printing operation passes through the conveyance nip portion. Reverse guide members 21 form a reversing mechanism for reversing the printing sheet 1. The reverse guide members 21 guide, to the feeding nip portion formed by the feeding roller 3 and the feeding driven roller 4, the printing sheet 1 conveyed in a backward direction by the conveyance roller 5.

Figure 4A:
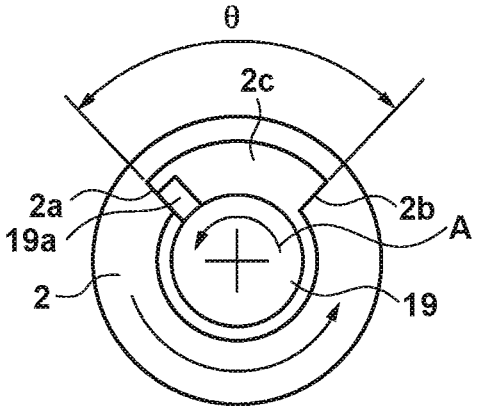
FIGS. 4A and 4B are views for explaining the arrangement of a pickup roller.
Figure 4B:
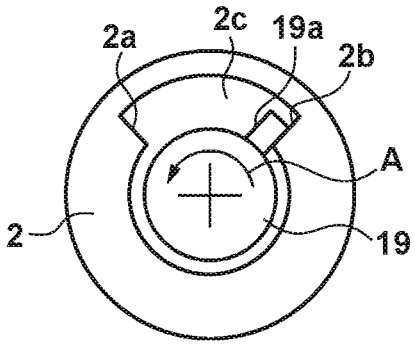

FIGS. 4A and 4B are views for explaining the arrangement of the pickup roller 2. As described above, the pickup roller 2 abuts against the top printing sheet 1 stacked on the feeding tray 11 to pick up the top printing sheet 1. A driving shaft 19 transmits driving of a feeding motor (to be described later) to the pickup roller 2. When picking up the printing sheet 1, the driving shaft 19 and the pickup roller 2 rotate in a direction indicated by an arrow A in FIGS. 4A and 4B. A projection 19*a* is formed in the driving shaft 19. A concave portion 2*c*, in which the projection 19*a* fits, is formed in the pickup roller 2. As shown in FIG. 4A, when the projection 19*a* abuts against a first surface 2*a* of the concave portion 2*c* of the pickup roller 2, driving of the driving shaft 19 is transmitted to the pickup roller 2. In this case, when the driving shaft 19 is driven, the pickup roller 2 is also rotated. On the other hand, as shown in FIG. 4B, when the projection 19*a* abuts against a second surface 2*b* of the concave portion 2*c* of the pickup roller 2, driving of the driving shaft 19 is not transmitted to the pickup roller 2. In this case, even if the driving shaft 19 is driven, the pickup roller 2 is not rotated. Also, when the projection 19*a* is formed between the first surface 2*a* and the second surface 2*b* without abutting against the first surface 2*a* or the second surface 2*b*, even if the driving shaft 19 is driven, the pickup roller 2 is not rotated.

Figure 5:
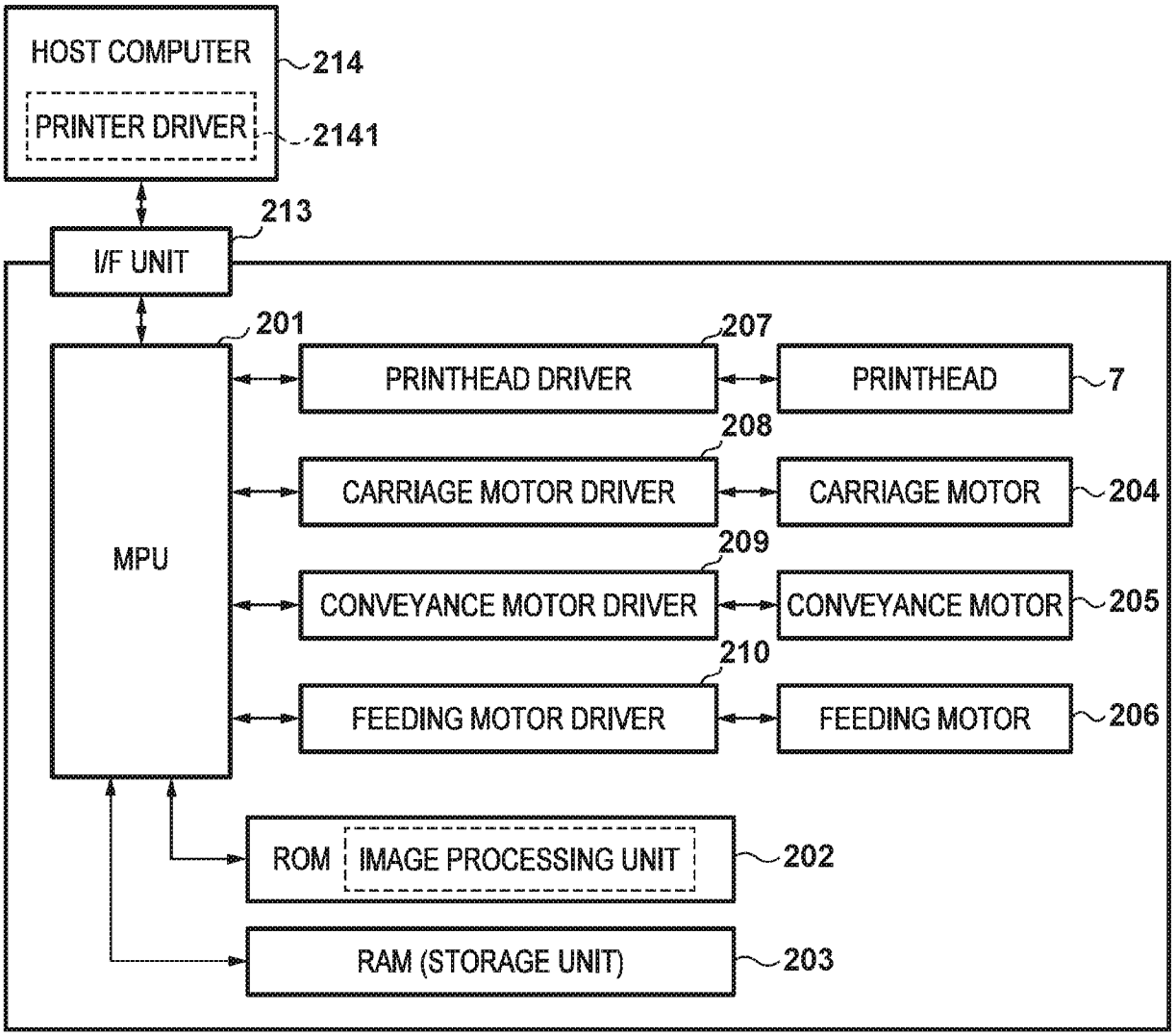
FIG. 5 is a block diagram showing the printing apparatus according to the present invention.

FIG. 5 is a block diagram showing the printing apparatus according to the present embodiment. A micro processing unit (MPU) 201 controls the operation of each unit, data processing, and the like. As will be described later, the MPU 201 also functions as a conveyance control means capable of controlling conveyance of the printing sheets 1 so that the trailing edge of a preceding sheet 1 and the leading edge of a succeeding sheet 1 overlap each other. A read only memory (ROM) 202 stores data and programs to be executed by the MPU 201. A random access memory (RAM) 203 temporarily stores processing data to be executed by the MPU 201 and data received from a host computer 214.

A printhead driver 207 controls the printhead 7. A carriage motor driver 208 controls a carriage motor 204 for driving the carriage 10. A conveyance motor 205 drives the conveyance roller 5 and the discharge roller 9. A conveyance motor driver 209 controls the conveyance motor 205. A feeding motor 206 drives the pickup roller 2 and the feeding roller 3. A feeding motor driver 210 controls the feeding motor 206.

In the host computer 214, a printer driver 2141 is used to communicate with the printing apparatus by collecting printing information, such as a printing image and printing image quality, when the user instructs the execution of a printing operation. The MPU 201 exchanges the printing image, and the like, with the host computer 214 via an interface (I/F) unit 213.

The overlap continuous feeding operation in single-sided (obverse surface) continuous printing will be described in time series with reference to ST1 of FIG. 1 to ST9 of FIG. 3. When the host computer 214 transmits printing data via the I/F unit 213, the printing data is processed by the MPU 201, and then is loaded into the RAM 203. The MPU 201 starts a printing operation based on the loaded data.

In ST1 of FIG. 1, at the beginning, the feeding motor driver 210 drives the feeding motor 206 at low speed. This rotates the pickup roller 2 (first feeding roller) at 7.6 inches/sec. When the pickup roller 2 rotates, the top printing sheet (a preceding sheet 1-A) stacked on the feeding tray 11 is picked up. The preceding sheet 1-A picked up by the pickup roller 2 is conveyed by the feeding roller 3 (a second feeding roller) rotating in the same direction as that of the pickup roller 2. The feeding motor 206 also drives the feeding roller 3. The present embodiment will be described by using an arrangement including the pickup roller 2 and the feeding roller 3. An arrangement including only a feeding roller for feeding the printing sheet stacked on the stacking unit may, however, be adopted.

When the sheet detection sensor 16 provided on the downstream side of the feeding roller 3 detects the leading edge of the preceding sheet 1-A, the feeding motor 206 is switched to high-speed driving. That is, the pickup roller 2 and the feeding roller 3 rotate at 20 inches/sec.

In ST2, by continuously rotating the feeding roller 3, the leading edge of the preceding sheet 1-A pushes the flapper 20 away against its own weight, and then rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and the pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion.

In ST3, upon end of the skew correction operation of the preceding sheet 1-A, the conveyance motor 205 is driven to start rotation of the conveyance roller 5. The conveyance roller 5 conveys the preceding sheet 1-A at 15 inches/sec. After the preceding sheet 1-A is aligned with the position facing the printhead 7, a printing operation is performed by discharging ink from the printhead 7 based on the printing data. Note that the alignment operation is performed by making the leading edge of the printing sheet 1 abut against the conveyance nip portion to temporarily position the printing sheet 1 at the position of the conveyance roller 5, and controlling the rotation amount of the conveyance roller 5 with reference to the position of the conveyance roller 5.

The printing apparatus of the present embodiment is a serial type printing apparatus in which the carriage 10 mounts the printhead 7. An operation of printing the printing sheet 1 is performed by repeating a conveyance operation of intermittently conveying the printing sheet 1 by a predetermined amount using the conveyance roller 5 and an image forming operation of discharging ink from the printhead 7 while moving the carriage 10 incorporating the printhead 7 when the conveyance roller 5 stops.

When alignment of the preceding sheet 1-A is performed, the feeding motor 206 is switched to low-speed driving. That is, the pickup roller 2 and the feeding roller 3 rotate at 7.6 inches/sec. While the conveyance roller 5 intermittently conveys the printing sheet 1 by the predetermined amount, the feeding motor 206 also intermittently drives the feeding roller 3. That is, while the conveyance roller 5 rotates, the feeding roller 3 also rotates. While the conveyance roller 5 stops, the feeding roller 3 also stops. The rotation speed of the feeding roller 3 is lower than that of the conveyance roller 5. Consequently, the printing sheet 1 is stretched between the conveyance roller 5 and the feeding roller 3. The feeding roller 3 is rotated together with the printing sheet 1 conveyed by the conveyance roller 5.

Since the feeding motor 206 is intermittently driven, the driving shaft 19 is also driven. As described above, the rotation speed of the pickup roller 2 is lower than that of the conveyance roller 5. Consequently, the pickup roller 2 is rotated together with the printing sheet 1 conveyed by the conveyance roller 5. That is, the pickup roller 2 rotates ahead of the driving shaft 19. More specifically, the projection 19*a* of the driving shaft 19 is spaced apart from the first surface 2*a* and abuts against the second surface 2*b*. Therefore, the second printing sheet (a succeeding sheet 1-B) is not picked up soon after the trailing edge of the preceding sheet 1-A passes through the pickup roller 2. After the driving shaft 19 is driven for a predetermined time, the projection 19*a* abuts against the first surface 2*a* and the pickup roller 2 starts to rotate.

In ST4 of FIG. 2, a state in which the pickup roller 2 starts to rotate, and picks up the succeeding sheet 1-B is shown. Due to a factor such as the responsiveness of the sensor, the sheet detection sensor 16 requires a predetermined interval or more between the printing sheets 1-A, 1-B to detect the edges of the printing sheets 1-A, 1-B. That is, it is necessary to separate the leading edge of the succeeding sheet 1-B from the trailing edge of the preceding sheet 1-A by a predetermined distance to provide a predetermined time interval from when the sheet detection sensor 16 detects the trailing edge of the preceding sheet 1-A until the sheet detection sensor 16 detects the leading edge of the succeeding sheet 1-B. To achieve this, the angle θ of the concave portion 2*c* of the pickup roller 2 is set to about 70°.

In ST5, the succeeding sheet 1-B picked up by the pickup roller 2 is conveyed by the feeding roller 3. At this time, the preceding sheet 1-A undergoes an image forming operation by the printhead 7 based on the printing data. When the sheet detection sensor 16 detects the leading edge of the succeeding sheet 1-B, the feeding motor 206 is switched to high-speed driving. That is, the pickup roller 2 and the feeding roller 3 rotate at 20 inches/sec.

In ST6, the tip end 17*c* of the second lever portion 17B of the sheet pressing lever 17 presses the trailing edge of the preceding sheet 1-A downward, as shown in ST5 of FIG. 2. It is possible to form a state in which the leading edge of the succeeding sheet 1-B overlaps the trailing edge of the preceding sheet 1-A by moving the succeeding sheet 1-B at a speed that is greater than that at which the preceding sheet 1-A moves downstream by the printing operation of the printhead 7 (ST6 of FIG. 2). Since the preceding sheet 1-A undergoes the printing operation based on the printing data, the preceding sheet 1-A is intermittently conveyed by the conveyance roller 5. On the other hand, after the sheet detection sensor 16 detects the leading edge of the succeeding sheet 1-B, the succeeding sheet 1-B can catch up with the preceding sheet 1-A by continuously rotating the feeding roller 3 at 20 inches/sec.

In ST7 of FIG. 3, after forming an overlap state in which the leading edge of the succeeding sheet 1-B overlaps the trailing edge of the preceding sheet 1-A, the succeeding sheet 1-B is conveyed by the feeding roller 3 until the leading edge of the succeeding sheet 1-B stops at a predetermined position upstream of the conveyance nip portion. The position of the leading edge of the succeeding sheet 1-B is calculated from the rotation amount of the feeding roller 3 after the sheet detection sensor 16 detects the leading edge of the succeeding sheet 1-B, and is controlled based on the calculation result. At this time, the preceding sheet 1-A undergoes an image forming operation based on the printing data by the printhead 7.

In ST8, when the conveyance roller 5 stops to perform the image forming operation (ink discharge operation) of the last row of the preceding sheet 1-A, the feeding roller 3 is driven to make the leading edge of the printing sheet 1-B abut against the conveyance nip portion, thereby performing the skew correction operation of the succeeding sheet 1-B.

In ST9, when the image forming operation of the last row of the preceding sheet 1-A ends, it is possible to perform alignment of the succeeding sheet 1-B while keeping the state in which the succeeding sheet 1-B overlaps the preceding sheet 1-A by rotating the conveyance roller 5 by a predetermined amount. The succeeding sheet 1-B undergoes a printing operation by the printhead 7 based on the printing data. When the succeeding sheet 1-B is intermittently conveyed for the printing operation, the preceding sheet 1-A is also intermittently conveyed, and is finally discharged outside the printing apparatus by the discharge roller 9.

When alignment of the succeeding sheet 1-B is performed, the feeding motor 206 is switched to low-speed driving. That is, the pickup roller 2 and the feeding roller 3 rotate at 7.6 inches/sec. If there is printing data even after the succeeding sheet 1-B is printed, the process returns to ST4 of FIG. 2 to pick up a third printing sheet.

Figure 6A:
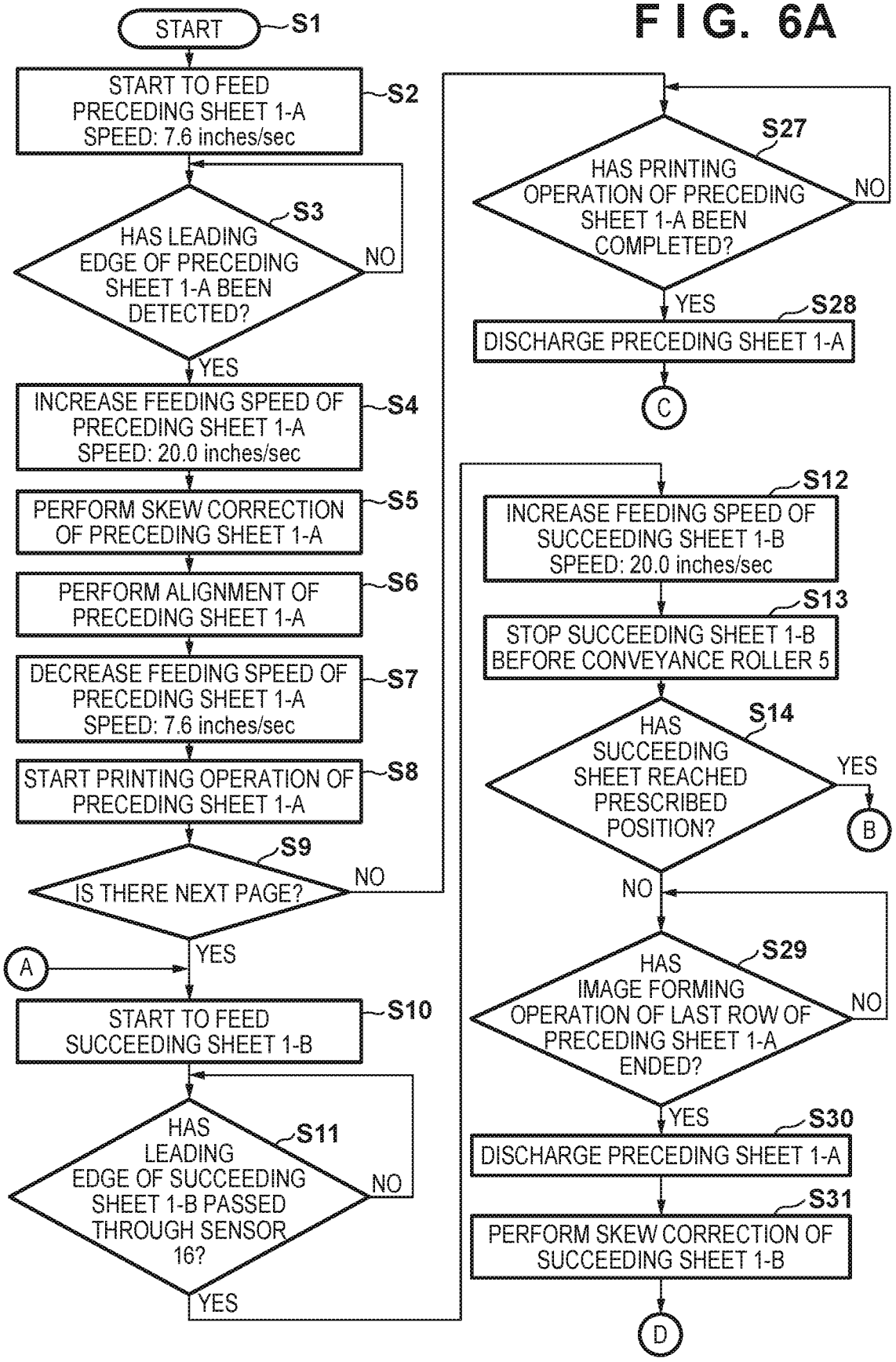
FIGS. 6A and 6B are flowcharts illustrating the overlap continuous feeding operation according to the present invention.
Figure 6B:
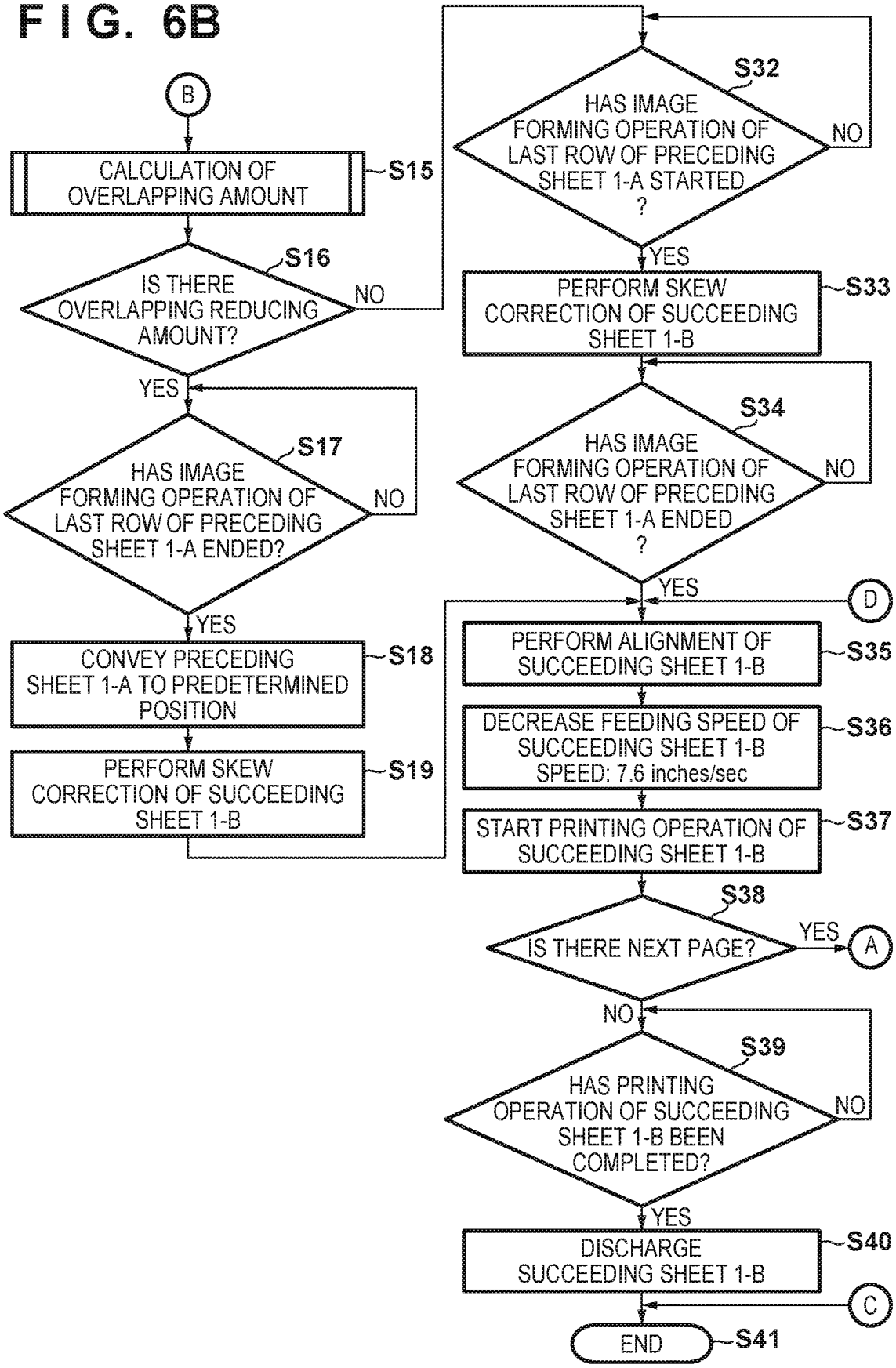

FIGS. 6A and 6B show an overlap continuous feeding sequence in single-sided continuous printing.

In step S1, when the host computer 214 transmits printing data via the I/F unit 213, a printing operation starts. In step S2, the feeding operation of the preceding sheet 1-A starts. More specifically, the feeding motor 206 is driven at low speed. The pickup roller 2 rotates at 7.6 inches/sec. The pickup roller 2 picks up the preceding sheet 1-A, and the feeding roller 3 feeds the preceding sheet 1-A toward the printhead 7.

In step S3, the sheet detection sensor 16 detects the leading edge of the preceding sheet 1-A. When the sheet detection sensor 16 detects the leading edge of the preceding sheet 1-A, the feeding motor 206 is switched to high-speed driving in step S4. That is, the pickup roller 2 and the feeding roller 3 rotate at 20 inches/sec. By controlling the rotation amount of the feeding roller 3 after the sheet detection sensor 16 detects the leading edge of the preceding sheet 1-A, the leading edge of the preceding sheet 1-A is also made to abut against the conveyance nip portion to perform the skew correction operation of the preceding sheet 1-A.

In step S6, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5. In step S7, the feeding motor 206 is switched to low-speed driving. In step S8, a printing operation starts when the printhead 7 discharges ink to the preceding sheet 1-A. More specifically, the printing operation of the preceding sheet 1-A is performed by repeating a conveyance operation of intermittently conveying the preceding sheet 1-A by the conveyance roller 5 and an image forming operation (ink discharge operation) of discharging ink from the printhead 7 by moving the carriage 10. The feeding motor 206 is intermittently driven at low speed in synchronization with the operation of intermittently conveying the preceding sheet 1-A by the conveyance roller 5. That is, the pickup roller 2 and the feeding roller 3 intermittently rotate at 7.6 inches/sec.

In step S9, it is determined whether there is printing data of the next page. If there is no printing data of the next page, the process advances to step S27. Upon completion of the printing operation of the preceding sheet 1-A in step S27, the preceding sheet 1-A is discharged in step S28, thereby terminating the printing operation.

If there is printing data of the next page in step S9, the feeding operation of the succeeding sheet 1-B starts in step S10. More specifically, the pickup roller 2 picks up the succeeding sheet 1-B, and the feeding roller 3 feeds the succeeding sheet 1-B toward the printhead 7. The pickup roller 2 rotates at 7.6 inches/sec. As described above, since the large concave portion 2*c* of the pickup roller 2 is provided with respect to the projection 19*a* of the driving shaft 19, the succeeding sheet 1-B is fed while having a predetermined interval with respect to the trailing edge of the preceding sheet 1-A.

In step S11, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S12. That is, the pickup roller 2 and the feeding roller 3 rotate at 20 inches/sec. In step S13, by controlling the rotation amount of the feeding roller 3 after the sheet detection sensor 16 detects the leading edge of the succeeding sheet 1-B, the succeeding sheet 1-B is conveyed so that its leading edge is at a position a predetermined amount before the conveyance nip portion. The preceding sheet 1-A is intermittently conveyed based on the printing data. Continuously driving the feeding motor 206 at high speed forms the overlap state in which the leading edge of the succeeding sheet 1-B overlaps the trailing edge of the preceding sheet 1-A.

In step S14, it is determined whether the leading edge of the succeeding sheet 1-B has reached a prescribed position (a position P3 in ST5 of FIG. 8 (to be described later)). If the leading edge has not reached the prescribed position, the overlap state is canceled to perform alignment of the succeeding sheet 1-B. More specifically, if it is determined in step S29 that the image forming operation of the last row of the preceding sheet 1-A has ended, the discharge operation of the preceding sheet 1-A is performed in step S30. During this operation, the feeding motor 206 is not driven, and thus, the succeeding sheet 1-B stops while its leading edge is at the position the predetermined amount before the conveyance nip portion. Since the preceding sheet 1-A is discharged, the overlap state is canceled. In step S31, the leading edge of the succeeding sheet 1-B is made to abut against the conveyance nip portion to perform the skew correction operation of the succeeding sheet 1-B. In step S35, alignment of the succeeding sheet 1-B is performed.

On the other hand, if it is determined in step S14 that the succeeding sheet 1-B has reached the prescribed position, an overlapping amount is calculated in step S15. After that, processing is different depending on the presence/absence of an overlapping reducing amount calculated in the overlapping amount calculation processing. In step S16, the presence/absence of an overlapping reducing amount is determined. If there is no overlapping reducing amount, it is possible to perform the skew correction operation of the succeeding sheet 1-B during the image forming operation of the last row of the preceding sheet 1-A, and thus, the process advances to step S32. In step S32, the process stands by for the start of the image forming operation of the preceding sheet 1-A. In step S33, the leading edge of the succeeding sheet 1-B is made to abut against the conveyance nip portion while keeping the overlap state, thereby performing the skew correction operation of the succeeding sheet 1-B. In step S34, it is determined whether the image forming operation of the last row of the preceding sheet 1-A has ended. If the image forming operation has ended, alignment of the succeeding sheet 1-B is performed in step S35 while keeping the overlap state.

On the other hand, if it is determined in step S16 that there is an overlapping reducing amount, the process stands by for the end of the image forming operation of the last row of the preceding sheet 1-A in step S17. Upon the end of the image forming operation of the last row of the preceding sheet 1-A, the process advances to step S18, and the preceding sheet 1-A is conveyed to a predetermined position by the conveyance roller 5 to have an overlapping amount (to be described later). After the leading edge of the succeeding sheet 1-B is made to abut against the conveyance nip portion to perform the skew correction operation of the succeeding sheet 1-B in step S19, alignment of the succeeding sheet 1-B is performed in step S35.

In step S36, the feeding motor 206 is switched to low-speed driving. In step S37, a printing operation starts by discharging ink from the printhead 7 to the succeeding sheet 1-B. More specifically, the printing operation of the succeeding sheet 1-B is performed by repeating a conveyance operation of intermittently conveying the succeeding sheet 1-B by the conveyance roller 5 and an image forming operation (ink discharge operation) of discharging ink from the printhead 7 by moving the carriage 10. The feeding motor 206 is intermittently driven at low speed in synchronization with the operation of intermittently conveying the succeeding sheet 1-B by the conveyance roller 5. That is, the pickup roller 2 and the feeding roller 3 intermittently rotate at 7.6 inches/sec.

In step S38, it is determined whether there is printing data of the next page (i.e., the third page). If there is printing data of the next page, the process returns to step S10. If there is no printing data of the next page, when the image forming operation of the succeeding sheet 1-B is complete in step S39, the discharge operation of the succeeding sheet 1-B is performed in step S40 and the printing operation ends in step S41.

Figure 7:
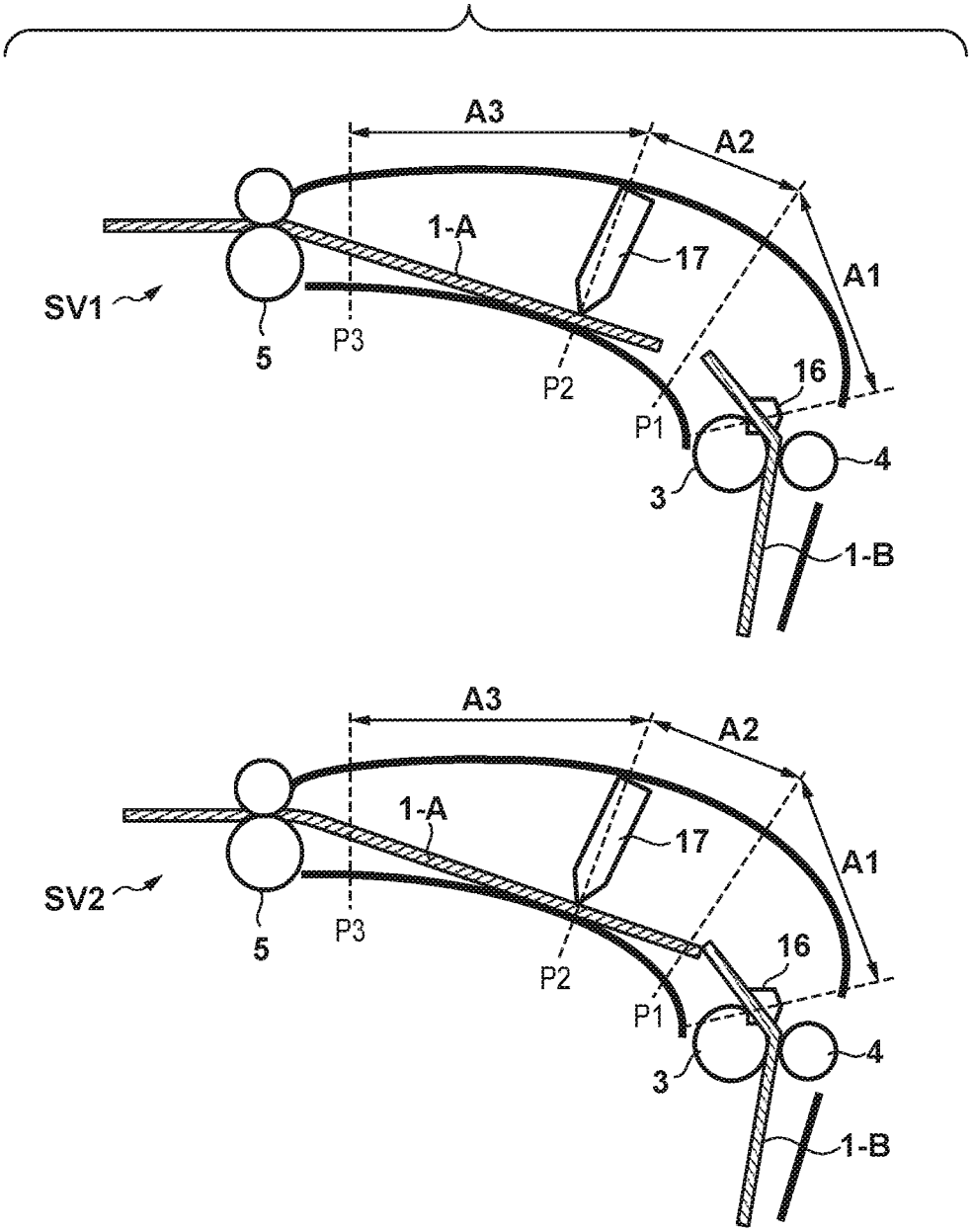
FIGS. 7 and 8 are views for explaining the operation of making the succeeding sheet overlap the preceding sheet.
Figure 8:
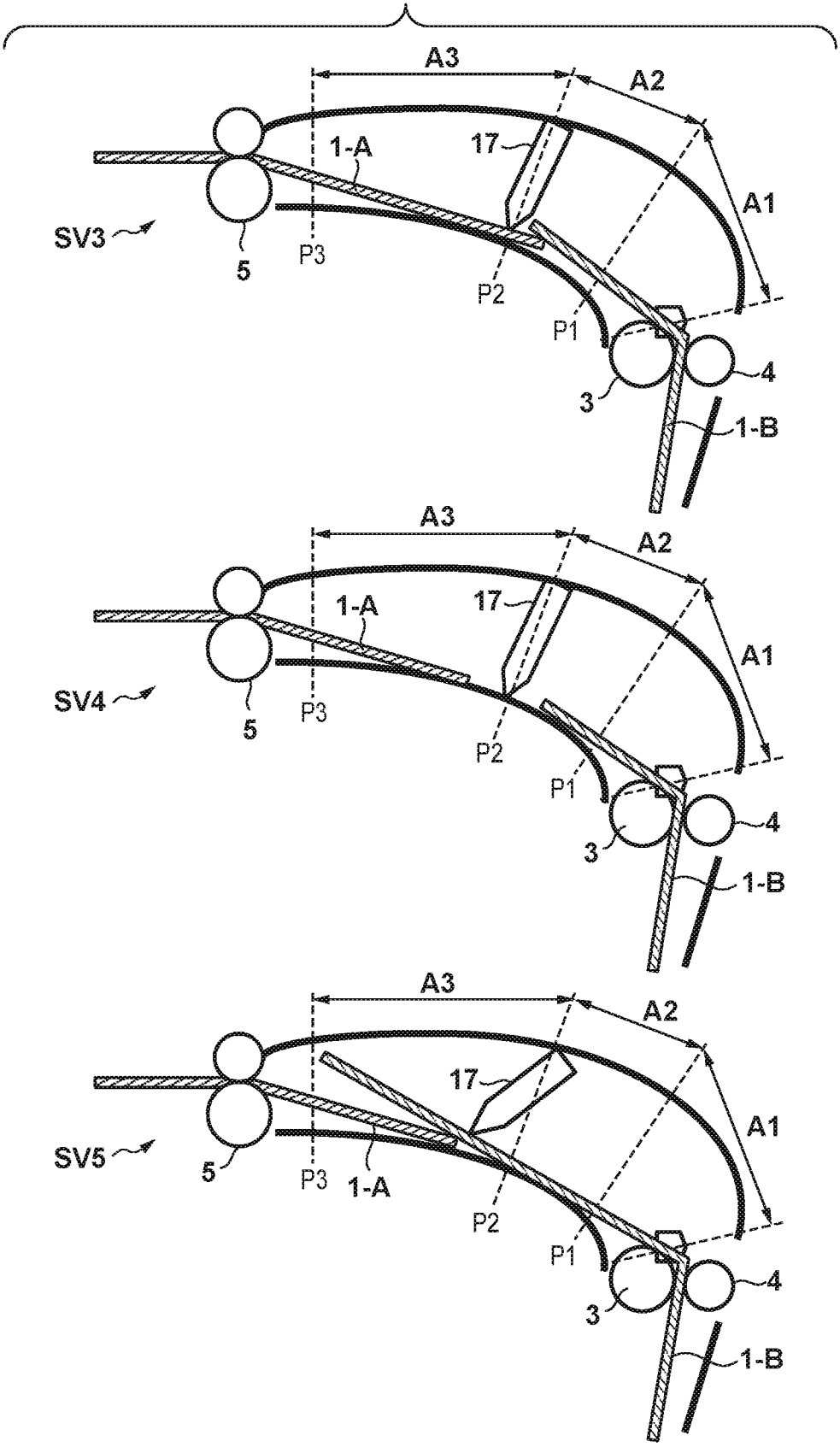

FIGS. 7 and 8 are views for explaining an operation of making a succeeding sheet 1-B overlap a preceding sheet 1-A according to the present embodiment. The operation of forming the overlap state in which the leading edge of the succeeding sheet 1-B overlaps the trailing edge of the preceding sheet 1-A, explained in steps S12 and S13 of FIG. 6A, will be described.

FIGS. 7 and 8 are enlarged views each showing a portion between the feeding nip portion, formed by the feeding roller 3 and the feeding driven roller 4, and the conveyance nip portion, formed by the conveyance roller 5 and the pinch roller 6.

Three states in a process of conveying the printing sheets 1 by the conveyance roller 5 and the feeding roller 3 will be sequentially described.

The first state in which an operation of making the succeeding sheet 1-B chase the preceding sheet 1-A is performed will be described with reference to SV1 and SV2 of FIG. 7. The second state in which an operation of making the succeeding sheet 1-B overlap the preceding sheet 1-A is performed will be described with reference to SV3 and SV4 of FIG. 8. The third state in which it is determined whether to perform the skew correction operation of the succeeding sheet 1-B while keeping the overlap state will be described with reference to SV5 of FIG. 8.

In SV1 of FIG. 7, the feeding roller 3 is controlled to convey the succeeding sheet 1-B, and the sheet detection sensor 16 detects the leading edge of the succeeding sheet 1-B. A section from the sheet detection sensor 16 to a position P1 at which the succeeding sheet 1-B can be made to overlap the preceding sheet 1-A is defined as a first section A1. In the first section A1, an operation of making the leading edge of the succeeding sheet 1-B chase the trailing edge of the preceding sheet 1-A is performed. The position P1 is decided based on the arrangement of the mechanism.

In the first state, the chasing operation may stop in the first section A1. If, as shown in SV2 of FIG. 7, the leading edge of the succeeding sheet 1-B passes the trailing edge of the preceding sheet 1-A before the position P1, the operation of making the succeeding sheet 1-B overlap the preceding sheet 1-A is not performed.

In SV3 of FIG. 8, a section from the above-described position P1 to a position P2 at which the sheet pressing lever 17 is provided is defined as a second section A2. In the second section A2, the operation of making the succeeding sheet 1-B overlap the preceding sheet 1-A is performed.

In the second state, the operation of making the succeeding sheet 1-B overlap the preceding sheet 1-A may stop in the second section A2. If, as shown in SV4 of FIG. 8, the leading edge of the succeeding sheet 1-B cannot catch up with the trailing edge of the preceding sheet 1-A within the second section A2, it is impossible to perform the operation of making the succeeding sheet 1-B overlap the preceding sheet 1-A.

In SV5, a section from the above-described position P2 to a position P3 is defined as a third section A3. The position P3 is the position of the leading edge of the succeeding sheet 1-B when the succeeding sheet stops in step S13 of FIG. 6A. While the succeeding sheet 1-B overlaps the preceding sheet 1-A, the succeeding sheet 1-B is conveyed so that its leading edge reaches the position P3. In the third section A3, it is determined whether to perform alignment of the succeeding sheet 1-B by making it abut against the conveyance nip portion while keeping the overlap state. That is, it is determined whether to perform alignment of the succeeding sheet 1-B by executing a skew correction operation while keeping the overlap state or to perform alignment of the succeeding sheet 1-B by canceling the overlap state and performing a skew correction operation.

Processing of deciding an overlapping amount Lt(B) of the preceding sheet 1-A and the succeeding sheet 1-B will be described with reference to FIGS. 9 to 15.

Figure 9:
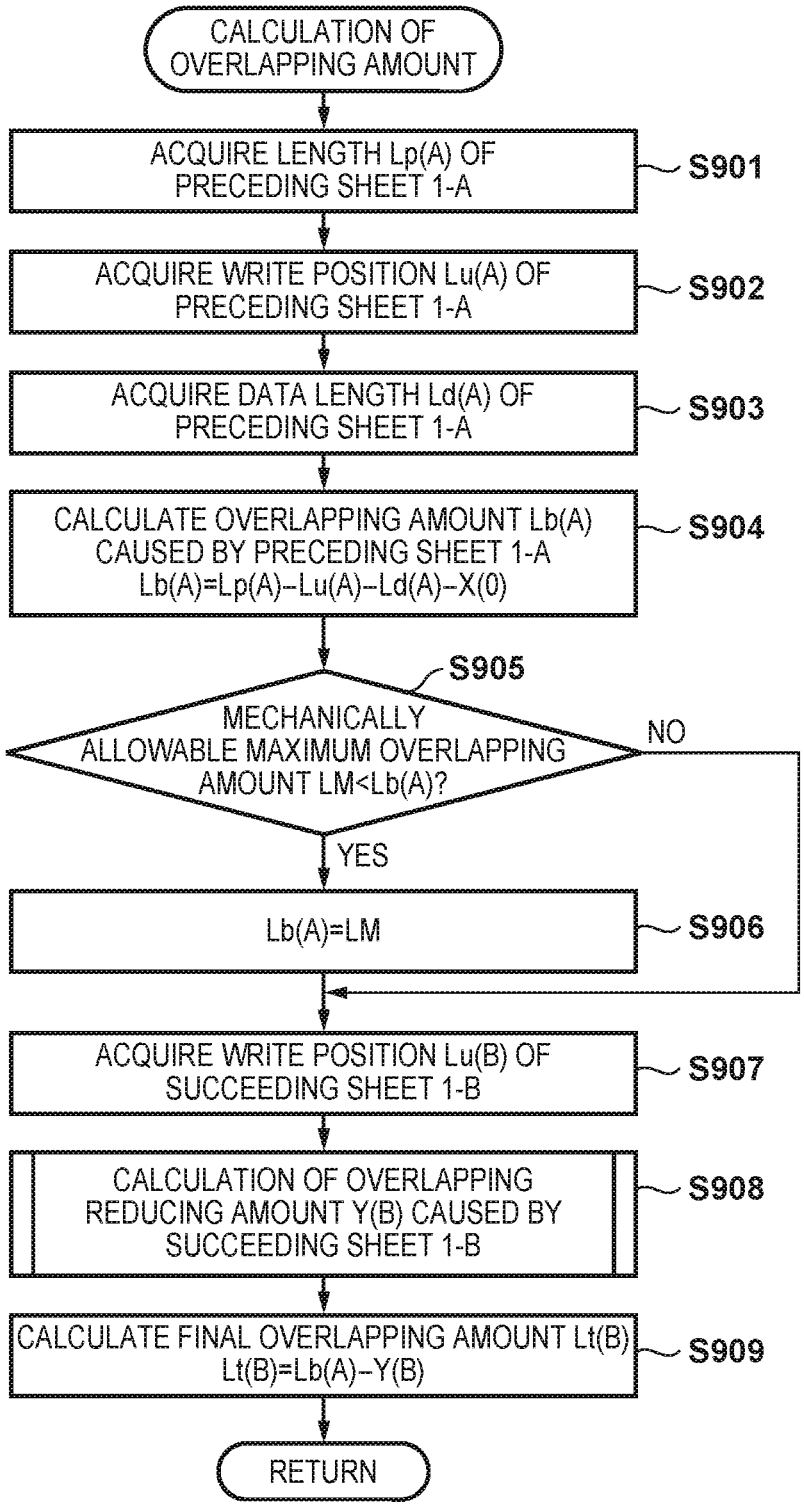
FIG. 9 is a flowchart illustrating processing of deciding an overlapping amount Lt(B) according to a first embodiment.
Figure 10:
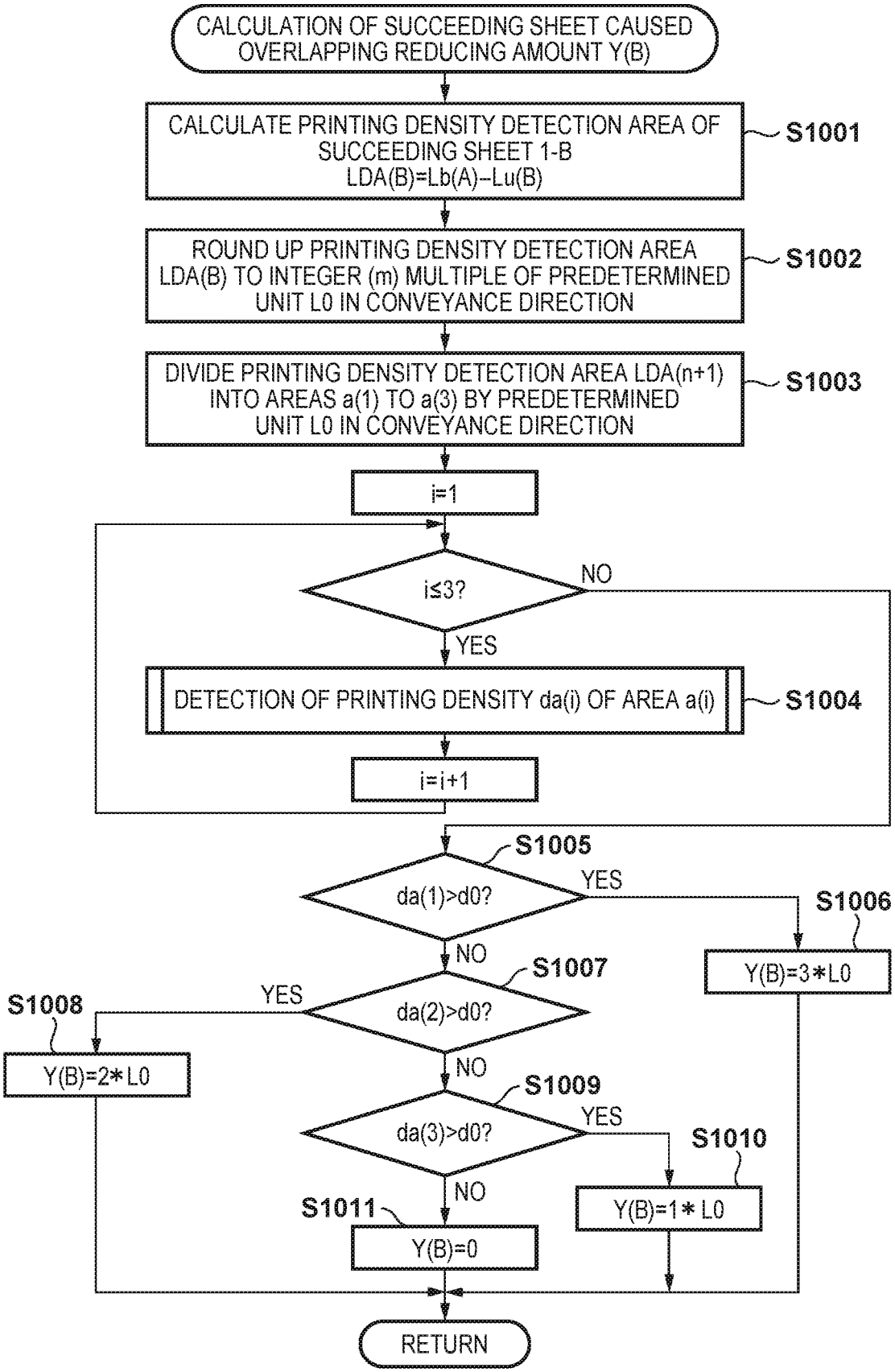
FIG. 10 is a flowchart illustrating processing of deciding a succeeding sheet caused overlapping reducing amount Y(B) according to the first embodiment.
Figure 11:
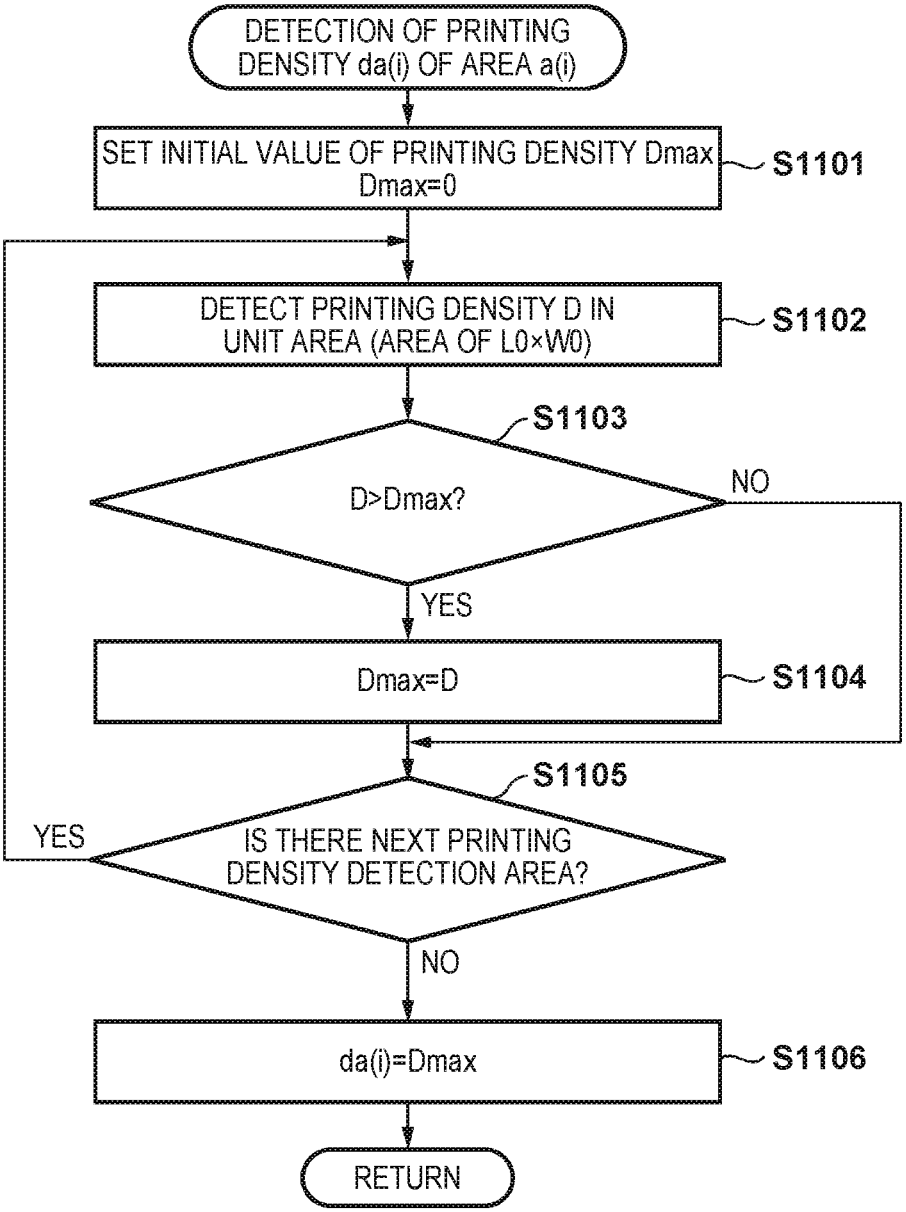
FIG. 11 is a flowchart illustrating processing of detecting a printing density according to the first embodiment.
Figure 12:
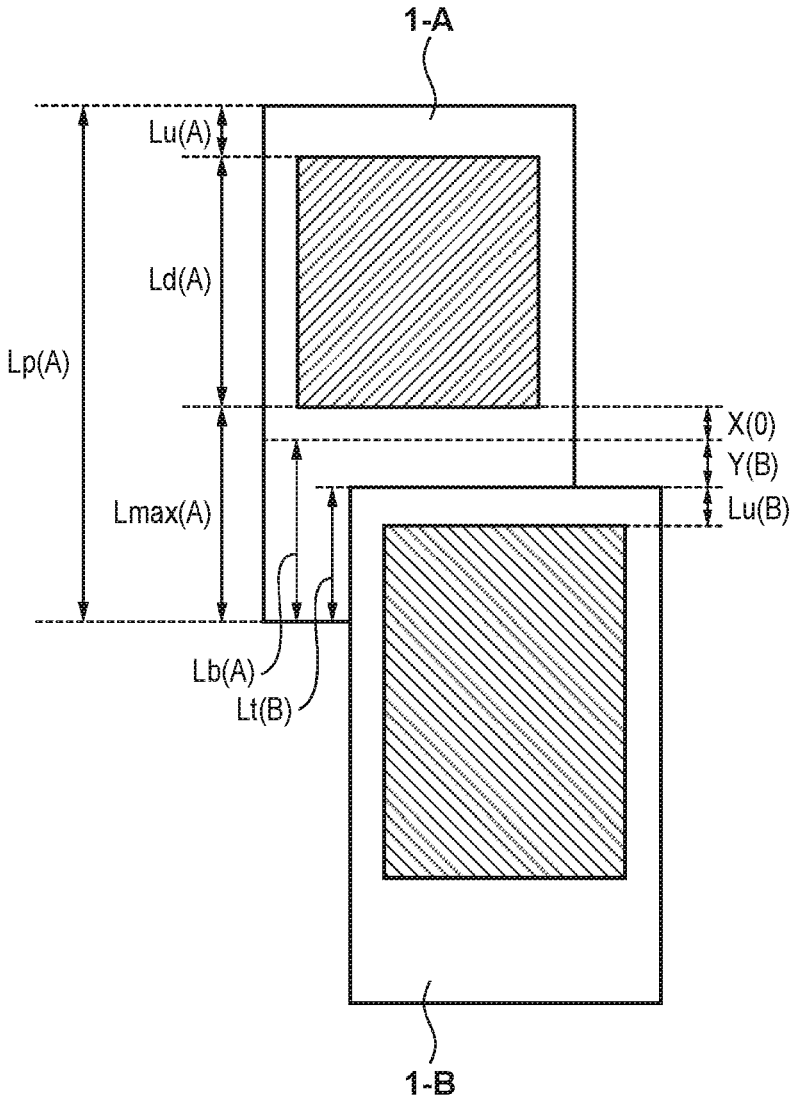
FIG. 12 is a schematic view showing the overlapping area of printing sheets according to the first embodiment.

FIG. 9 shows the overlapping amount calculation processing in step S15 of FIG. 6A. FIGS. 10 and 11 show processing of calculating an overlapping reducing amount Y(B) depending on the succeeding sheet 1-B in step S908 of FIG. 9. FIG. 12 is a schematic view showing the overlapping area of the printing sheets 1. FIG. 13 is a schematic view showing cockling on the succeeding sheet 1-B overlapping the preceding sheet 1-A. FIG. 14 is a view for explaining division of a printing density detection area on the succeeding sheet 1-B.

The sheet size of the preceding sheet 1-A is acquired from printing information of the preceding sheet 1-A transmitted from the host computer 214, thereby acquiring a length Lp(A) of the preceding sheet 1-A in the conveyance direction (step S901). Furthermore, a write position Lu(A) of data to be printed on the preceding sheet 1-A and a data length Ld(A) are acquired from the printing information (steps S902 and S903). As shown in FIG. 12, it is possible to calculate a margin Lmax(A) of the leading edge of the preceding sheet 1-A based on the length Lp(A) of the preceding sheet 1-A, the write position Lu(A), and the printing data length Ld(A). A value obtained by subtracting, from the margin Lmax(A) of the trailing edge, a predetermined overlapping margin X(0) considering the overlapping accuracy of the feeding roller 3 and the conveyance roller 5 is set as an overlapping amount (preceding sheet caused overlapping amount) Lb(A) depending on the preceding sheet 1-A (step S904). For the sake of simplicity, the printing data length Ld(A) is acquired at the start of printing of the preceding sheet 1-A. Even if the printing data length Ld(A) is unknown at the start of printing of the preceding sheet 1-A, however, it may be acquired during the printing operation.

On the other hand, a conveyance path sandwiched between the conveyance guides 15 and the arrangement of the conveyance roller 5 and the feeding roller 3 impose an upper limit LM of an overlapping distance in terms of the mechanism. Therefore, the preceding sheet caused overlapping amount Lb(A) calculated based on the printing data is compared with the upper limit LM of the overlapping distance. If the upper limit LM is smaller, the preceding sheet caused overlapping amount Lb(A) is replaced by the upper limit LM (steps S905 and S906).

Processing of calculating the overlapping reducing amount (succeeding sheet caused overlapping reducing amount) Y(B) depending on the succeeding sheet 1-B is performed next.

In step S907, a write position Lu(B) of data to be printed on the succeeding sheet 1-B is acquired from printing information of the succeeding sheet 1-B transmitted from the host computer 214.

In step S908, the succeeding sheet caused overlapping reducing amount Y(B) is calculated. When performing a printing operation (overlapping printing) by making the succeeding sheet 1-B overlap the preceding sheet 1-A, the succeeding sheet 1-B does not exist immediately above platen ribs 8*a* and the preceding sheet 1-A exists between the marginal area and the platen ribs 8*a*, as shown in FIG. 13. Since the reverse surface of the succeeding sheet 1-B is constrained not by the platen ribs 8*a*, but by the preceding sheet 1-A, if the printing density of the leading edge of the succeeding sheet 1-B is high, the succeeding sheet 1-B is brought closer to the printhead 7 by the height of a deformation caused by cockling. Consequently, if there is a possibility that the height of the deformation caused by cockling is large and the succeeding sheet 1-B grazes against the printhead 7, it is necessary to set the succeeding sheet caused overlapping reducing amount Y(B) so as to avoid overlapping printing.

Details of the processing of calculating the succeeding sheet caused overlapping reducing amount Y(B) in step S908 of FIG. 9 will be described with reference to FIG. 10.

In step S1001, a printing density detection area LDA(B) of the succeeding sheet 1-B is obtained based on the already calculated preceding sheet caused overlapping amount Lb(A) and the write position Lu(B) of the data to be printed on the succeeding sheet 1-B.

In step S1002, to simplify printing density detection processing, round-up processing is performed so that the printing density detection area LDA(B) becomes an m (m is an integer) multiple of a distance L0 of a unit area in the conveyance direction. Assume that m=3. As shown in FIG. 14, the printing density detection area is divided into three areas a(1), a(2), and a(3) (step S1003). A printing density da(i) of a printing area a(i) is calculated (step S1004).

The printing density da(i) is obtained based on an ink discharge dot count in a unit area of a predetermined printing density detection area. An ink discharge amount is different depending on the diameter of each nozzle. By setting a large color dot (cyan, magenta, or yellow) as a reference (=1), however, a small color dot is defined by the reference×⅛ and a black dot is defined by the reference×2. In this embodiment, 600 dpi is set as one pixel, and a printing density when an ink amount per pixel is obtained by the reference×2 is defined as 100%. As shown in FIG. 14, in this embodiment, let L0 be the distance of the unit area in the conveyance direction (sub-scanning direction), and W0 be the distance of the printhead 7 in the scanning direction (main scanning direction) orthogonal to the conveyance direction. Then, assume that the distance L0 is 256 pixels, and the distance W0 is 640 pixels. A printing density D is calculated based on an average ink amount per block of 1 pixel×1 pixel in this unit area.

FIG. 11 shows details of the printing density detection processing in step S1004 of FIG. 10. A maximum value Dmax of the printing densities is set as an initial value (step S1101), and the detected printing densities D in the unit areas are sequentially acquired in the printing density detection area a(1) (step S1102). The acquired printing density D is compared with the maximum value Dmax of the already acquired printing densities D (step S1103), and the maximum value Dmax is updated (step S1104). The processes in steps S1102 to S1104 are repeated for each detection area (step S1105), and the finally acquired printing density Dmax is set as a printing density da(1) in the printing density detection area a(1) (step S1106). Printing densities da(2) and da(3) are detected for the areas a(2) and a(3), respectively, in the same manner.

A predetermined printing density threshold d0 is set, and the printing density da(1), da(2), or da(3) is compared with the threshold d0. FIG. 15 shows the printing density threshold d0. As a printing pass count (the scanning count of the printhead 7) in an image forming operation increases, the threshold d0 decreases. This is because the printing time is different depending on the printing pass count, and a deformation amount caused by cockling on a printing sheet 1 increases as the printing time is longer.

Referring back to FIG. 10, comparison processing is performed from the area a(1) on the leading edge side. When the threshold d0 is exceeded, the area and the subsequent areas are set as overlapping disable areas. To determine whether the area a(1) is an overlapping enable area, the printing density da(1) is compared with the threshold d0 (step S1005). If the printing density da(1) exceeds the threshold d0, the area a(1) is an overlapping disable area, and the succeeding sheet caused overlapping reducing amount Y(B) is set (step S1006) by:

$$Y(B)=m\cdot L0=3\times L0.$$

The process then ends.

On the other hand, if it is determined in step S1005 that the printing density da(1) is equal to or less than the threshold d0, the area a(1) is an overlapping enable area, and the process transits to the overlapping enable/disable determination processing of the area a(2). In step S1007, the overlapping enable/disable determination processing of the area a(2) is performed, similarly to the area a(1). If the area a(2) is an overlapping disable area, the succeeding sheet caused overlapping reducing amount Y(B) is calculated (step S1008), thereby terminating the process. If the area a(2) is an overlapping enable area, the process transits to the overlapping enable/disable determination processing of the area a(3). In step S1009, the overlapping enable/disable determination processing of the area a(3) is performed in the same manner. If the area a(3) is an overlapping disable area, the succeeding sheet caused overlapping reducing amount Y(B) is calculated (step S1010), thereby terminating the process. If the area a(3) is an overlapping enable area, all the determination areas are overlapping enable areas, and thus the succeeding sheet caused overlapping reducing amount Y(B) is set to zero (step S1011), thereby terminating the process.

The final overlapping amount Lt(B) is calculated from the thus obtained succeeding sheet caused overlapping reducing amount Y(B) and the already calculated preceding sheet caused overlapping reducing amount Lb(A) (step S909 of FIG. 9).

In the processing of calculating the overlapping amount Lt(B) of FIG. 9, the succeeding sheet caused overlapping reducing amount Y(B) is calculated based on the printing densities da(1) to da(3), as described with reference to FIGS. 10 and 11. The deformation amount of the succeeding sheet 1-B may be estimated, however, based on the printing densities da(1) to da(3) and another printing condition (the printing pass count or the printing time), and then the succeeding sheet caused overlapping reducing amount Y(B) may be obtained based on the estimated deformation amount.

Furthermore, in the above-described processing of calculating the overlapping amount Lt(B), the printing density threshold is changed according to the printing pass count in an image forming operation. If the printing pass count is large, an image quality priority mode is set, and thus an overlapping operation need not be performed.

If the succeeding sheet caused overlapping reducing amount Y(B) is zero, the printing sheets 1 are eventually made to overlap each other by the marginal amount of the trailing edge of the preceding sheet 1-A except for the predetermined overlapping margin X(0). The present invention is, however, exclusive of a case in which the printing sheets 1 are always made to overlap each other by the marginal amount of the trailing edge in consideration of a constant overlapping margin.

In this embodiment, areas of the trailing edge of the preceding sheet 1-A and the leading edge of the succeeding sheet 1-B, in which no printing is performed, are defined as margins. The present invention is also inclusive of a case in which a margin within a printable range is defined as an area in which there is no printing data.

According to the above-described embodiment, it is possible to increase the speed of printing while suppressing a stain on a sheet, a sheet jam, a deterioration in image quality, or the like, caused when printing sheets 1 are conveyed by making the succeeding sheet 1-B overlap the preceding sheet 1-A and high-density printing is performed.

Second Embodiment

Processing of deciding a preceding sheet caused overlapping amount Lb(A) according to the second embodiment will be described with reference to FIGS. 16 to 23.

An apparatus configuration according to this embodiment is the same as in the first embodiment and a description thereof will be omitted.

Figure 16:
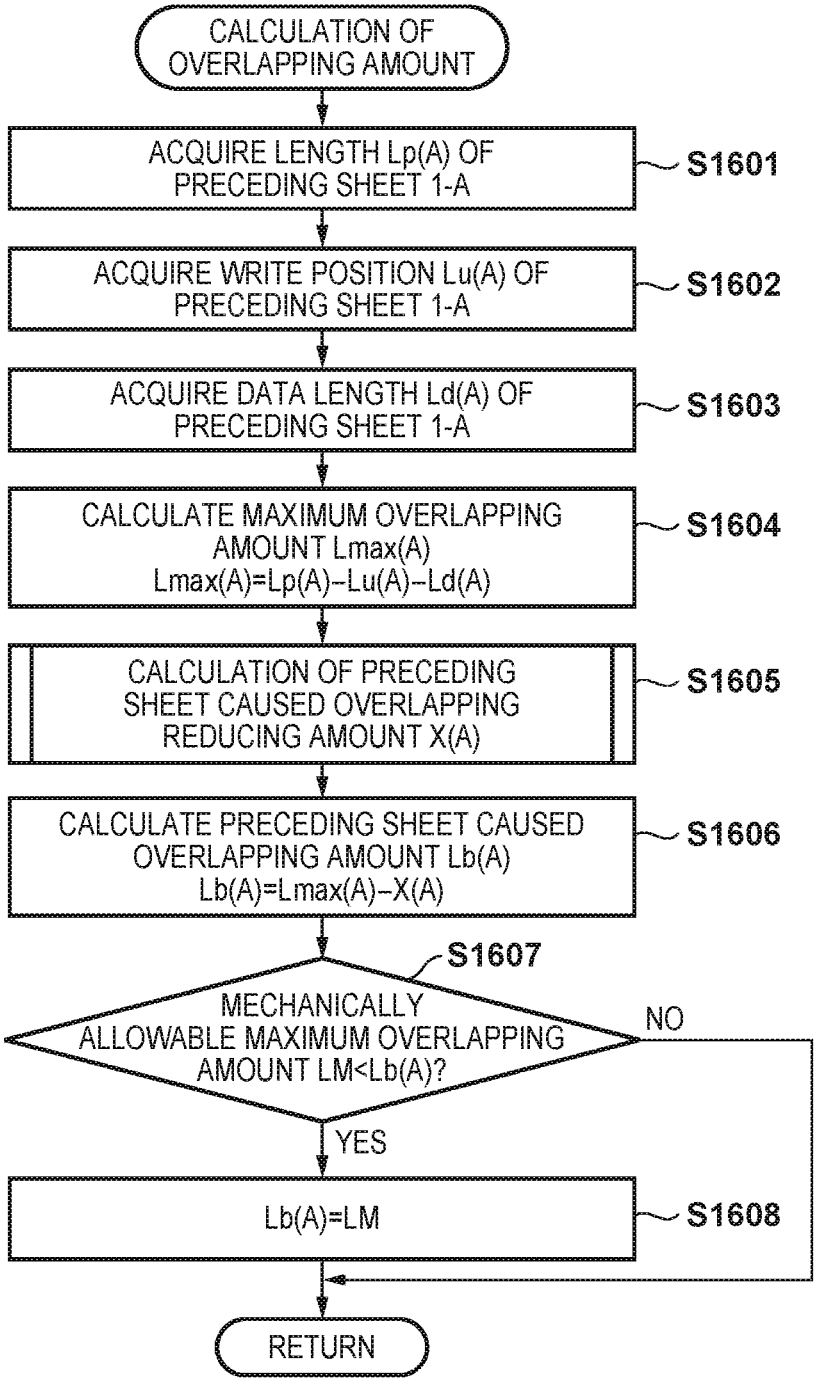
FIG. 16 is a flowchart illustrating processing of deciding a preceding sheet caused overlapping amount Lb(A) according to a second embodiment.

FIG. 16 shows processing of calculating the preceding sheet caused overlapping amount Lb(A) according to this embodiment.

Similarly to steps S901 to S903 of FIG. 9, a length Lp(A) of a preceding sheet 1-A, a write position Lu(A) of printing data, and a data length Ld(A) are acquired from printing information of the preceding sheet 1-A transmitted from a host computer 214 (steps S1601 to S1603).

In step S1604, the margin of the trailing edge of the preceding sheet 1-A is calculated from the length Lp(A) of the preceding sheet 1-A, the write position Lu(A), and the data length Ld(A) that have been acquired, and is set as a maximum overlapping amount Lmax(A).

Figure 17:
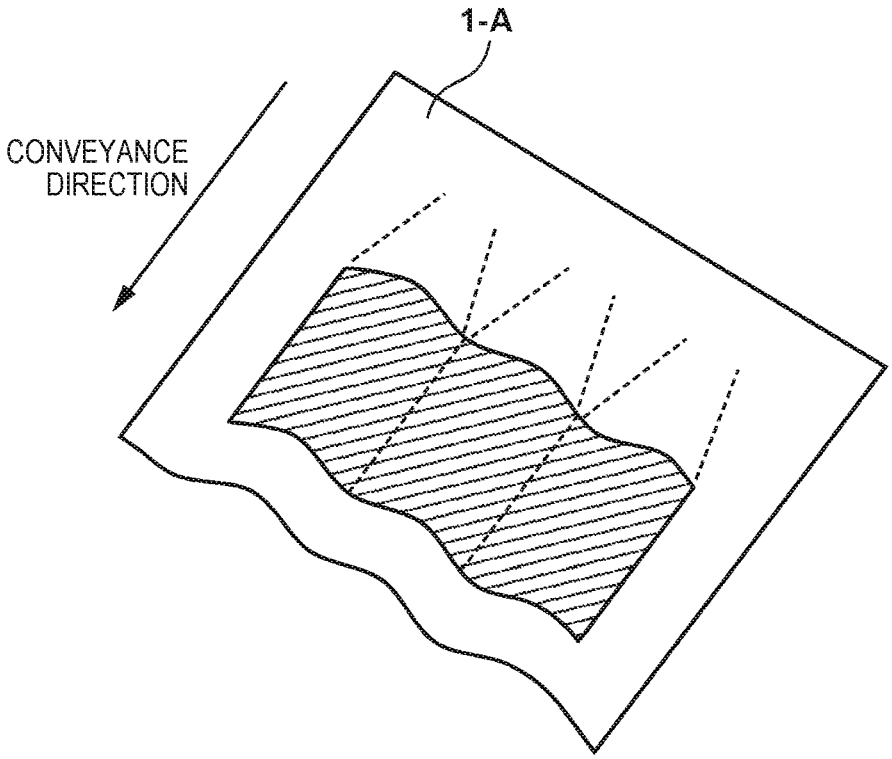
FIG. 17 is a schematic view showing cockling near the trailing edge of a preceding sheet according to the second embodiment.
Figure 18:
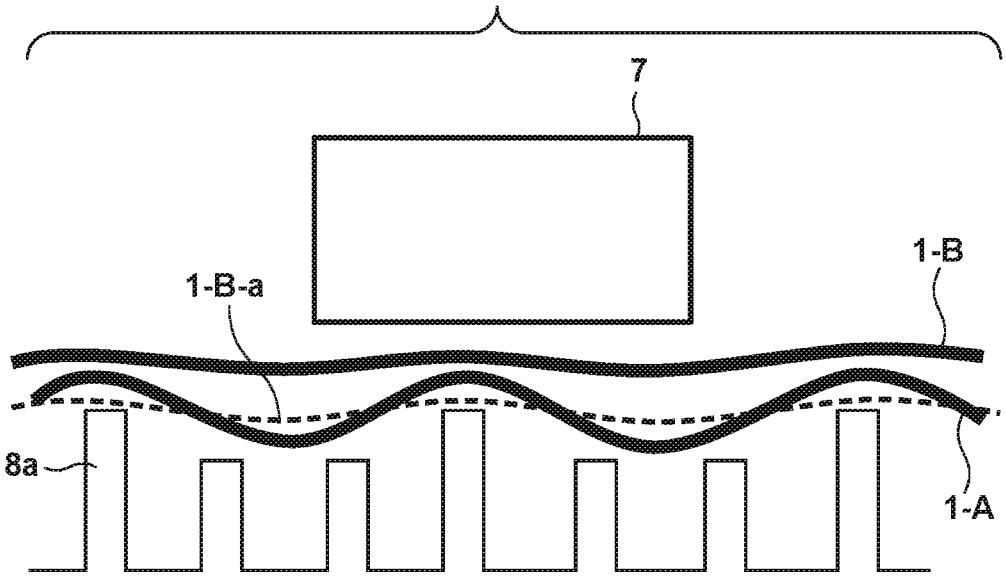
FIG. 18 is a schematic view showing the floating of a succeeding sheet overlapping the preceding sheet on which cockling has occurred according to the second embodiment.

In step S1605, an overlapping reducing amount (preceding sheet caused overlapping reducing amount) X(A) depending on the preceding sheet 1-A is calculated. When the printing density of the trailing edge of the preceding sheet 1-A is high, a deformation may occur due to cockling near the trailing edge including the marginal area as shown in FIG. 17, and the deformed marginal area may float from platen ribs 8*a* to a small extent, as shown in FIG. 18. In this case, when a succeeding sheet 1-B is made to overlap the preceding sheet 1-A, the succeeding sheet 1-B is brought closer to the printhead 7 as compared with an orientation 1-B-a of the succeeding sheet 1-B when the sheets do not overlap each other. It is necessary to set the preceding sheet caused overlapping reducing amount X(A) so as not to be influenced by the deformation near the trailing edge of the preceding sheet 1-A.

Figure 19:
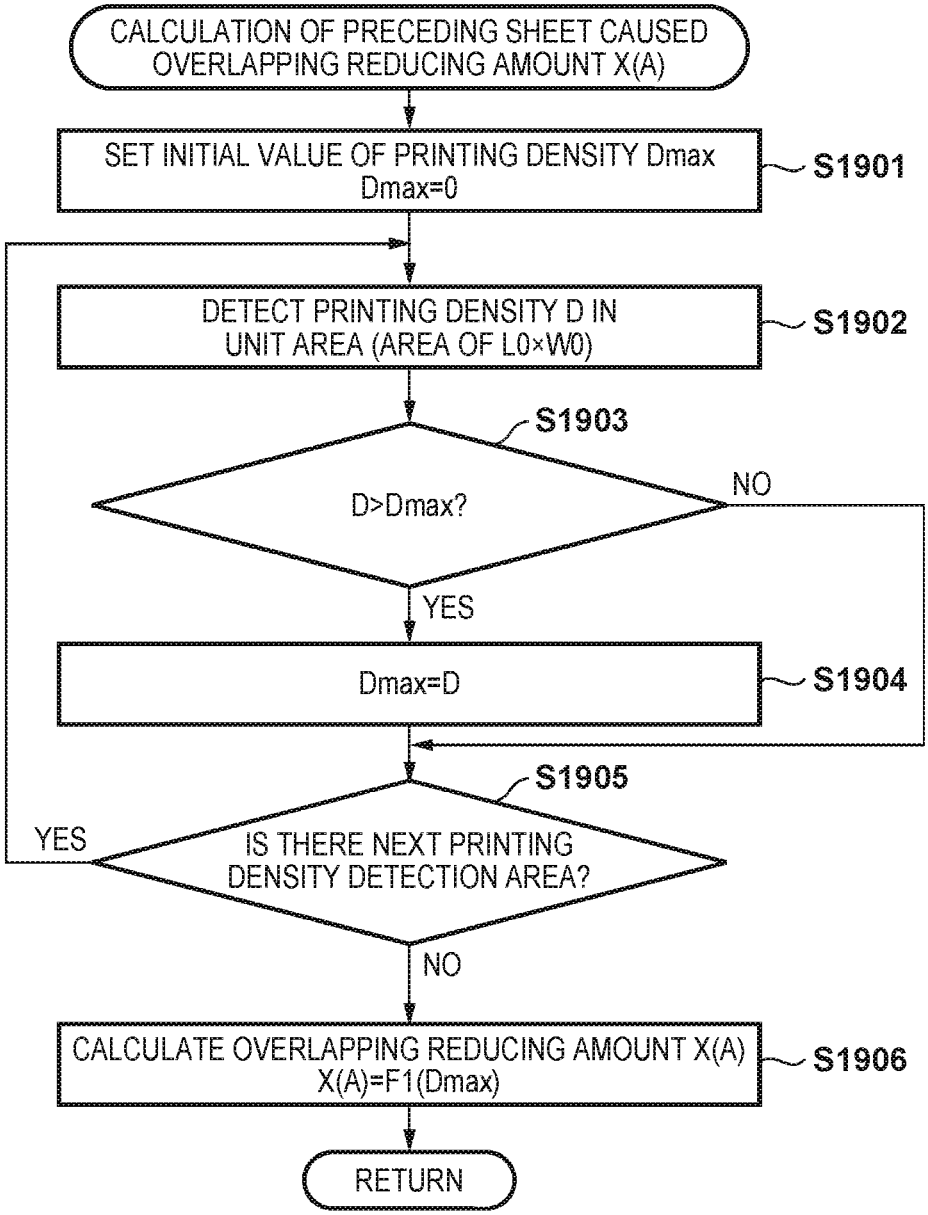
FIG. 19 is a flowchart illustrating processing of deciding a preceding sheet caused overlapping reducing amount X(A) according to the second embodiment.

FIG. 19 shows details of the processing of calculating the preceding sheet caused overlapping reducing amount X(A) in step S1605 of FIG. 16.

Figure 20:
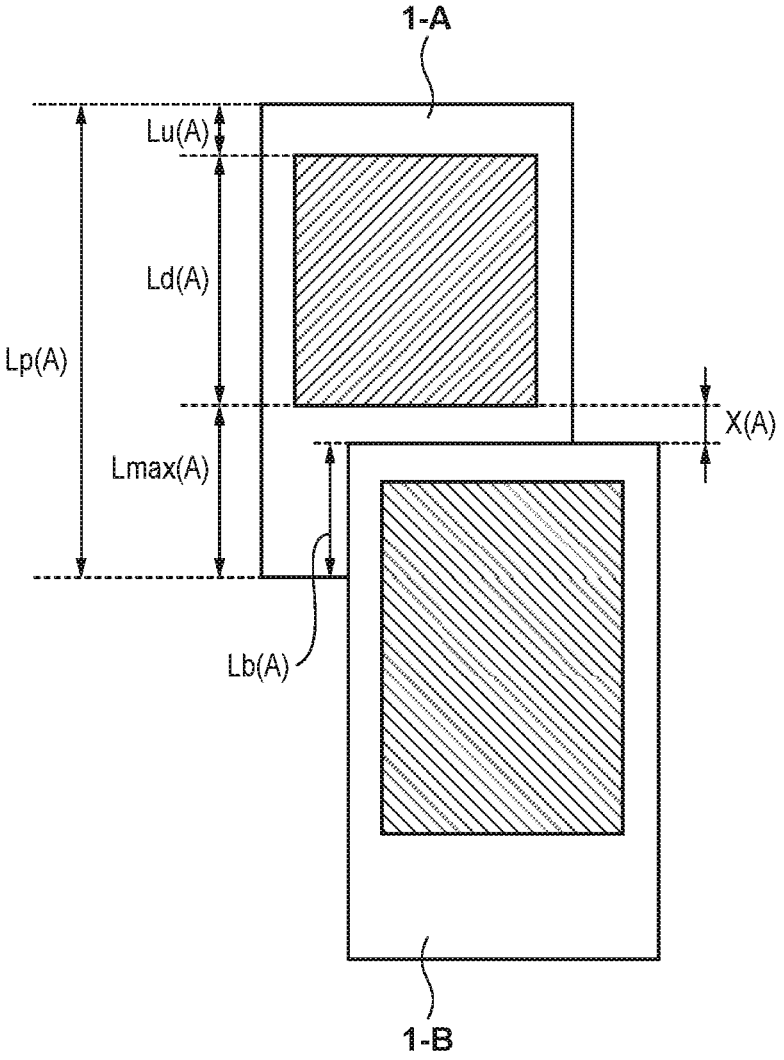
FIG. 20 is a schematic view showing the overlapping area of the printing sheets according to the second embodiment.

As shown in FIG. 20, the preceding sheet caused overlapping reducing amount X(A) is a marginal distance that is set according to the printing density of the preceding sheet 1-A, and is provided from the end position of printing data on the preceding sheet 1-A to the sheet leading edge position of the succeeding sheet 1-B. The succeeding sheet caused overlapping reducing amount Y(B) described in the first embodiment may be added to the final marginal distance provided from the end position of the printing data on the preceding sheet 1-A to the sheet leading edge position of the succeeding sheet 1-B. In this embodiment, the necessary preceding sheet caused overlapping reducing amount X(A) is decided according to a printing density D of a predetermined printing density detection area.

The printing density D is obtained based on an ink discharge dot count in a unit area of the predetermined printing density detection area. As shown in FIG. 21, in this embodiment, let L0 be the distance of the unit area in the conveyance direction, and W0 be the distance of the unit area in the main scanning direction, and 600 dpi is set as one pixel. Then, assume that the distance L0 is 256 pixels, and the distance W0 is 640 pixels. The printing density detection area is an area including 1028 pixels or less in the conveyance direction from the trailing edge of the preceding sheet 1-A. In this printing density detection area, the printing density D is calculated based on an average ink amount per block of 1 pixel×1 pixel.

Referring to FIG. 19, a maximum value Dmax of the printing densities is set as an initial value (step S1901), the printing densities D in the unit areas, obtained as described above, are sequentially acquired (step S1902), the acquired printing density D is compared with the maximum value Dmax of the already obtained printing densities D (step S1903), and the maximum value Dmax is updated (step S1904). The processes in steps S1902 to S1905 are repeated for each printing density detection area, and the finally obtained printing density is set as the maximum value Dmax.

The preceding sheet caused overlapping reducing amount X(A) is obtained based on the detected printing density Dmax by using a function F1 shown in FIG. 22 (step S1906). Values D1 and D2 shown in FIG. 22 are set to values shown in FIG. 23 in accordance with a printing pass count in an image forming operation. Note that a lower limit X0 of the preceding sheet caused overlapping reducing amount X(A) is set based on the overlapping accuracy of a feeding roller 3 and a conveyance roller 5.

The preceding sheet caused overlapping amount Lb(A) is calculated from the thus obtained preceding sheet caused overlapping reducing amount X(A) and the maximum overlapping amount Lmax(A) (step S1606).

On the other hand, a conveyance path sandwiched between conveyance guides 15 and the arrangement of the conveyance roller 5 and the feeding roller 3 impose an upper limit LM of an overlapping distance in terms of the mechanism. Therefore, the preceding sheet caused overlapping amount Lb(A) calculated based on the printing data is compared with the upper limit LM of the overlapping distance. If the upper limit LM is smaller, the preceding sheet caused overlapping amount Lb(A) is replaced by the upper limit LM (steps S1607 and S1608).

In this way, the preceding sheet caused overlapping amount Lb(A) is calculated.

According to this embodiment, it is possible to increase the speed of printing while suppressing a stain on a sheet, a sheet jam, a deterioration in image quality, or the like, caused when the printing sheets 1 are conveyed by making the succeeding sheet 1-B overlap the preceding sheet 1-A and high-density printing is performed.

Third Embodiment

Processing of deciding an overlapping amount Lt(B) of a preceding sheet 1-A and a succeeding sheet 1-B according to the third embodiment will be described with reference to FIGS. 24 to 27.

In this embodiment, the final overlapping amount Lt(B) is decided in consideration of differences in environmental conditions, such as the temperature and humidity, and thus, a method of calculating a preceding sheet caused overlapping reducing amount X(A) and a succeeding sheet caused overlapping reducing amount Y(B) is different from that in the above-described first embodiment or second embodiment.

An apparatus configuration according to this embodiment is the same as in the first embodiment except that a temperature sensor and humidity sensor (neither is shown) are provided.

Figure 24:
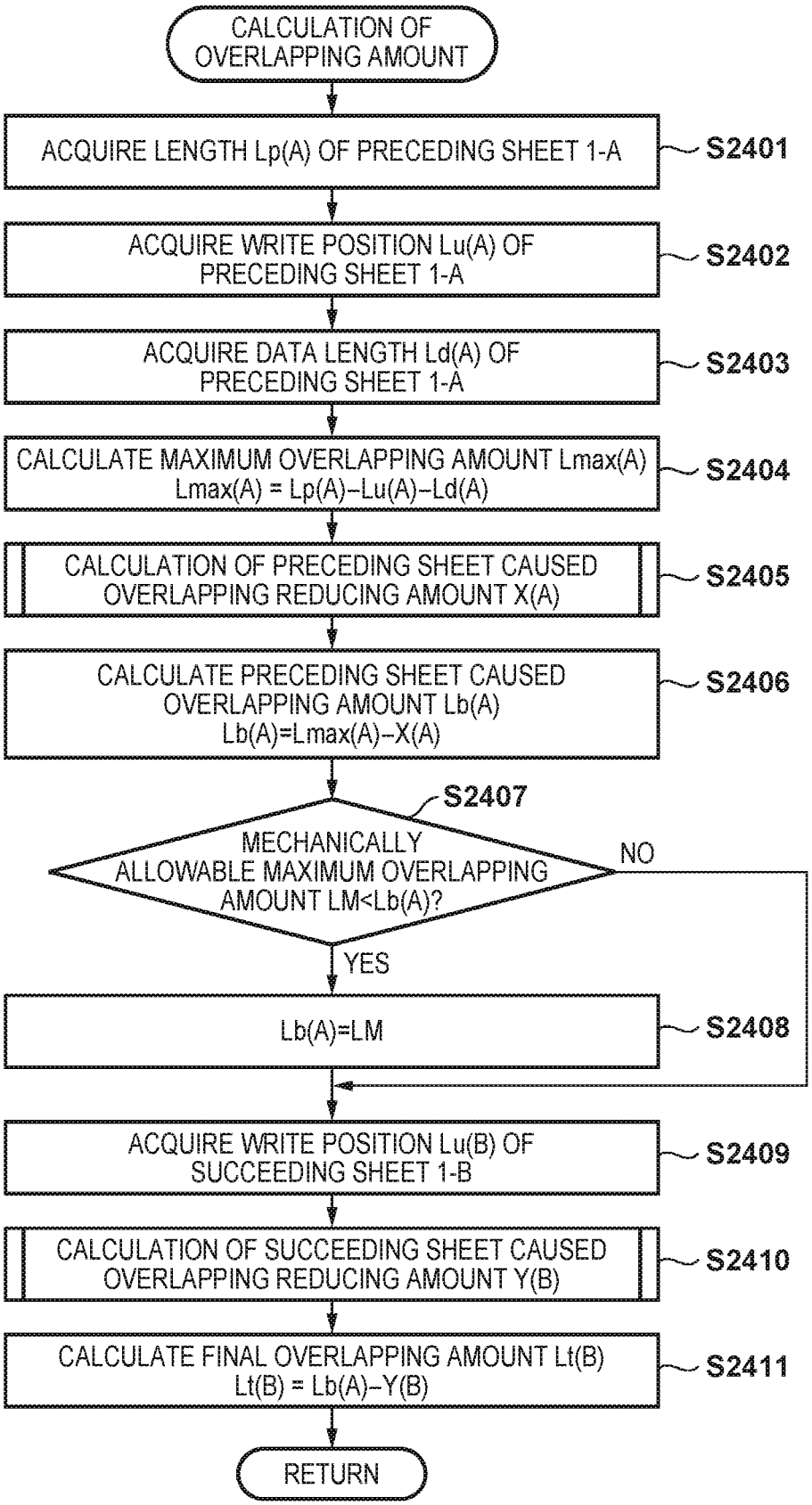
FIG. 24 is a flowchart illustrating processing of deciding an overlapping amount Lt(B) according to a third embodiment.
Figure 25:
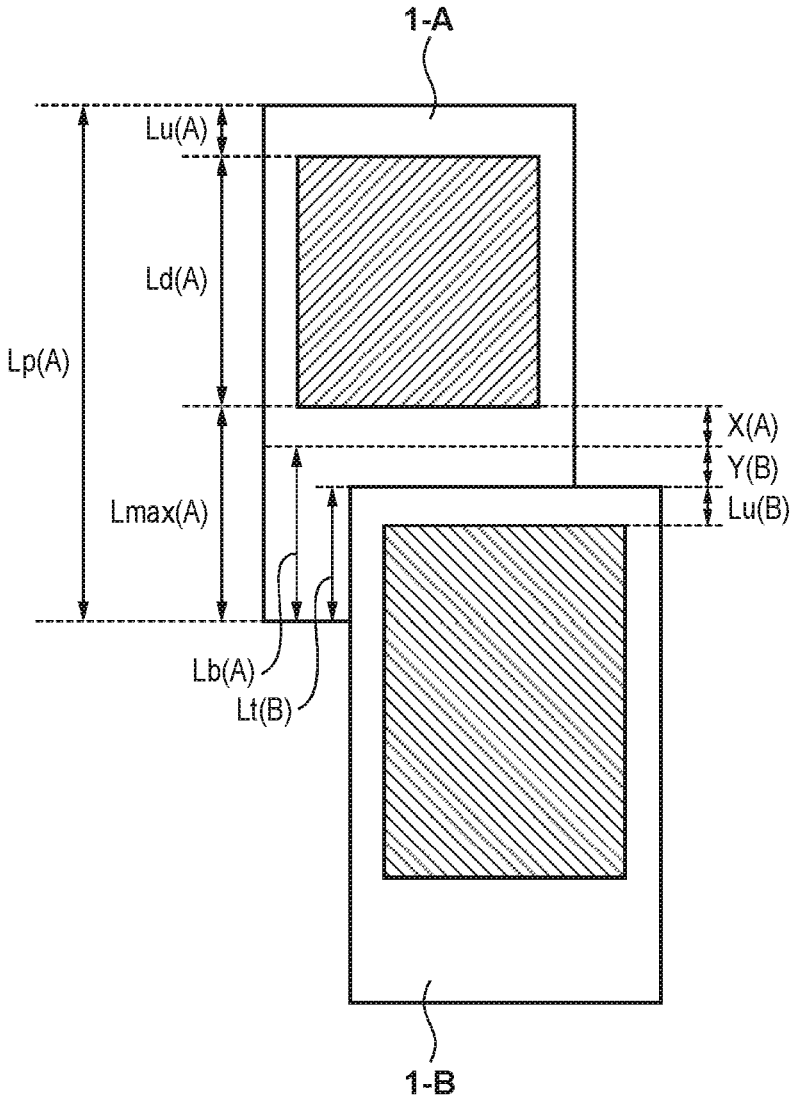
FIG. 25 is a schematic view showing the overlapping area of printing sheets according to the third embodiment.

FIG. 24 shows processing of calculating the overlapping amount Lt(B) according to this embodiment.

Similarly to FIGS. 9 and 16, a length Lp(A) of the preceding sheet 1-A, a write position Lu(A) of printing data, and a data length Ld(A) are acquired from printing information of the preceding sheet 1-A transmitted from a host computer 214 (steps S2401 to S2403). The margin of the trailing edge of the preceding sheet 1-A is calculated from the length Lp(A) of the preceding sheet 1-A, the write position Lu(A), and the data length Ld(A) that have been acquired, and is set as a maximum overlapping amount Lmax(A) (step S2404).

The preceding sheet caused overlapping reducing amount X(A) is calculated (step S2405). Details of the processing of calculating the preceding sheet caused overlapping reducing amount X(A) are almost the same as those shown in FIG. 19. That is, the preceding sheet caused overlapping reducing amount X(A) is a marginal distance that is set according to the printing density of the preceding sheet 1-A, and is provided from the end position of the printing data on the preceding sheet 1-A to the sheet leading edge position of the succeeding sheet 1-B (see FIG. 25). The succeeding sheet caused overlapping reducing amount Y(B) (to be described later) is also added to the final marginal distance provided from the end position of the printing data on the preceding sheet 1-A to the sheet leading edge position of the succeeding sheet 1-B. In this embodiment, the necessary preceding sheet caused overlapping reducing amount X(A) is decided according to the printing density of a predetermined printing density detection area.

As described with reference to FIG. 19, the processes in steps S1902 to S1905 are repeatedly performed for each printing density detection area, thereby obtaining a final printing density Dmax. The preceding sheet caused overlapping reducing amount X(A) is obtained based on the printing density Dmax by using a function F1 shown in FIG. 22 (step S1906). FIG. 26 shows tables for obtaining parameters t1, t2, h1, h2, p1, and p2 to be used to calculate variables D1 and D2 shown in FIG. 22. Referring to FIG. 26, each parameter is provided for each environmental temperature of the printing apparatus, each environmental humidity, or each printing pass count in one-pass printing by one operation or multipass printing by a plurality of operations in an image forming operation, and is selected based on the corresponding printing condition. Values D01 and D02 are the values of the variables D1 and D2 under the reference printing condition. The variables D1 and D2 are calculated based on the reference values under each printing condition by the following equations:

$$D1=t1*h1*p1*D01;\text{ and}$$

$$D2=t2*h2*p2*D02.$$

That is, the function of obtaining the preceding sheet caused overlapping reducing amount X(A) can be changed according to a printing condition of the environmental temperature, environmental humidity, and printing pass count. Note that a lower limit X0 of the preceding sheet caused overlapping reducing amount X(A) is imposed based on the overlapping accuracy of a feeding roller 3 and a conveyance roller 5.

A preceding sheet caused overlapping amount Lb(A) is calculated from the thus obtained preceding sheet caused overlapping reducing amount X(A) and the maximum overlapping amount Lmax(A) (step S2406).

On the other hand, a conveyance path sandwiched between conveyance guides 15 and the arrangement of the conveyance roller 5 and the feeding roller 3 impose an upper limit LM of an overlapping distance in terms of the mechanism. Therefore, the preceding sheet caused overlapping amount Lb(A) calculated based on the printing data is compared with the upper limit LM of the overlapping distance. If the upper limit LM is smaller, the preceding sheet caused overlapping amount Lb(A) is replaced by the upper limit LM (steps S2407 and S2408).

Processing of calculating the succeeding sheet caused overlapping reducing amount Y(B) is performed next.

In step S2409, a write position Lu(B) of data to be printed on the succeeding sheet 1-B is acquired from printing information of the succeeding sheet 1-B transmitted from the host computer 214.

In step S2410, the succeeding sheet caused overlapping reducing amount Y(B) is calculated. Details of the processing of calculating the succeeding sheet caused overlapping reducing amount Y(B) are almost the same as those shown in FIG. 10. That is, printing densities da(1) to da(3) of printing density detection areas a(1) to a(3) are detected in steps S1001 to S1004 described with reference to FIG. 10.

A predetermined printing density threshold d0 is set, and the printing density da(1), da(2), or da(3) is compared with the threshold d0. FIG. 27 shows tables for obtaining parameters t3, h3, and p3 according to the environmental temperature, the environmental humidity, and the printing pass count in an image forming operation, respectively, that are used to calculate the printing density threshold d0. A value d00 represents the reference value of d0 under the reference printing condition, and the value d0 under each printing condition is calculated based on the reference value by the following equation:

$$d0=t3*h3*p3*d00.$$

The final overlapping amount Lt(B) is calculated from the already calculated preceding sheet caused overlapping amount Lb(A) and the succeeding sheet caused overlapping reducing amount Y(B) that has been obtained in steps S1005 to S1011 of FIG. 10 (step S2411).

According to the above-described embodiment, it is possible to increase the speed of printing while suppressing a stain on a sheet, a sheet jam, a deterioration in image quality, or the like, caused when the printing sheets 1 are conveyed by making the succeeding sheet 1-B overlap the preceding sheet 1-A and high-density printing is performed.

Fourth Embodiment

A method of calculating a succeeding sheet caused overlapping reducing amount Y(B) according to the fourth embodiment will be described with reference to FIG. 28.

In this embodiment, a method of calculating the succeeding sheet caused overlapping reducing amount Y(B) when an overlapping amount Lt(B) of a preceding sheet 1-A and a succeeding sheet 1-B is decided is different from that in the third embodiment.

An apparatus configuration, processing of deciding the final overlapping amount Lt(B) of the preceding sheet 1-A and the succeeding sheet 1-B, and processing of calculating a preceding sheet caused overlapping reducing amount X(A) are the same as in the first embodiment, and a description thereof will be omitted.

Figure 28:
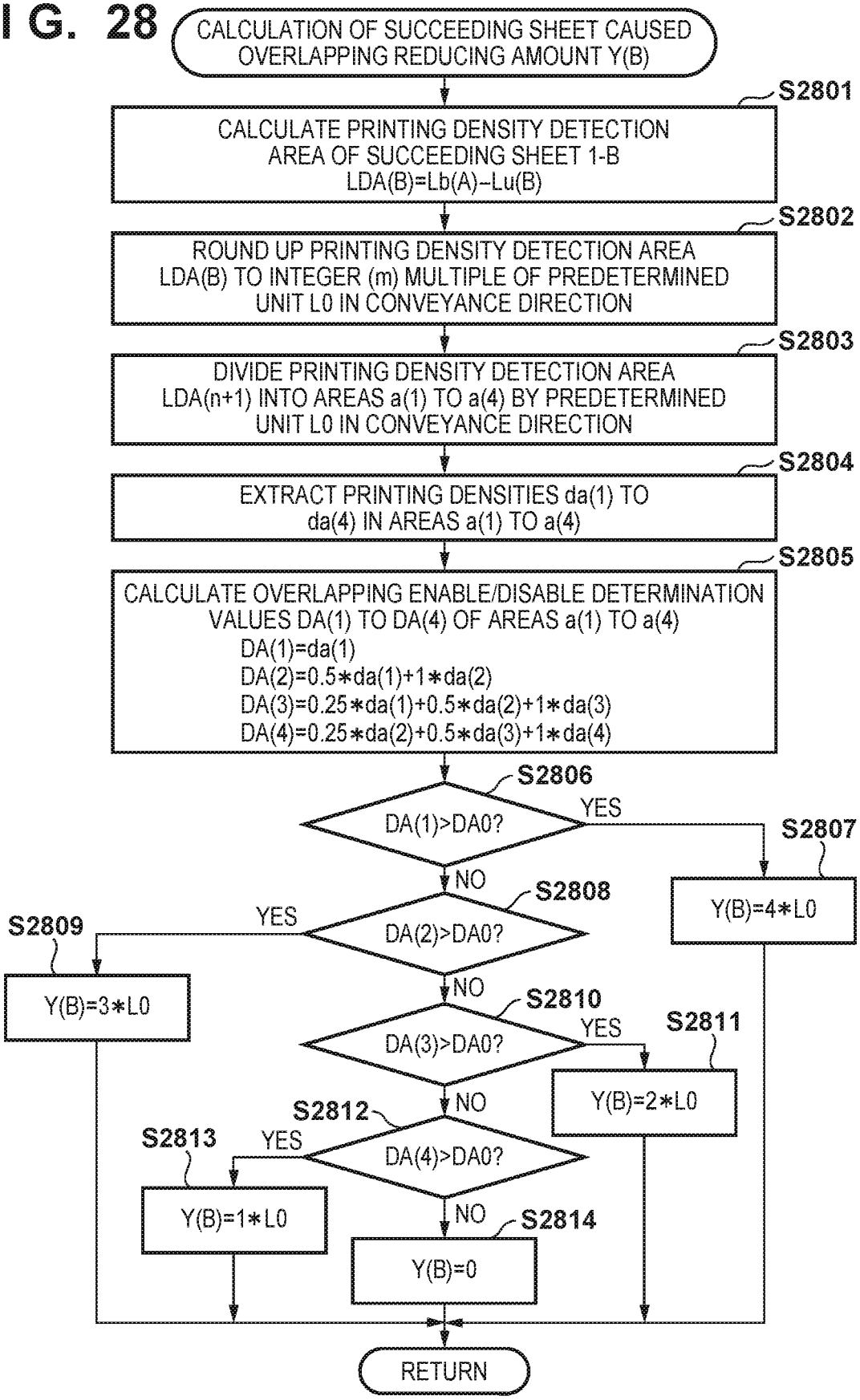
FIG. 28 is a flowchart illustrating processing of deciding a succeeding sheet caused overlapping reducing amount Y(B) according to a fourth embodiment.

FIG. 28 shows processing of calculating the succeeding sheet caused overlapping reducing amount Y(B) according to this embodiment.

In steps S2801 to S2803, a printing density detection area LDA(B) of the succeeding sheet 1-B is obtained, and round-up processing is performed so that the printing density detection area LDA(B) becomes an m (m is an integer) multiple of a distance L0 of a unit area in the conveyance direction (step S1002), similarly to steps S1001 to S1003 of FIG. 10. For the sake of descriptive convenience, m=4 is set and the printing density detection area is divided into four areas a(1), a(2), a(3), and a(4) (step S2803). For each of the areas a(1) to a(4), a printing density is detected for each unit area obtained by dividing the area by a width W0 in the main scanning direction, and the maximum value of the detected printing densities is set as a printing density da(1), da(2), da(3), or da(4) (step S2804).

In step S2805, overlapping enable/disable determination values DA(1) to DA(4), each of which is used to determine whether a corresponding one of the areas a(1) to a(4) is an overlapping enable area, are defined and calculated. To determine whether the corresponding area is an overlapping enable area, the printing densities of the two upstream areas are traced back from the corresponding area to calculate the overlapping enable/disable determination value by the following equation:

$$DA(n)=0.25*da(n-2)+0.5*da(n-1)+1*da(n).$$

A predetermined printing density threshold DA0 is set, and is compared with the calculated overlapping enable/disable determination value. The printing density threshold DA0 is calculated from a reference threshold and parameters according to the environmental temperature, the environmental humidity, and the printing pass count in an image forming operation, similarly to the threshold d0 in the third embodiment.

Comparison processing is performed from the area a(1) on the leading edge side. When the threshold DA0 is exceeded, the area and the subsequent areas are set as overlapping disable areas. To determine whether the area a(1) is an overlapping enable area, the overlapping enable/disable determination value DA(1) is compared with the threshold DA0 (step S2806). If the overlapping enable/disable determination value DA(1) exceeds the threshold DA0, the area a(1) is an overlapping disable area, and the succeeding sheet caused overlapping reducing amount Y(B) is set (step S2807) by the following equation:

$$Y(B)=m\cdot L0=4\times L0.$$

Then, the processing of calculating the succeeding sheet caused overlapping reducing amount Y(B) is terminated.

On the other hand, if the overlapping enable/disable determination value DA(1) is equal to or less than the threshold DA0, the area a(1) is an overlapping enable area, and the process transits to the overlapping enable/disable determination processing of the area a(2). After that, the overlapping enable/disable determination processing is sequentially performed from the area a(2), similarly to the area a(1). If the area a(2) is an overlapping disable area, the succeeding sheet caused overlapping reducing amount Y(B) is calculated (step S2807). Otherwise, the process transits to the overlapping enable/disable determination processing of the next area (step S2808). These processes are repeatedly performed for the area a(2) and the subsequent areas to calculate the final succeeding sheet caused overlapping reducing amount Y(B) (steps S2808 to S2814).

The final overlapping amount Lt(B) is calculated from the thus obtained succeeding sheet caused overlapping reducing amount Y(B) and the already calculated preceding sheet caused overlapping reducing amount Lb(A).

According to the above-described embodiment, it is possible to increase the speed of printing while suppressing a stain on a sheet, a sheet jam, a deterioration in image quality, or the like, caused when the printing sheets 1 are conveyed by making the succeeding sheet 1-B overlap the preceding sheet 1-A and high-density printing is performed.

Fifth Embodiment

An overlap continuous feeding operation in double-sided printing and processing of deciding a preceding sheet caused overlapping amount Lb(A) according to the fifth embodiment will be described with reference to FIGS. 29 to 35.

An apparatus configuration according to this embodiment is the same as in the first embodiment and a description thereof will be omitted.

An operation of reversing a printing sheet 1 in a double-sided printing mode will be described in time series with reference to ST11 of FIG. 29 to ST16 of FIG. 30. Note that a single-sided printing operation in the double-sided printing mode is the same as the operation in ST1 to ST3 of FIG. 1.

Figure 29:
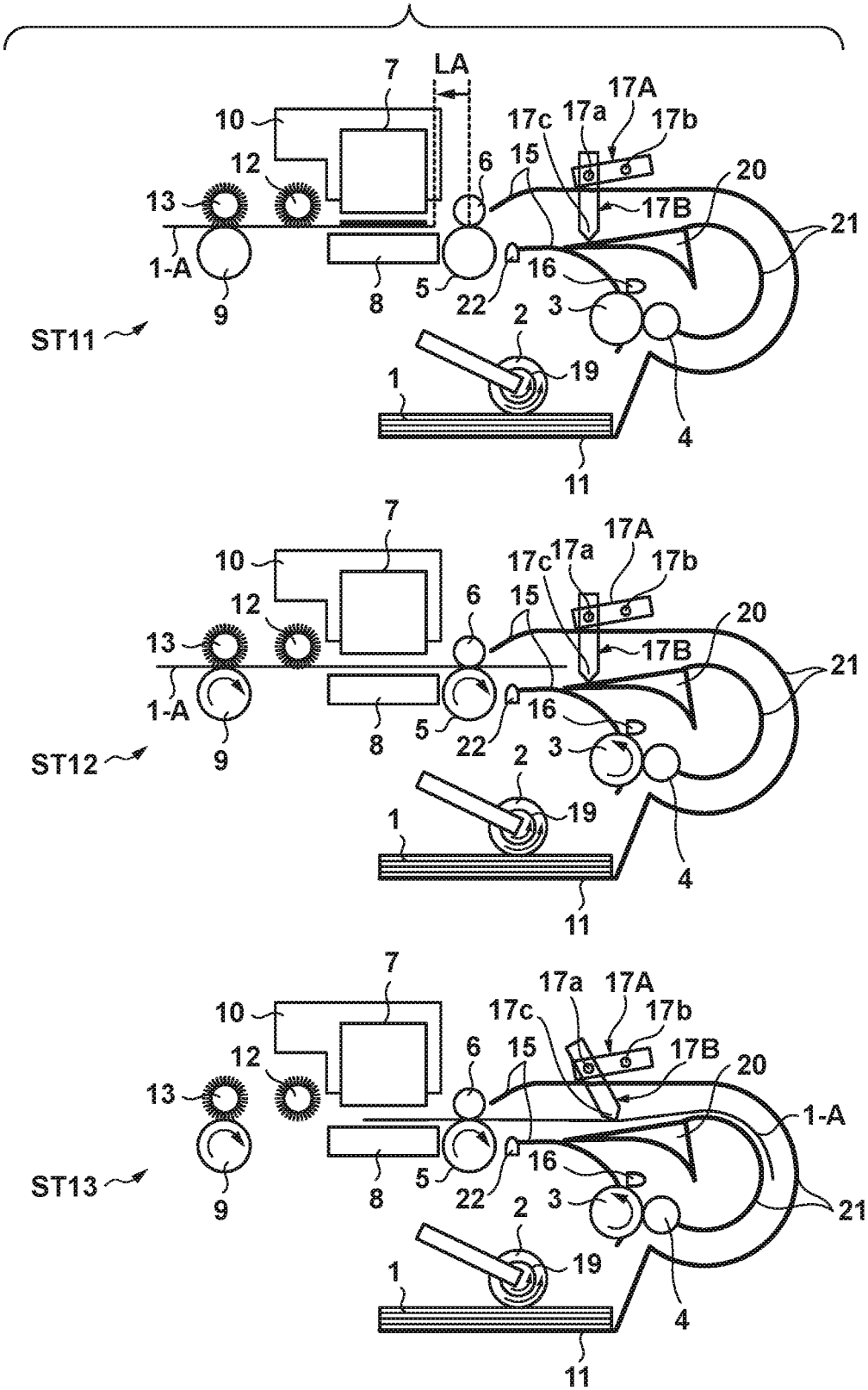
FIG. 29 is a view for explaining an overlap continuous feeding operation in double-sided printing according to a fifth embodiment.

Referring to FIG. 29, in ST11, when the printing operation of a preceding sheet 1-A ends, a conveyance roller 5 and a discharge roller 9 stop rotating. The conveyance roller 5 and the discharge roller 9 are rotated until the trailing edge of the preceding sheet 1-A is conveyed to a position a distance LA away from a conveyance nip portion of the conveyance roller 5 and a pinch roller 6, and the discharge roller 9 and a spur 13 hold the preceding sheet 1-A that has passed through the conveyance nip portion. At this time, a flapper 20 is at a lower position by its own weight, as shown in FIG. 29, and guides the preceding sheet 1-A to the reverse guide members 21.

In ST12, the conveyance roller 5 and the discharge roller 9 reversely rotate in a direction (the clockwise direction in FIG. 29) opposite to that at the time of the printing operation to cause the preceding sheet 1-A to re-enter the conveyance nip portion of the conveyance roller 5 and the pinch roller 6, thereby conveying the preceding sheet 1-A toward conveyance guides 15 and a sheet pressing lever 17. At this time, the conveyance roller 5 rotates at 8 inches/sec.

In ST13, when the conveyance roller 5 continuously rotates in the clockwise direction in FIG. 29, one edge (the trailing edge at the time of printing the obverse surface) of the preceding sheet 1-A rotates a distal end 17*c* of the sheet pressing lever 17 about a rotating shaft 17*a* in the counter-clockwise direction against the biasing force of a spring. The sheet pressing lever 17 may be configured so that the one edge of the preceding sheet 1-A passes through the sheet pressing lever 17 without contacting the lower position of the distal end 17*c* of the sheet pressing lever 17. When the conveyance roller 5 further continuously rotates, one edge of the preceding sheet 1-A is guided to the reverse guide members 21.

Figure 30:
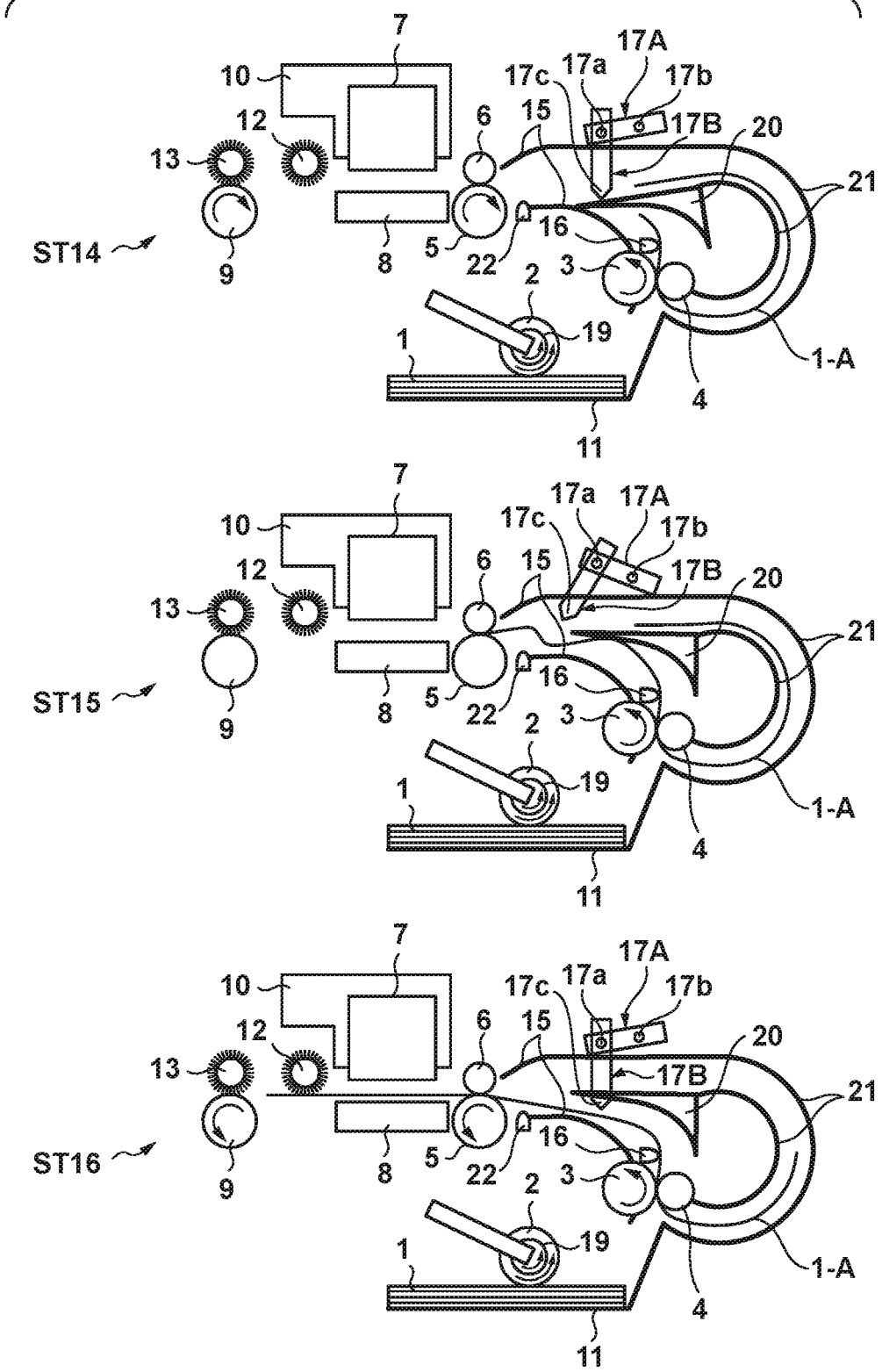
FIG. 30 is a view for explaining the overlap continuous feeding operation in double-sided printing according to the fifth embodiment.

Referring to FIG. 30, in ST14, when the conveyance roller 5 further continuously rotates, one edge (the trailing edge at the time of printing the obverse surface) of the preceding sheet 1-A is guided to the reverse guide members 21, and enters a feeding nip portion of a feeding roller 3 and a feeding driven roller 4. When a sheet detection sensor 16 detects one edge (the trailing edge at the time of printing the obverse surface) of the preceding sheet 1-A, the conveyance roller 5 rotates by a predetermined amount, and then the conveyance roller 5 and the feeding roller 3 temporarily stop rotating. In this case, a conveyance path is formed by the conveyance guides 15 and the reverse guide members 21 so that the other edge (the leading edge at the time of printing the obverse surface) of the preceding sheet 1-A surely passes through the conveyance nip portion. In addition, in this case, when one edge (the trailing edge at the time of printing the obverse surface) of the preceding sheet 1-A reaches the distal end 17*c* of the sheet pressing lever 17, the other edge (the leading edge at the time of printing the obverse surface) of the preceding sheet 1-A passes through the distal end 17*c* of the sheet pressing lever 17.

In ST15, by continuously rotating the feeding roller 3, one edge (the trailing edge at the time of printing the obverse surface) of the preceding sheet 1-A pushes the flapper 20 away against its own weight and the reaction force of the preceding sheet 1-A, and is re-fed to the conveyance guides 15. At this time, since the other edge (the leading edge at the time of printing the obverse surface) of the preceding sheet 1-A is not in contact with the sheet pressing lever 17, the reaction force of the preceding sheet 1-A when one edge (the trailing edge at the time of printing the obverse surface) of the preceding sheet 1-A pushes the flapper 20 away can be minimized. When the feeding roller 3 is further continuously rotated, one edge of the preceding sheet 1-A abuts against the conveyance nip portion formed by the conveyance roller 5 and the pinch roller 6 to perform skew correction, as in ST2 of FIG. 1 at the time of single-sided printing.

In ST16, upon the end of the skew correction operation of the preceding sheet 1-A, a conveyance motor 205 is driven to start rotation of the conveyance roller 5. The conveyance roller 5 conveys the sheet at 15 inches/sec. The preceding sheet 1-A is aligned with the position facing a printhead 7. At this time, the surface of the preceding sheet 1-A facing the printhead 7 is the reverse surface that is opposite to the printed obverse surface and is white sheet. The printing operation of the reverse surface of the aligned preceding sheet 1-A is performed by discharging ink from the printhead 7 based on printing data.

Upon the start of the printing operation of the reverse surface of the preceding sheet 1-A, the pickup operation of a succeeding sheet 1-B starts. This is the same as the overlap continuous feeding operation in single-sided continuous printing described in ST4 of FIG. 2 in the first embodiment.

The overlap continuous feeding operation of the reverse surface of the preceding sheet 1-A and the succeeding sheet 1-B up to ST9 of FIG. 3 is the same as in the first embodiment.

An overlap continuous feeding sequence in double-sided printing will be described with reference to FIGS. 31A, 31B, 32A, and 32B.

In step S3101, when a host computer 214 transmits printing data via an I/F unit 213, a printing operation starts. In step S3102, the feeding operation of the preceding sheet 1-A starts. More specifically, a feeding motor 206 is driven at low speed. A pickup roller 2 rotates at 7.6 inches/sec. The pickup roller 2 picks up the preceding sheet 1-A, and the feeding roller 3 feeds the preceding sheet 1-A toward the printhead 7.

In step S3103, the sheet detection sensor 16 detects the leading edge of the preceding sheet 1-A. When the sheet detection sensor 16 detects the leading edge of the preceding sheet 1-A, the feeding motor 206 is switched to high-speed driving in step S3104. That is, the pickup roller 2 and the feeding roller 3 rotate at 20 inches/sec. In step S3105, by controlling the rotation amount of the feeding roller 3 after the sheet detection sensor 16 detects the leading edge of the preceding sheet 1-A, the leading edge of the preceding sheet 1-A is made to abut against the conveyance nip portion to perform the skew correction operation of the preceding sheet 1-A.

In step S3106, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5. In step S3107, the feeding motor 206 is switched to low-speed driving. In step S3108, a printing operation starts when the printhead 7 discharges ink to the obverse surface of the preceding sheet 1-A. More specifically, the printing operation of the obverse surface of the preceding sheet 1-A is performed by repeating a conveyance operation of intermittently conveying the preceding sheet 1-A by the conveyance roller 5 and an image forming operation (ink discharge operation) of discharging ink from the printhead 7 moved by a carriage 10. The feeding motor 206 is intermittently driven at low speed in synchronization with the operation of intermittently conveying the preceding sheet 1-A by the conveyance roller 5. That is, the pickup roller 2 and the feeding roller 3 intermittently rotate at 7.6 inches/sec.

The process stands by for completion of the printing operation of the obverse surface of the preceding sheet 1-A in step S3109, and then advances to step S3110 to convey the trailing edge of the preceding sheet 1-A to a predetermined position (LA in ST11 of FIG. 29). In step S3111, it is confirmed whether the printing sheet 1 has a reversible sheet length. If the sheet length of the preceding sheet 1-A is confirmed to fall outside a predetermined range, the process advances to step S3112 to discharge the preceding sheet 1-A, and then ends. If the sheet length of the preceding sheet 1-A is confirmed to fall within the predetermined range, the process advances to step S3114 to stand by for drying for a predetermined time.

In step S3115, by starting to reversely rotate the conveyance roller 5 and the discharge roller 9 and to forwardly rotate the feeding roller 3, an operation of reversing the preceding sheet 1-A is performed. After the preceding sheet 1-A passes through the sheet detection sensor 16 in step S3116, the conveyance roller 5, the discharge roller 9, and the feeding roller 3 stop rotating in step S3117. The process stands by for drying for the predetermined time in step S3118, and the feeding roller 3 is rotated in step S3119, thereby feeding the preceding sheet 1-A toward the printhead 7 again.

In step S3120, the process stands by for detection of the leading edge of the preceding sheet 1-A by the sheet detection sensor 22. By controlling the rotation amount of the feeding roller 3 after the leading edge of the preceding sheet 1-A is detected, the leading edge of the preceding sheet 1-A is made to abut against the conveyance nip portion to perform the skew correction operation of the preceding sheet 1-A (step S3121).

In step S3122, alignment of the preceding sheet 1-A is performed based on the printing data. In step S3123, a printing operation starts by discharging ink from the printhead 7 to the reverse surface of the preceding sheet 1-A.

In step S3124, it is determined whether there is printing data of the next page (i.e., a second page). If there is no printing data of the next page, the process stands by for completion of the printing operation of the preceding sheet 1-A in step S3126. Upon completion of the printing operation, the preceding sheet 1-A is discharged in step S3127, and the printing operation is terminated in step S3128.

Note that, if it is determined in step S3124 that there is printing data of the next page, the process advances to step S3125 to start a double-sided overlapping operation.

Figure 31A:
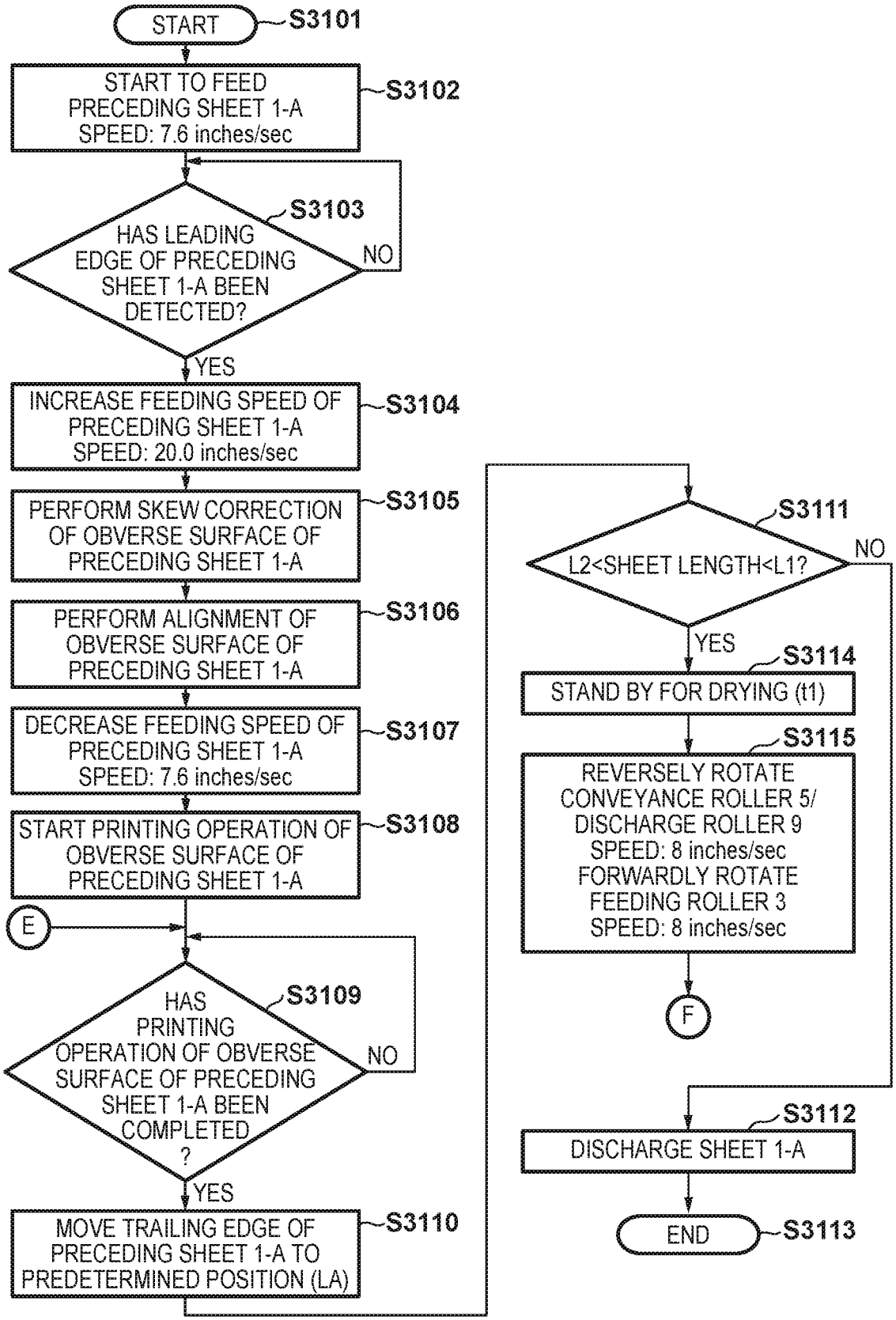
FIGS. 31A and 31B are flowcharts illustrating the overlap continuous feeding operation in double-sided printing according to the fifth embodiment.
Figure 31B:
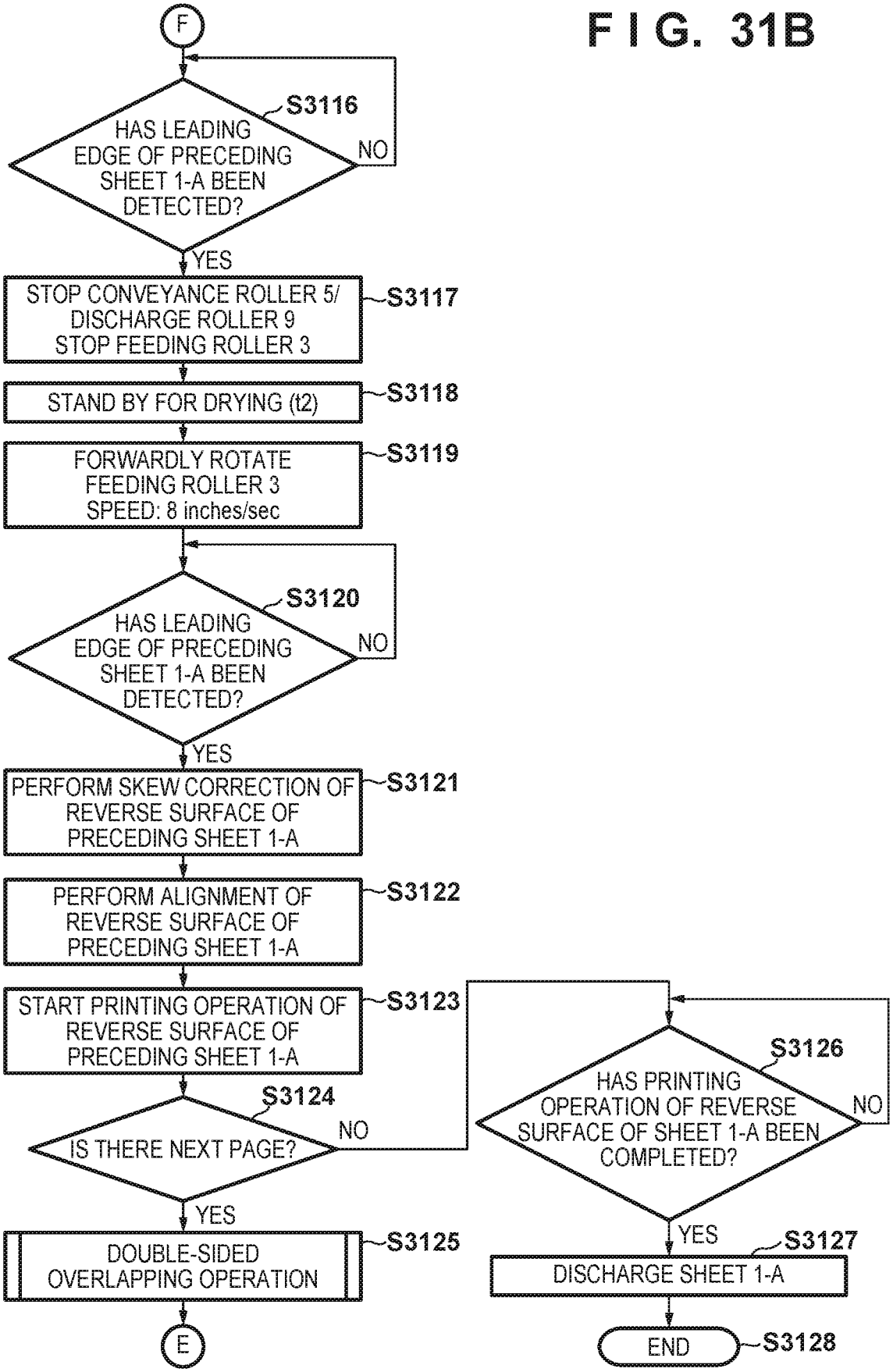
Figure 32A:
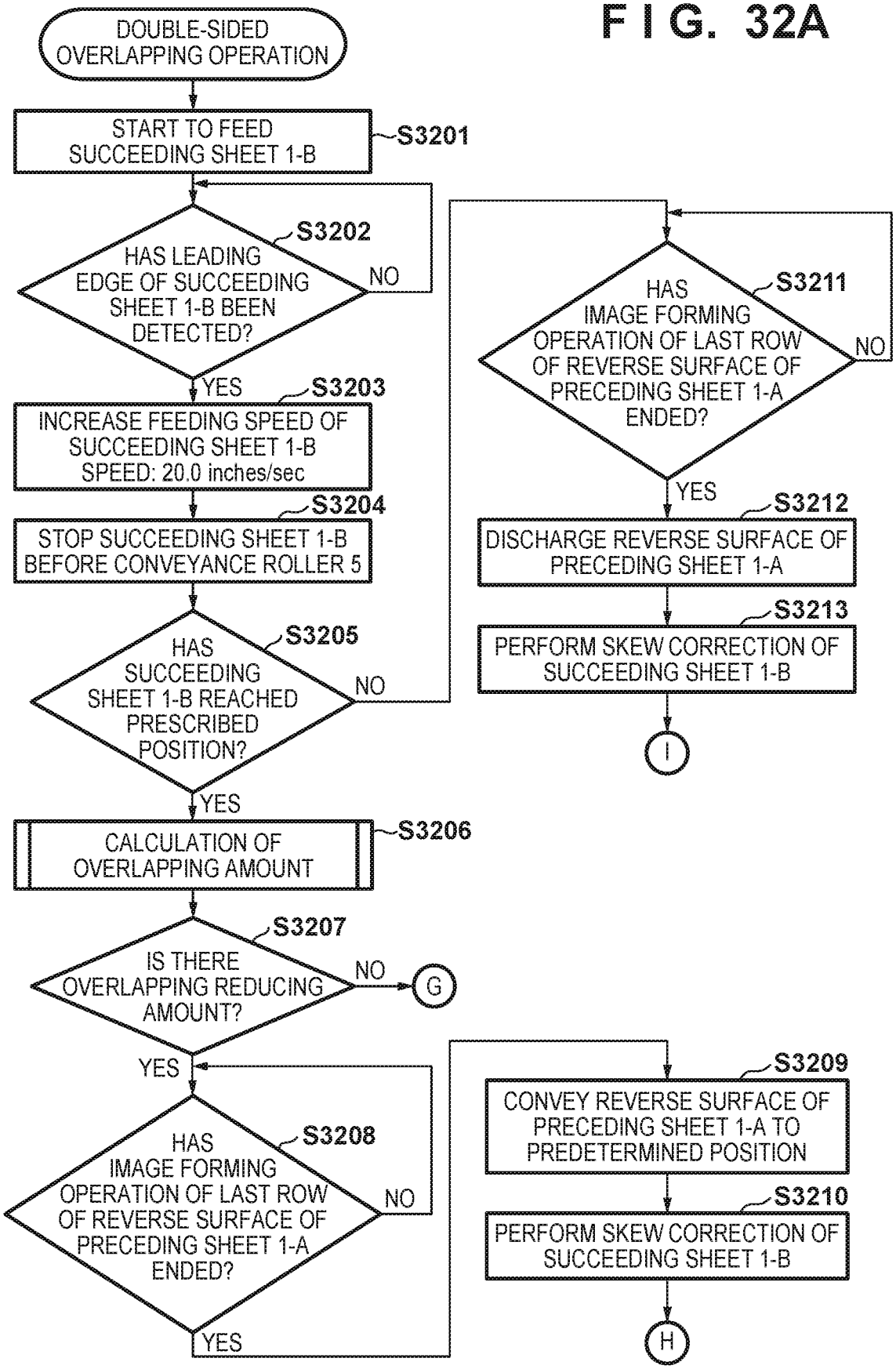
FIGS. 32A and 32B are flowcharts illustrating the overlap continuous feeding operation in double-sided printing according to the fifth embodiment.
Figure 32B:
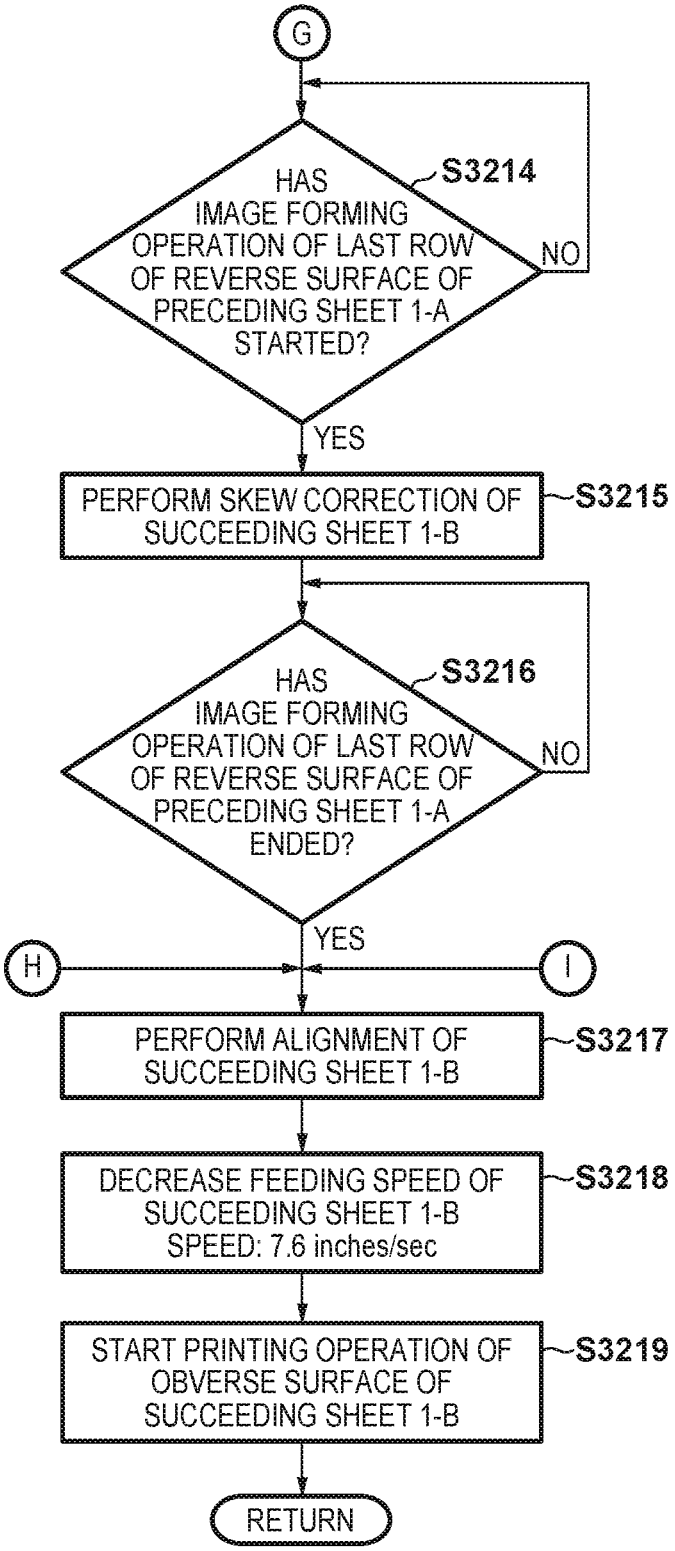

FIGS. 32A and 32B show the double-sided overlapping operation sequence in step S3125 of FIG. 31B.

If it is determined in step S3124 that there is printing data of the next page, the feeding operation of the succeeding sheet 1-B starts in step S3201. More specifically, the pickup roller 2 picks up the succeeding sheet 1-B and the feeding roller 3 feeds the succeeding sheet 1-B toward the printhead 7. The pickup roller 2 rotates at 7.6 inches/sec. As described above, since a large concave portion 2*c* of the pickup roller 2 is provided with respect to a projection 19*a* of a driving shaft 19, the succeeding sheet 1-B is fed while having a predetermined interval with respect to the trailing edge of the reverse surface of the preceding sheet 1-A.

In step S3202, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S3203. That is, the pickup roller 2 and the feeding roller 3 rotate at 20 inches/sec. In step S3204, by controlling the rotation amount of the feeding roller 3 after the sheet detection sensor 16 detects the leading edge of the succeeding sheet 1-B, the succeeding sheet 1-B is conveyed so that its leading edge is at a position a predetermined amount before the conveyance nip portion. The reverse surface of the preceding sheet 1-A is intermittently conveyed based on the printing data. Continuously driving the feeding motor 206 at high speed forms the overlap state in which the leading edge of the obverse surface of the succeeding sheet 1-B overlaps the trailing edge of the reverse surface of the preceding sheet 1-A.

In step S3205, it is determined whether the leading edge of the succeeding sheet 1-B has reached a prescribed position (a position P3 in ST5 of FIG. 8). If the leading edge has not reached the prescribed position, the overlap state is canceled to perform alignment of the succeeding sheet 1-B. More specifically, if it is determined in step S3211 that the image forming operation of the last row of the reverse surface of the preceding sheet 1-A has ended, the discharge operation of the reverse surface of the preceding sheet 1-A is performed in step S3212. During this operation, the feeding motor 206 is not driven, and thus, the obverse surface of the succeeding sheet 1-B stops while its leading edge is at the position the predetermined amount before the conveyance nip portion. Since the reverse surface of the preceding sheet 1-A is discharged, the overlap state is canceled. In step S3213, the leading edge of the succeeding sheet 1-B is made to abut against the conveyance nip portion to perform the skew correction operation of the succeeding sheet 1-B. In step S3217, alignment of the succeeding sheet 1-B is performed.

If the succeeding sheet 1-B has reached the prescribed position, an overlapping amount is calculated in step S3206. At this time, processing is different depending on the presence/absence of an overlapping reducing amount calculated in an overlapping amount calculation process. In step S3207, the presence/absence of an overlapping reducing amount is determined. If there is no overlapping reducing amount, it is possible to perform the skew correction operation of the succeeding sheet 1-B during the image forming operation of the last row of the reverse surface of the preceding sheet 1-A, and thus, the process advances to step S3214. In step S3214, the process stands by for the start of the image forming operation of the preceding sheet 1-A.

In step S3215, the leading edge of the succeeding sheet 1-B is made to abut against the conveyance nip portion while keeping the overlap state, thereby performing the skew correction operation of the succeeding sheet 1-B. In step S3216, the process stands by for the end of the image forming operation of the last row of the reverse surface of the preceding sheet 1-A. In step S3217, alignment of the succeeding sheet 1-B is performed while keeping the overlap state in step S3217.

If it is determined in step S3207 that there is an overlapping reducing amount, the process stands by for the end of the image forming operation of the last row of reverse surface of the preceding sheet 1-A in step S3208. Upon the end of the image forming operation of the last row of the reverse surface of the preceding sheet 1-A, the reverse surface of the preceding sheet 1-A is conveyed to a predetermined position by the conveyance roller 5 to have an overlapping amount (to be described later) in step S3209. The leading edge of the succeeding sheet 1-B is made to abut against the conveyance nip portion to perform the skew correction operation of the succeeding sheet 1-B in step S3210, and alignment of the succeeding sheet 1-B is performed in step S3217.

In step S3218, the feeding motor 206 is switched to low-speed driving. In step S3219, a printing operation starts by discharging ink from the printhead 7 to the obverse surface of the succeeding sheet 1-B. More specifically, the printing operation of the obverse surface of the succeeding sheet 1-B is performed by repeating a conveyance operation of intermittently conveying the obverse surface of the succeeding sheet 1-B by the conveyance roller 5 and an image forming operation of discharging ink from the printhead 7 moved by the carriage 10, thereby returning to step S3109 of FIG. 31A.

Processing of deciding the preceding sheet caused overlapping amount Lb(A) in consideration of a unique overlapping requirement imposed by performing double-sided printing on the preceding sheet 1-A will be described with reference to FIG. 33. FIG. 34 shows an overlapping amount and an ink application area decided based on printing data when performing an overlapping operation.

In step S3301, a length Lp(A) of the preceding sheet 1-A in the conveyance direction is acquired from printing information of the preceding sheet 1-A transmitted from the host computer 214. In step S3302, a write position Lu(A-F) of printing data on the obverse surface of the preceding sheet 1-A and a write position Lu(A-B) of printing data on the reverse surface of the preceding sheet 1-A are acquired. In step S3303, a printing length Ld(A-B) on the reverse surface of the preceding sheet 1-A is acquired. In step S3304, the margin of the trailing edge of the reverse surface of the preceding sheet 1-A is calculated from the length Lp(A) of the preceding sheet 1-A in the conveyance direction, the write position Lu(A-B) on the reverse surface, and the printing length Ld(A-B) of the printing data on the reverse surface that have been acquired, and is set as a maximum overlapping amount Lmax(A-B) depending on the reverse surface of the preceding sheet 1-A.

A printing apparatus according to this embodiment has a sheet reversing mechanism, and decides the preceding sheet caused overlapping amount Lb(A) in consideration of not only the printing data on the reverse surface of the preceding sheet 1-A in a printing operation immediately before an overlapping operation is performed, but also the printing data on the obverse surface of the preceding sheet 1-A. As shown in FIG. 34, assume that there is an area on the trailing edge side that falls outside an ink application area 100A-B on the reverse surface of the preceding sheet 1-A, that is, an ink application area 100A-F on the obverse surface of the preceding sheet 1-A on the obverse surface side facing the marginal area of the trailing edge. In this case, even if the area of the preceding sheet 1-A is the marginal area of the trailing edge of the reverse surface of the preceding sheet 1-A, it is deformed due to ink applied in the printing operation of the obverse surface of the preceding sheet 1-A. If the succeeding sheet 1-B is made to overlap the preceding sheet 1-A, the succeeding sheet 1-B is brought closer to the printhead 7, as shown in FIG. 18 and as described in the second embodiment. Therefore, the preceding sheet caused overlapping amount Lb(A) is decided using printing information of the obverse surface of the preceding sheet 1-A.

Figure 34:
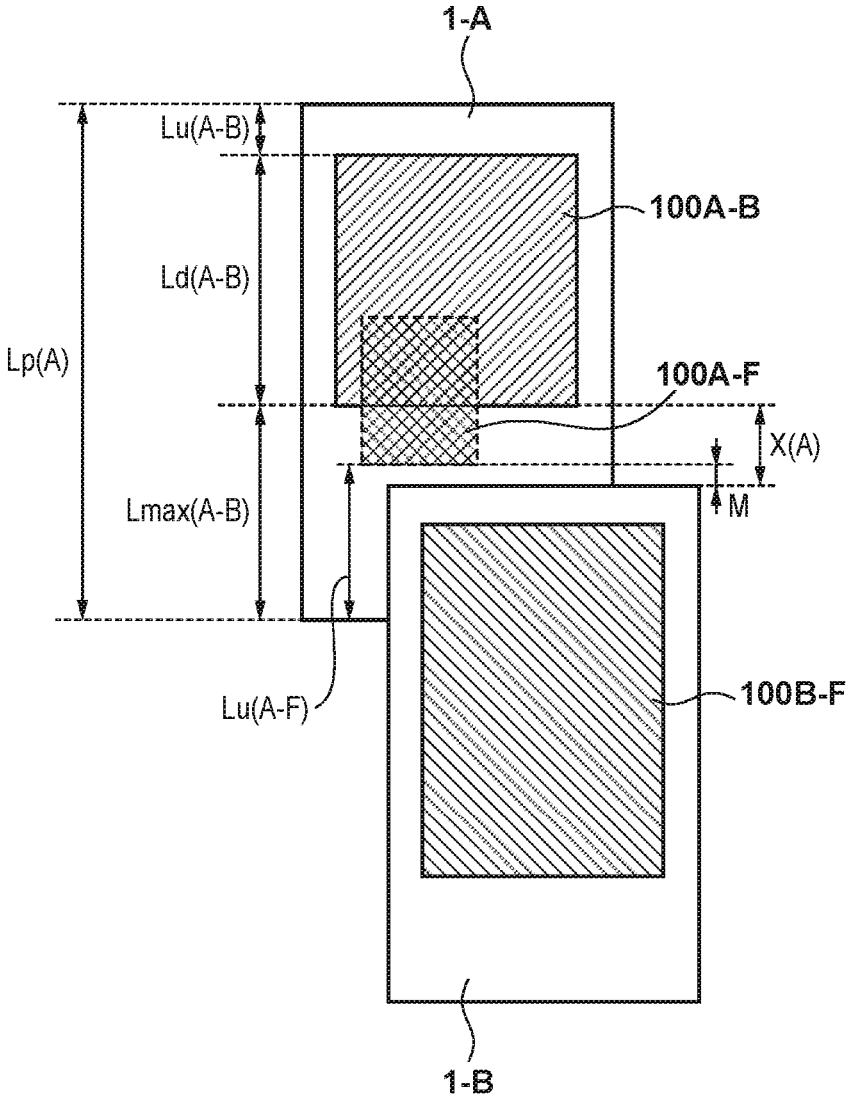
FIG. 34 is a schematic view showing the overlapping area of printing sheets according to the fifth embodiment.
Figure 35:
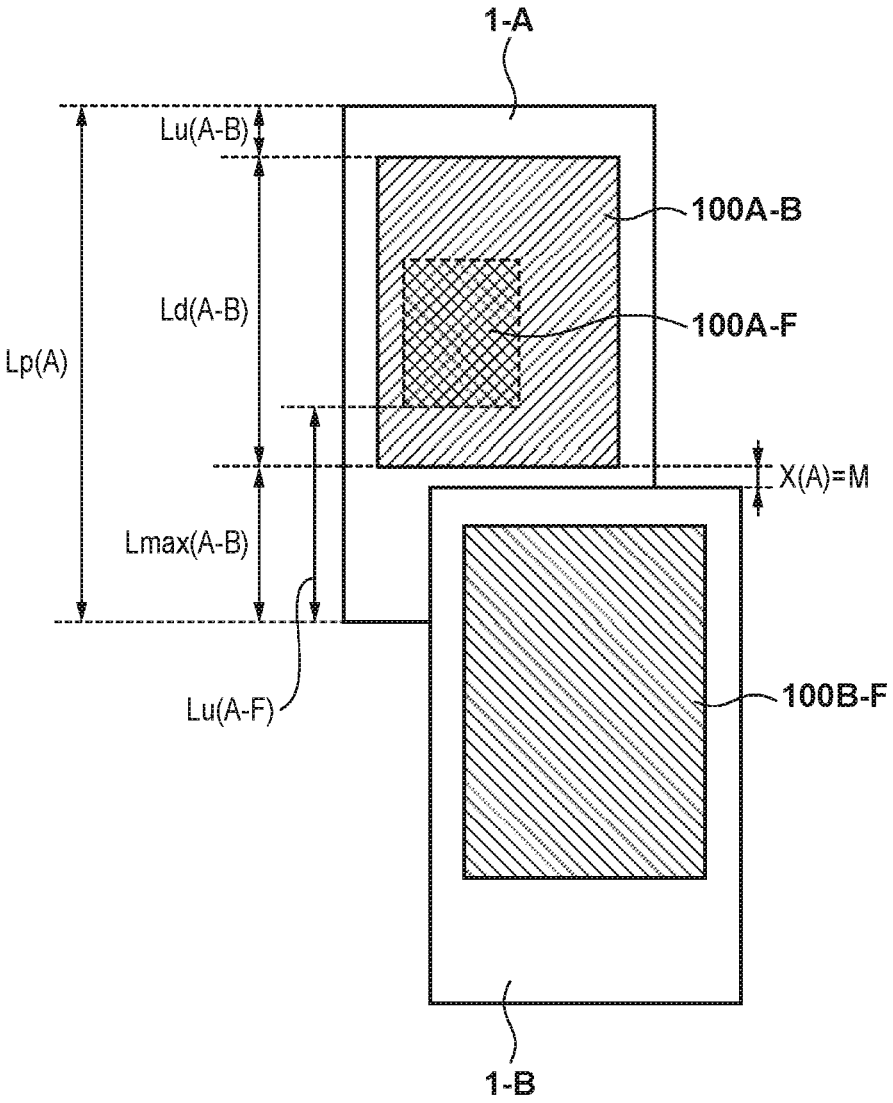
FIG. 35 is a schematic view showing the overlapping area of the printing sheets according to the fifth embodiment.

In step S3305, the maximum overlapping amount Lmax (A-B) depending on the reverse surface of the preceding sheet 1-A calculated in step S3304 is compared with the write position Lu(A-F) of the printing data on the obverse surface of the preceding sheet 1-A acquired in step S3302, thereby confirming an area in which no ink is applied on either the obverse or reverse surface. If, as shown in FIG. 34, the maximum overlapping amount Lmax(A-B) depending on the reverse surface of the preceding sheet 1-A is larger than the write position Lu(A-F) of the printing data on the obverse surface of the preceding sheet 1-A, a margin M that is a fixed value is added to the difference between Lmax (A–B) and Lu(A–F), and the obtained value is set as the preceding sheet caused overlapping reducing amount X(A) (step S3306). Alternatively, if, as shown in FIG. 35, the maximum overlapping amount Lmax(A-B) depending on the reverse surface of the preceding sheet 1-A is equal to or less than the write position Lu(A-F) of the printing data on the obverse surface of the preceding sheet 1-A, the process advances to step S3307 to set the margin M that is the fixed value as the preceding sheet caused overlapping reducing amount X(A).

In step S3308, the preceding sheet caused overlapping amount Lb(A) is calculated from the preceding sheet caused overlapping reducing amount X(A) and the maximum overlapping amount Lmax(A–B).

On the other hand, a conveyance path sandwiched between the conveyance guides 15 and the arrangement of the conveyance roller 5 and the feeding roller 3 impose an upper limit LM of an overlapping distance in terms of the mechanism. Therefore, the preceding sheet caused overlapping amount Lb(A) calculated based on the printing data is compared with the upper limit LM of the overlapping distance. If the upper limit LM is smaller, the preceding sheet caused overlapping amount Lb(A) is replaced by the upper limit LM (steps S3309 and S3310).

In this way, the preceding sheet caused overlapping amount Lb(A) is calculated.

According to the above-described embodiment, it is possible to increase the speed of printing while suppressing a stain on a sheet, a sheet jam, a deterioration in image quality, or the like, caused when printing sheets 1 are conveyed by making the succeeding sheet 1-B overlap the preceding sheet 1-A and high-density double-sided printing is performed.

Sixth Embodiment

Processing of deciding a preceding sheet caused overlapping amount Lb(A) according to the sixth embodiment will be described with reference to FIGS. 36 to 39.

An apparatus configuration according to this embodiment is the same as in the first embodiment, and has the same sheet reversing mechanism as that in the fifth embodiment.

Figure 36:
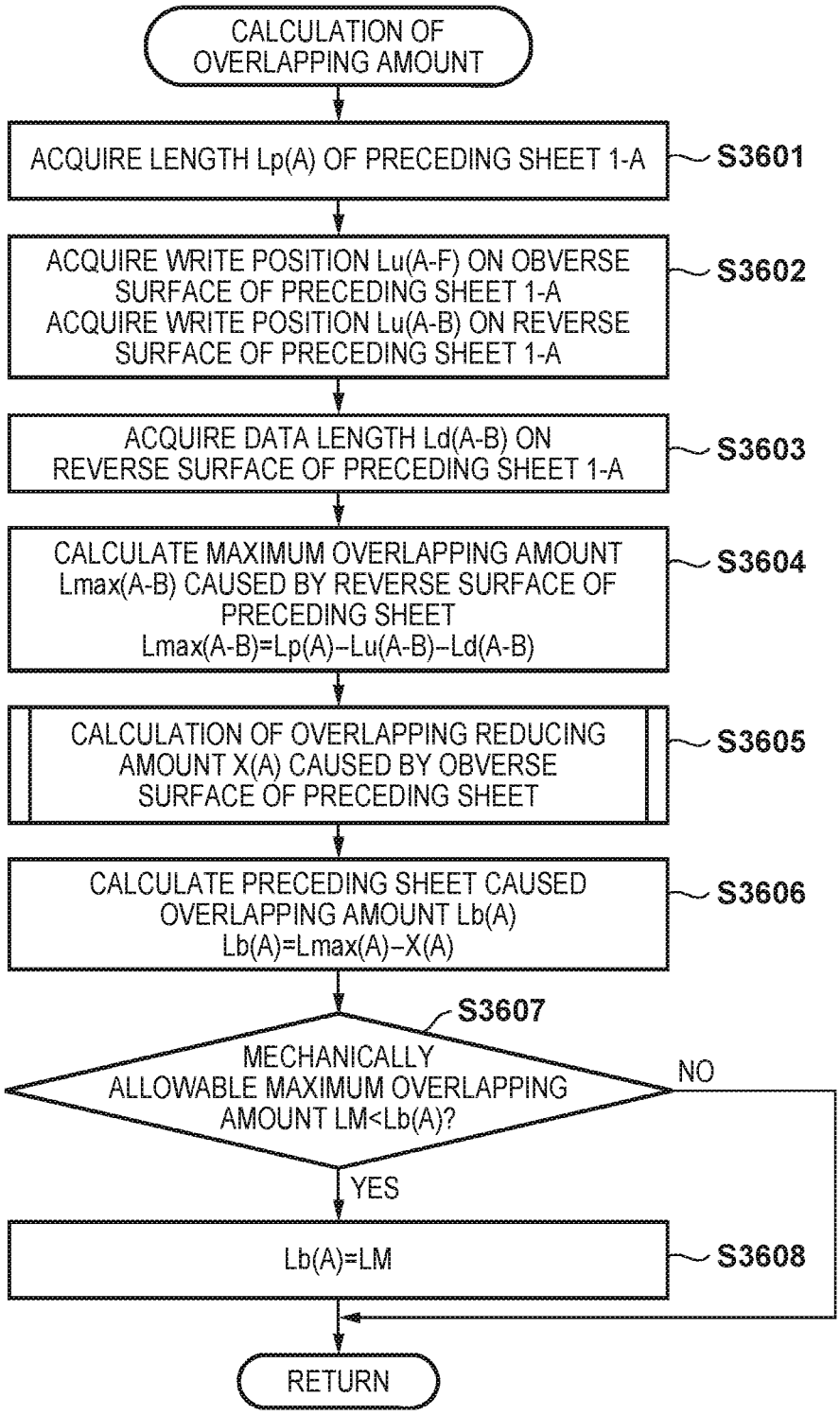
FIG. 36 is a flowchart illustrating processing of deciding a preceding sheet caused overlapping amount Lb(A) according to a sixth embodiment.
Figure 37:
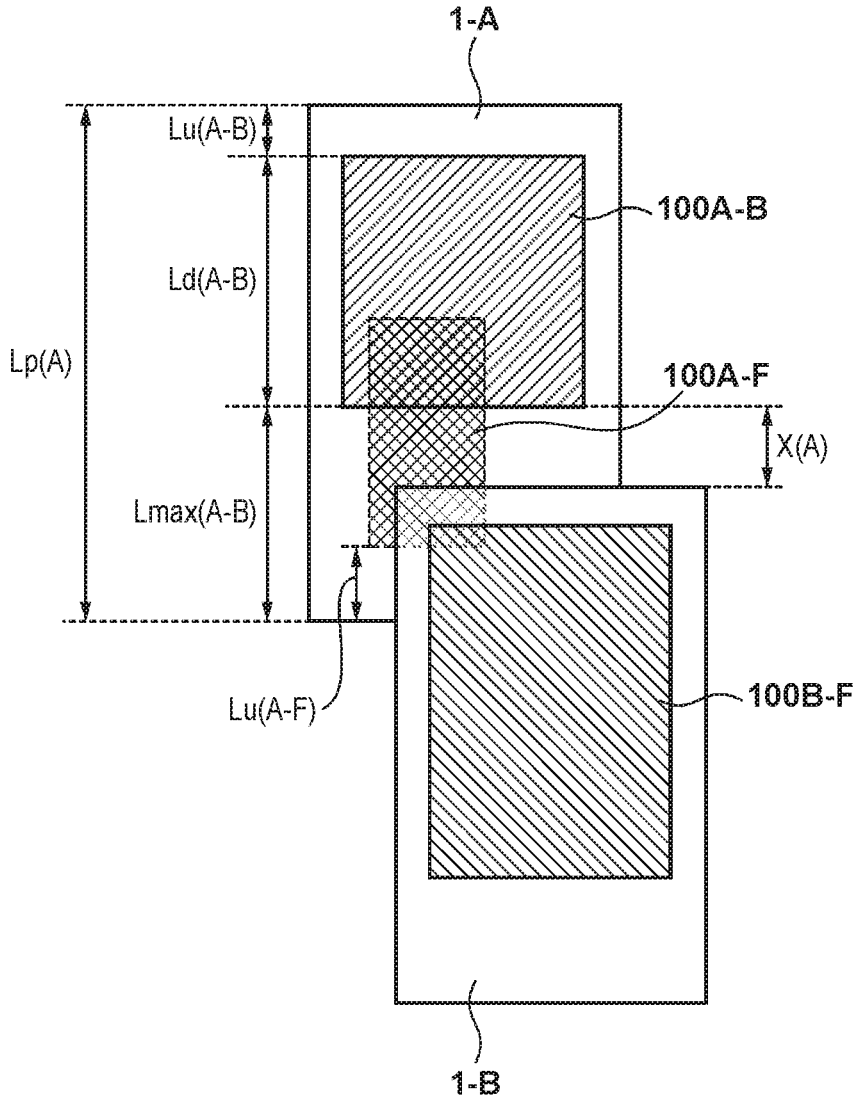
FIG. 37 is a schematic view showing the overlapping area of printing sheets according to the sixth embodiment.
Figure 38:
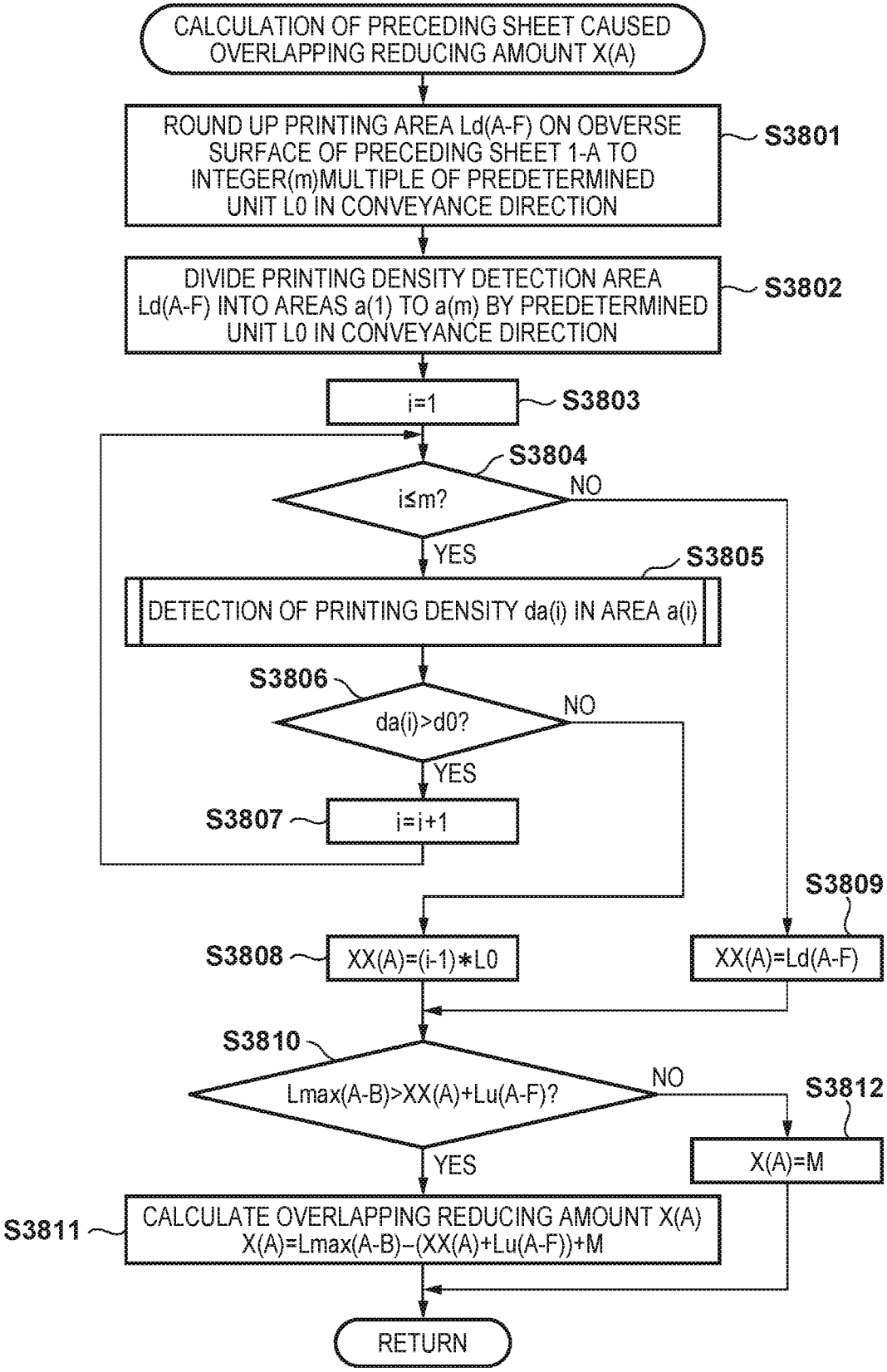
FIG. 38 is a flowchart illustrating processing of deciding a preceding sheet caused overlapping reducing amount X(A) according to the sixth embodiment.

FIG. 36 shows the processing of deciding the preceding sheet caused overlapping amount Lb(A) in consideration of a unique overlapping requirement imposed by performing double-sided printing on a preceding sheet 1-A. FIG. 37 shows an overlapping amount and an ink application area decided based on printing data when performing an overlapping operation.

Figure 33:
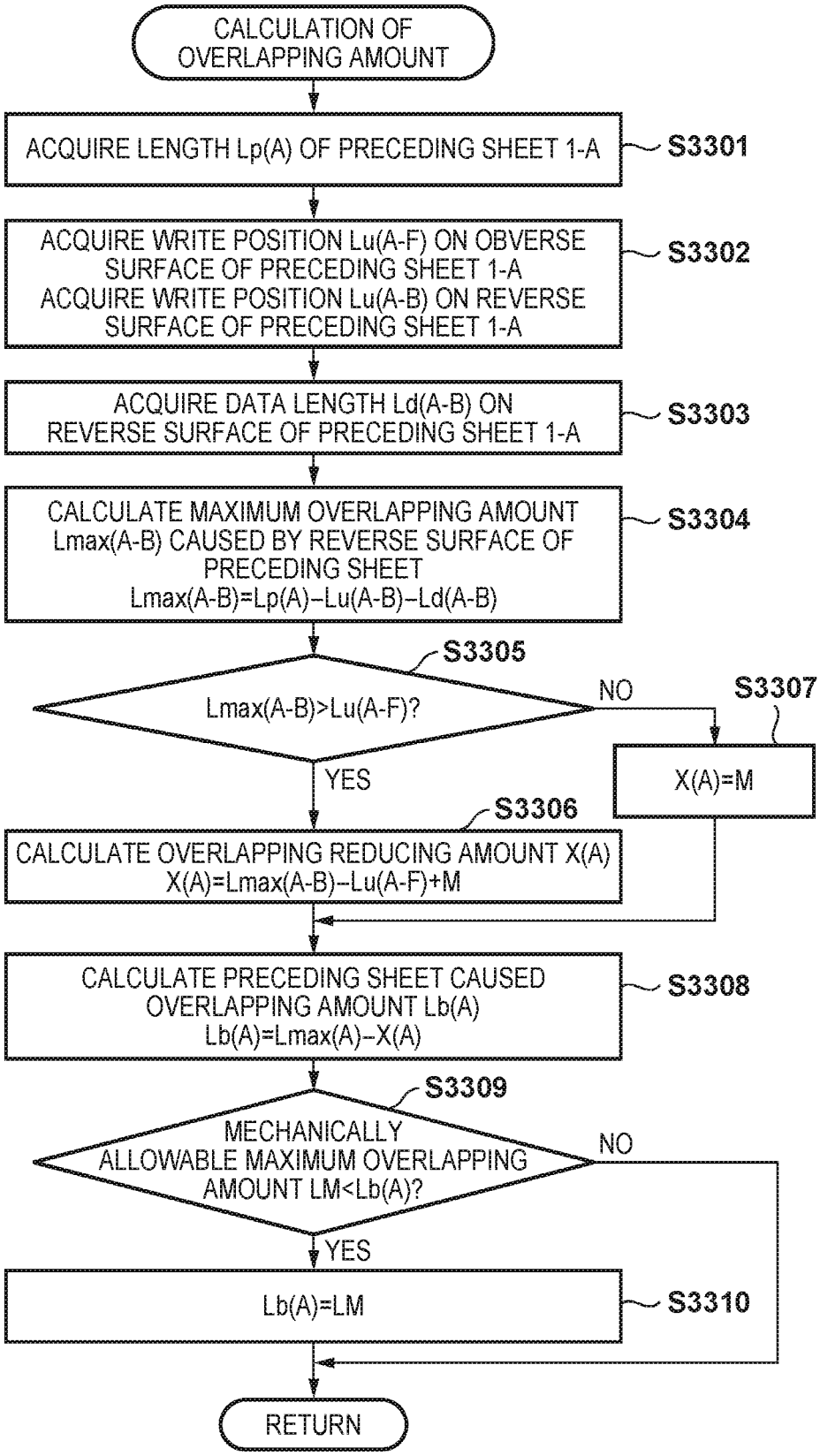
FIG. 33 is a flowchart illustrating processing of deciding a preceding sheet caused overlapping amount Lb(A) according to the fifth embodiment.

In steps S3601 to S3604, a maximum overlapping amount Lmax(A-B) is obtained, similarly to steps S3301 to S3304 of FIG. 33.

Figure 39:
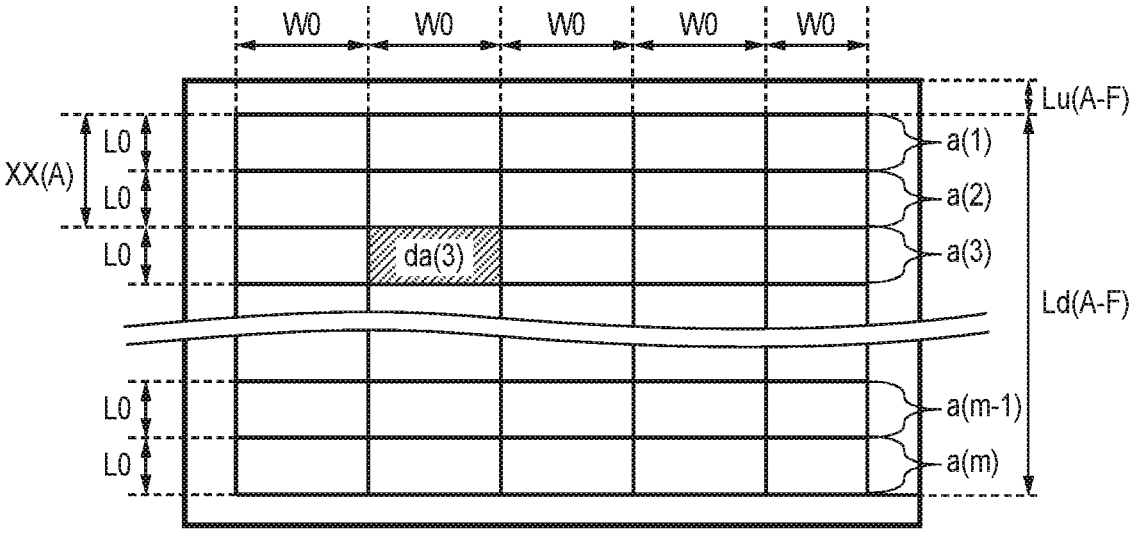
FIG. 39 is a view for explaining division of a printing density detection area according to the sixth embodiment.

In step S3605, a preceding sheet caused overlapping reducing amount X(A) is calculated. The processing of calculating the preceding sheet caused overlapping reducing amount X(A) will be described in detail with reference to FIG. 38. In step S3801, for the sake of simplicity, round-up processing is performed so that a printing area Ld(A–F) on the obverse surface of the preceding sheet 1-A becomes an m (m is an integer) multiple of a distance L0 of a unit area in the conveyance direction. In step S3802, the printing area is divided into m areas a(1) to a(m), as shown in FIG. 39. At this time, the area a(m) may have a distance in the conveyance direction that is shorter than the distance L0.

In steps S3803 to S3805, whether a predetermined printing density is exceeded is sequentially determined from an area on the leading edge side of the obverse surface of the preceding sheet 1-A, thereby detecting a printing density da(i) in an area a(i). The processing of detecting the printing density da(i) is the same as that shown in FIG. 11, and a description thereof will be omitted.

In step S3806, it is determined whether the printing density da(i) in the area a(i) exceeds a threshold d0. If the printing density da(i) in the area a(i) exceeds the threshold d0, an area XX(A) that a succeeding sheet 1-B can overlap is calculated from the printing density of the obverse surface of the preceding sheet 1-A in step S3808. Assume that a printing density da(3) in the area a(3) exceeds the threshold d0. A hatched area shown in FIG. 39 has the maximum printing density, and the printing density in this area is the value of da(3). Since the printing density da(3) exceeds the threshold d0, as shown in FIG. 39, the area XX(A) is given by:

$$XX(A)=L0*(3-1).$$

Alternatively, if the printing densities da(i) of all the areas a(i) do not exceed the threshold d0, the process advances to step S3809 to set, as the area XX(A), the printing length Ld(A-F) of the printing data on the obverse surface of the preceding sheet 1-A.

In step S3810, the maximum overlapping amount Lmax (A-B) depending on the reverse surface of the preceding sheet 1-A is compared with the overlapping distance (XX (A)+Lu(A−F)) from one edge of the printing sheet that has been obtained based on the printing density of the obverse surface of the preceding sheet 1-A. If the maximum overlapping amount Lmax(A-B) depending on the reverse surface of the preceding sheet 1-A is larger, the preceding sheet caused overlapping reducing amount X(A) is obtained by adding a margin M that is a fixed value to the difference between the two values (step S3811), given by:

$$X(A)=L\max(A-B)-(XX(A)+Lu(A-F))+M.$$

When the two values are equal to each other or the maximum overlapping amount Lmax(A−B) depending on the reverse surface of the preceding sheet 1-A is smaller, the preceding sheet caused overlapping reducing amount X(A) is set to the margin M that is the fixed value (step S3812).

Referring back to FIG. 36, in step S3606, the preceding sheet caused overlapping amount Lb(A) is calculated from the overlapping reducing amount X(A) depending on the obverse surface of the preceding sheet 1-A calculated in step S3605 and the maximum overlapping amount Lmax(A-B) depending on the reverse surface of the preceding sheet 1-A calculated in step S3604.

On the other hand, a conveyance path sandwiched between conveyance guides 15 and the arrangement of a conveyance roller 5 and a feeding roller 3 impose an upper limit LM of an overlapping distance in terms of the mechanism. Therefore, the preceding sheet caused overlapping amount Lb(A) calculated based on the printing data is compared with the upper limit LM of the overlapping distance. If the upper limit LM is smaller, the preceding sheet caused overlapping amount Lb(A) is replaced by the upper limit LM (steps S3607 and S3608).

As described above, the preceding sheet caused overlapping amount Lb(A) is calculated.

According to the above-described embodiment, it is possible to increase the speed of printing while suppressing a stain on a sheet, a sheet jam, a deterioration in image quality, or the like, caused when printing sheets 1 are conveyed by making the succeeding sheet 1-B overlap the preceding sheet 1-A and high-density double-sided printing is performed.

Seventh Embodiment

Processing of deciding an overlapping amount Lt(B) of a preceding sheet 1-A and a succeeding sheet 1-B according to the seventh embodiment will be described with reference to FIGS. 40 and 41.

In this embodiment, an overlap continuous feeding operation in double-sided printing is performed, similarly to the fifth and sixth embodiments, but double-sided printing of a plurality of printing sheets 1 is executed by performing the printing operation of the reverse surfaces of all the printing sheets 1 after the end of the printing operation of the obverse surfaces of all the printing sheets 1.

An apparatus configuration according to this embodiment is the same as in the first embodiment, and has the same sheet reversing mechanism as that in the fifth embodiment.

Figure 40:
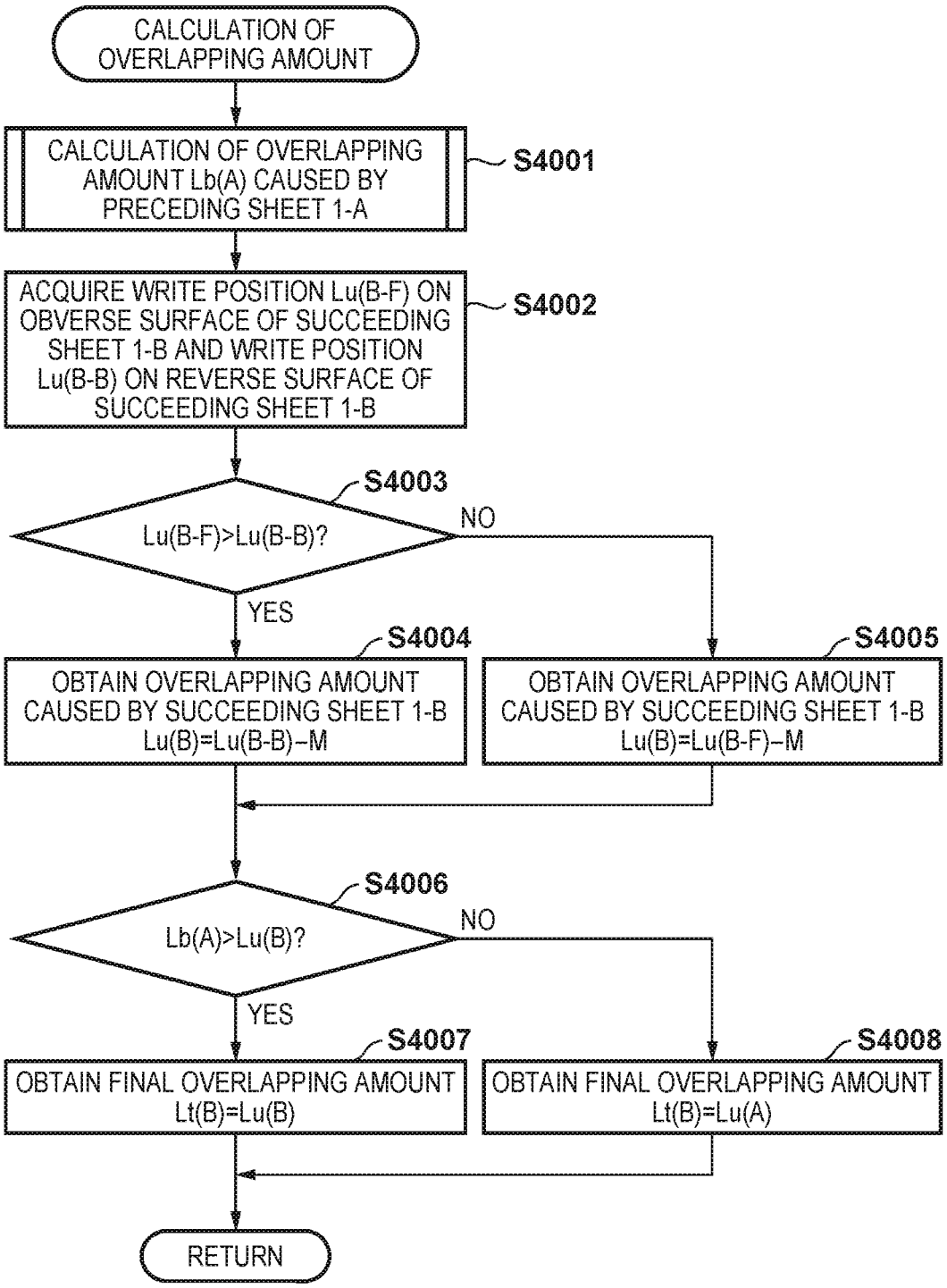
FIG. 40 is a flowchart illustrating processing of deciding an overlapping amount Lt(B) according to a seventh embodiment.

FIG. 40 shows the processing of deciding the overlapping amount Lt(B) of the preceding sheet 1-A and the succeeding sheet 1-B in consideration of a unique overlapping requirement imposed by performing double-sided printing on the succeeding sheet 1-B. FIG. 41 shows an overlapping amount and an ink application area decided based on printing data when performing an overlapping operation.

In step S4001, an overlapping amount Lb(A) depending on the obverse and reverse surfaces of the preceding sheet 1-A is calculated, similarly to FIG. 33.

Figure 41:
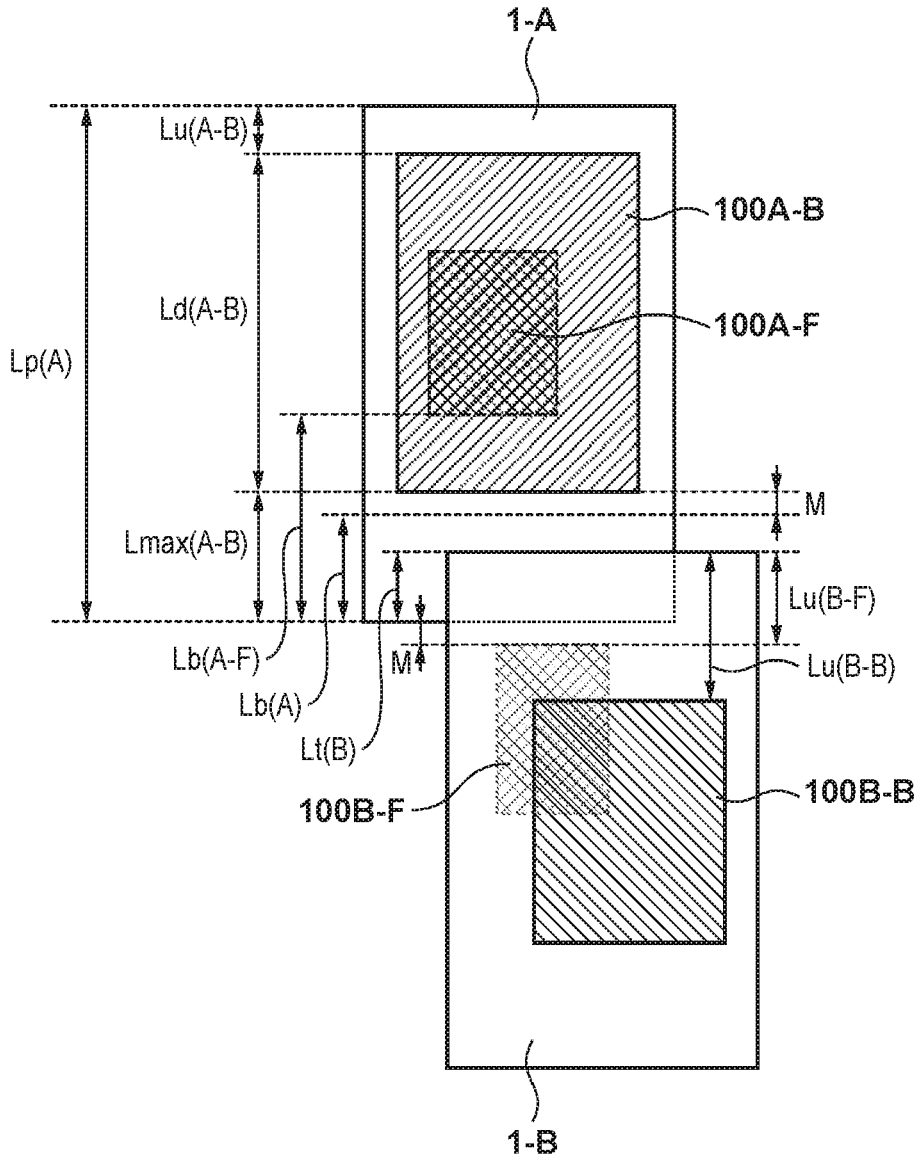
FIG. 41 is a schematic view showing the overlapping area of printing sheets according to the seventh embodiment.
Figure 42:
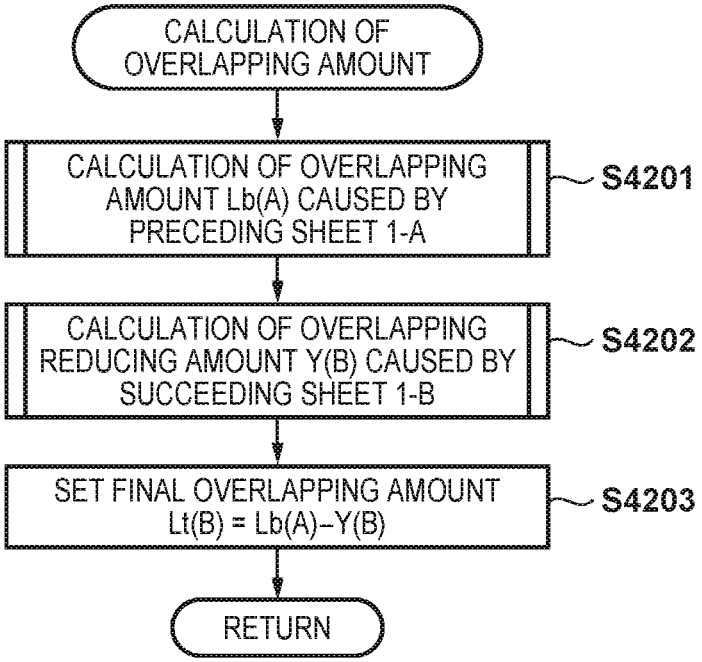
FIG. 42 is a flowchart illustrating processing of deciding an overlapping amount Lt(B) according to the eighth embodiment.

As shown in FIG. 41, assume that there is an area on the leading edge side that falls outside an ink application area 100B-B on the reverse surface of the succeeding sheet 1-B, that is, an ink application area 100B-F on the obverse surface of the succeeding sheet 1-B corresponding to the marginal area of the leading edge. In this case, even if the area of the succeeding sheet 1-B is the marginal area of the trailing edge of the reverse surface of the succeeding sheet 1-B, it is deformed due to ink applied in the printing operation of the obverse surface of the succeeding sheet 1-B. If the succeeding sheet 1-B is made to overlap the preceding sheet 1-A, the succeeding sheet 1-B is brought closer to the printhead 7, as shown in FIG. 13 and as described in the first embodiment. Therefore, the overlapping amount Lt(B) of the reverse surface of the preceding sheet 1-A and the obverse surface of the succeeding sheet 1-B is decided using printing information of the obverse surface of the succeeding sheet 1-B.

In step S4002, write positions Lu(B−F) and Lu(B−B) on the obverse and reverse surfaces of the succeeding sheet 1-B are acquired. In step S4003, the two write positions are compared with each other, and a value obtained by subtracting a margin M that is a fixed value from the smaller value of the write positions is defined as the overlapping amount (succeeding sheet caused overlapping amount) Lu(B) depending on the succeeding sheet 1-B (steps S4004 and S4005). Furthermore, the preceding sheet caused overlapping amount Lb(A) calculated in step S4001 is compared with the overlapping amount Lu(B) depending on the succeeding sheet 1-B (step S4006), and the smaller value is set as the final overlapping amount Lt(B) (steps S4007 and S4008).

As described above, the overlapping amount Lt(B) of the preceding sheet 1-A and the succeeding sheet 1-B is calculated.

According to the above-described embodiment, it is possible to increase the speed of printing while suppressing a stain on a sheet, a sheet jam, a deterioration in image quality, or the like, caused when printing sheets 1 are conveyed by making the succeeding sheet 1-B overlap the preceding sheet 1-A and high-density double-sided printing is performed.

Eighth Embodiment

Processing of deciding an overlapping amount Lt(B) of a preceding sheet 1-A and a succeeding sheet 1-B according to the eighth embodiment will be described with reference to FIGS. 42 to 47B.

In this embodiment, double-sided printing of a plurality of printing sheets 1 is executed by performing the printing operation of the reverse surfaces of all the printing sheets 1 after the end of the printing operation of the obverse surfaces of all the printing sheets 1, similarly to the sixth and seventh embodiments.

An apparatus configuration according to this embodiment is the same as in the first embodiment, and has the same sheet reversing mechanism as that in the fifth embodiment.

Figure 44A:
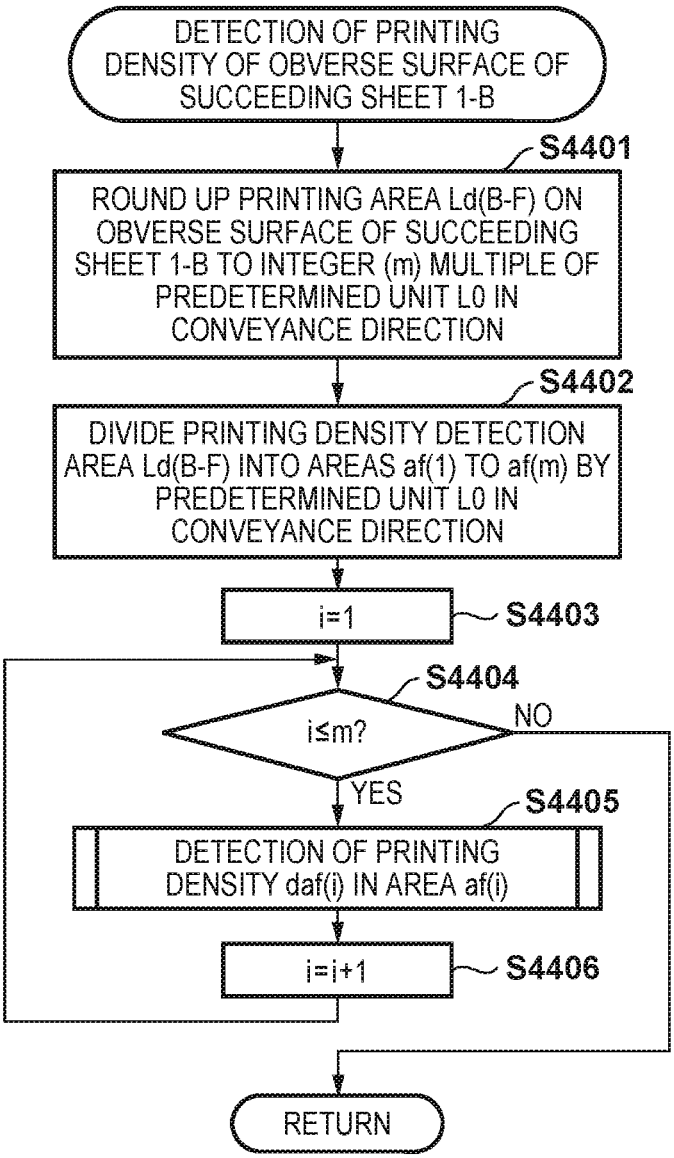
FIGS. 44A and 44B are flowcharts each illustrating processing of deciding a succeeding sheet caused overlapping reducing amount Y(B) according to the eighth embodiment.
Figure 44B:
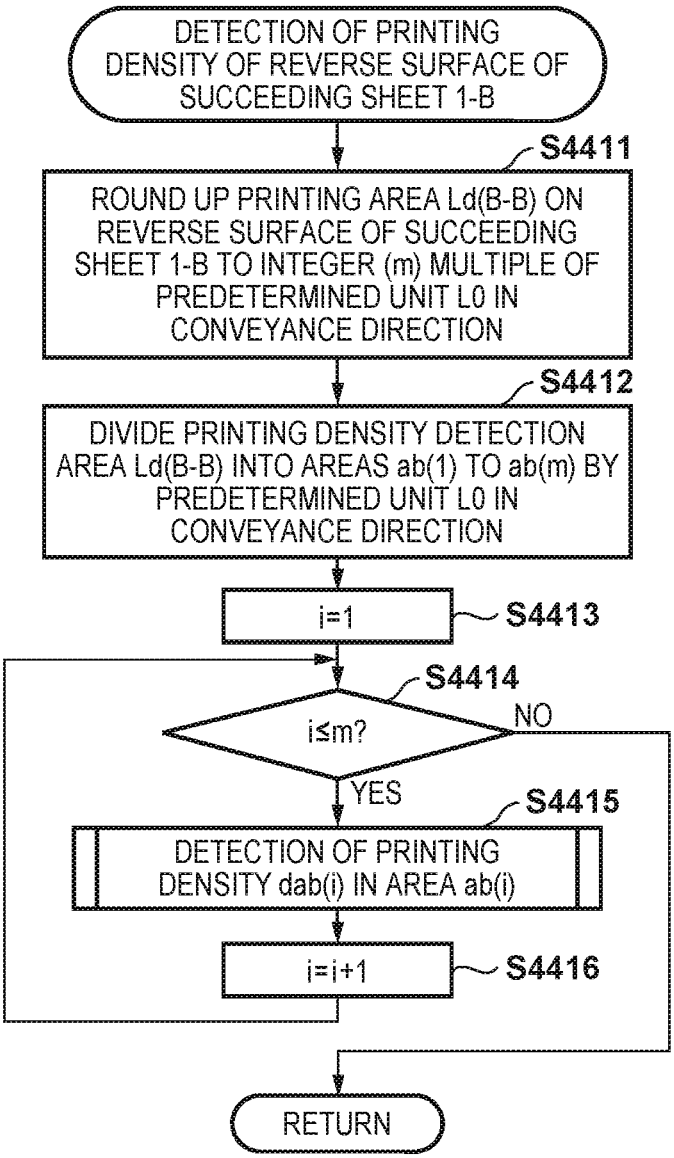
Figure 45:
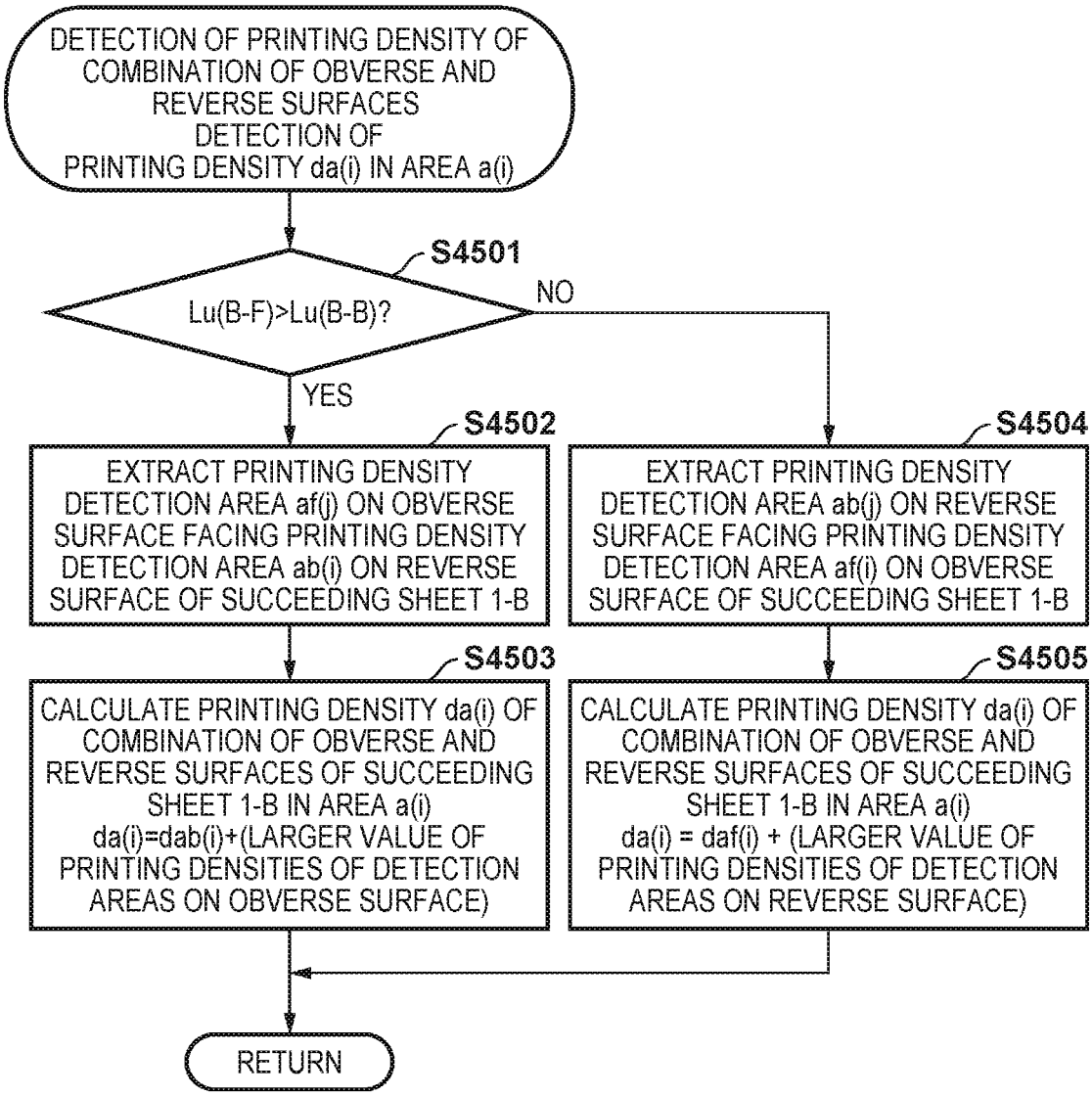
FIG. 45 is a flowchart illustrating processing of deciding the succeeding sheet caused overlapping reducing amount Y(B) according to the eighth embodiment.
Figure 46:
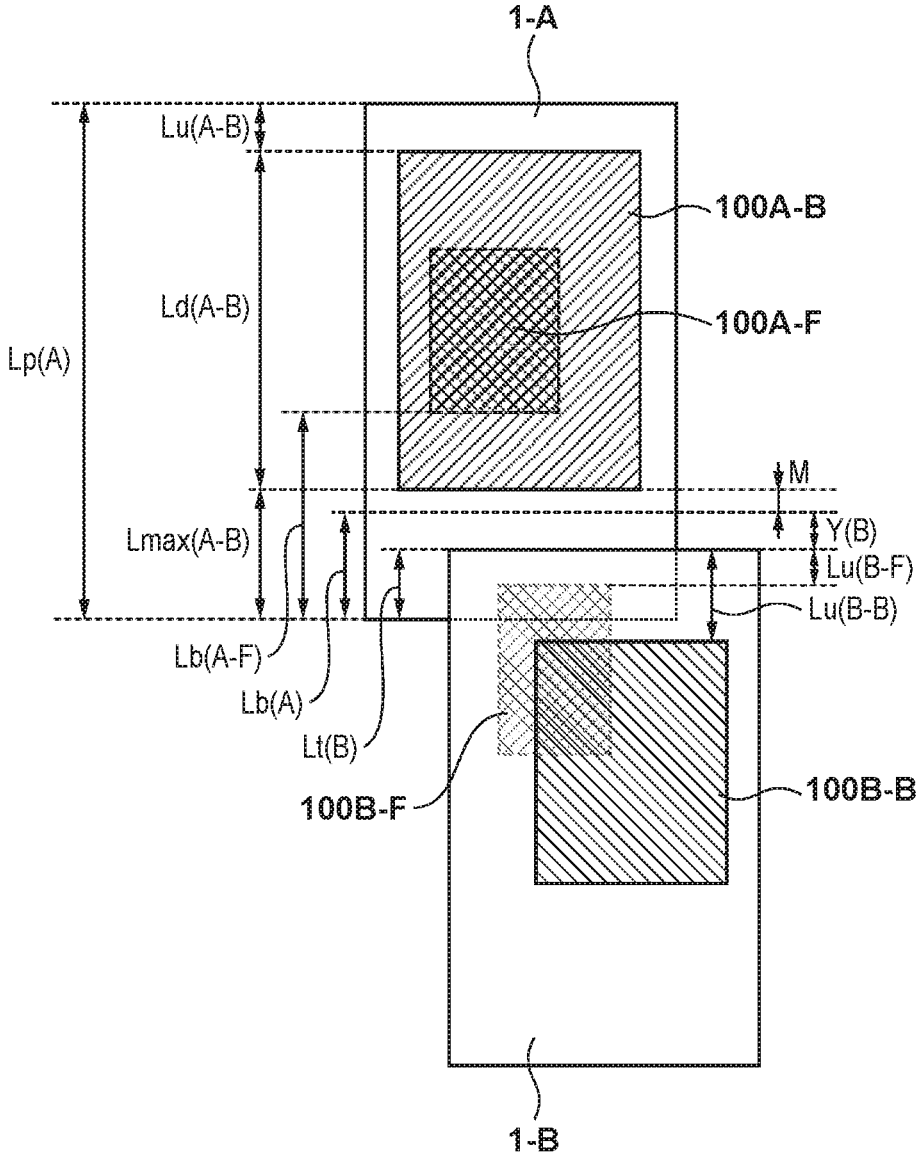
FIG. 46 is a schematic view showing the overlapping area of printing sheets according to the eighth embodiment.

FIGS. 42 to 45 show the processing of deciding the overlapping amount Lt(B) of the preceding sheet 1-A and the succeeding sheet 1-B in consideration of a unique overlapping requirement imposed by performing double-sided printing on the succeeding sheet 1-B. FIG. 46 shows an overlapping amount and an ink application area decided based on printing data when performing an overlapping operation.

Figure 43A:
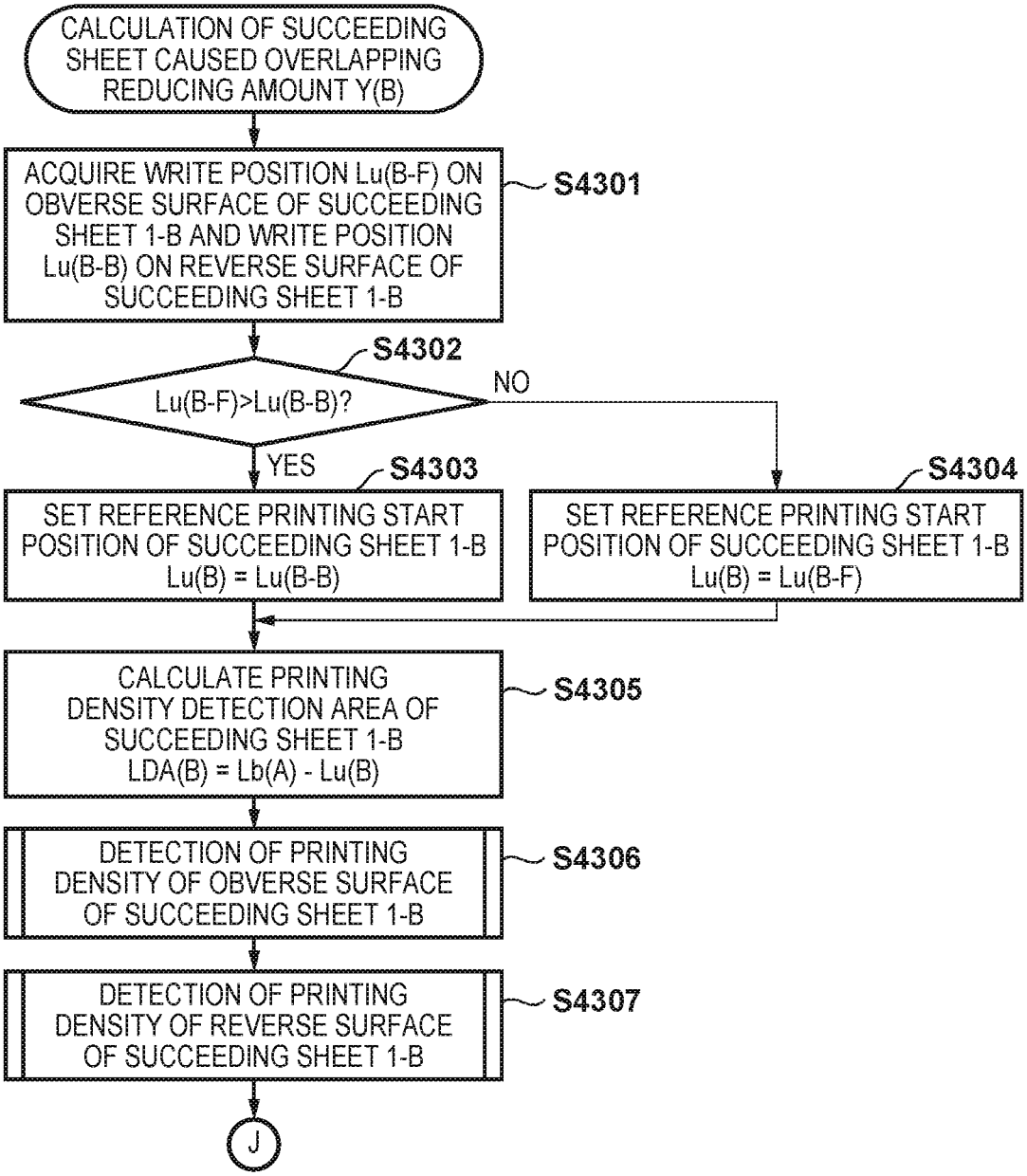
FIGS. 43A and 43B are flowcharts illustrating the processing of deciding the overlapping amount Lt(B) according to the eighth embodiment.
Figure 43B:
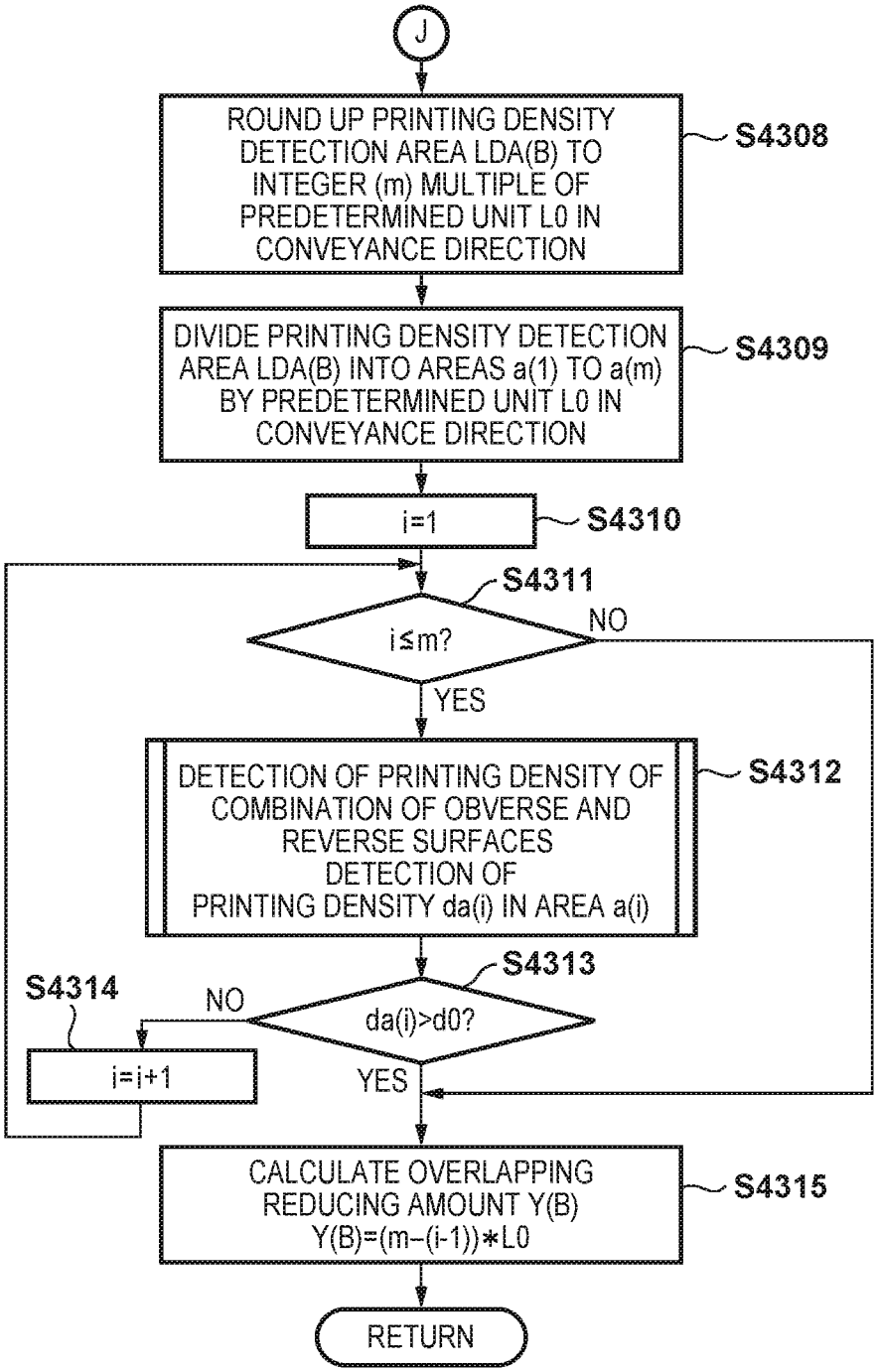

In step S4201, an overlapping amount Lb(A) depending on the obverse and reverse surfaces of the preceding sheet 1-A is calculated, similarly to FIG. 33. In step S4202, a succeeding sheet caused overlapping reducing amount Y(B) is calculated. FIGS. 43A and 43B show details of the processing.

Figure 47A:
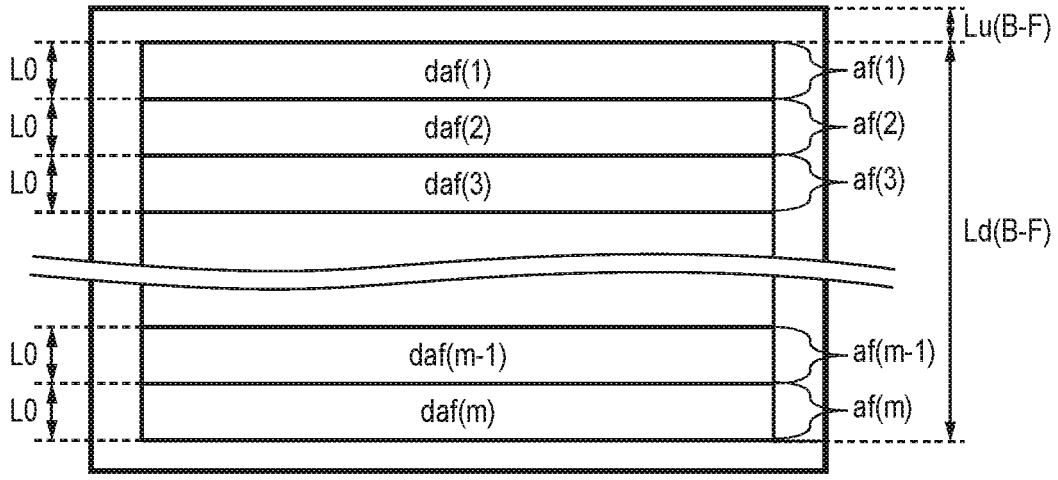
FIGS. 47A and 47B are views for explaining division of a printing density detection area according to the eighth embodiment.

Referring to FIG. 43A, in step S4301, write positions Lu(B−F) and Lu(B−B) on the obverse and reverse surfaces of the succeeding sheet 1-B are acquired. In step S4302, the two write positions Lu(B−F) and Lu(B−B) are compared with each other, and the smaller value is set as the reference printing start position of the succeeding sheet 1-B (steps S4303 and S4304). In step S4305, a printing density detection area LDA(B) obtained by combining the obverse and reverse surfaces of the succeeding sheet 1-B is calculated to calculate an overlapping amount. In steps S4306 and S4307, the printing densities of the obverse and reverse surfaces of the succeeding sheet 1-B are detected. It is desirable to detect the printing density of the obverse surface during the printing operation of the obverse surface, and to store the printing density in a memory (not shown), and thus, step S4306 may be executed during the continuous printing operation of all the obverse surfaces. FIGS. 44A and 44B show details of the printing density detection processes of the obverse and reverse surfaces of the succeeding sheet 1-B in steps S4306 and S4307, respectively. These flowcharts are basically the same, and only the printing density detection processing of the obverse surface shown in FIG. 44A will be explained. In step S4401, for the sake of simplicity, round-up processing is performed so that a printing area Ld(B−F) on the obverse surface of the succeeding sheet 1-B becomes an m (m is an integer) multiple of a distance L0 of a unit area in the conveyance direction. As shown in FIG. 47A, the printing area is divided into m areas a(1) to a(m) (step S4402). At this time, the area a(m) may have a distance in the conveyance direction that is shorter than the distance L0. In steps S4403 to S4406, the printing density is sequentially detected from an area on the leading edge side of the obverse surface of the succeeding sheet 1-B. Processing of detecting a printing density daf(i) in an area af(i) in step S4405 is the same as that shown in FIG. 11 and a description thereof will be omitted.

Figure 47B:
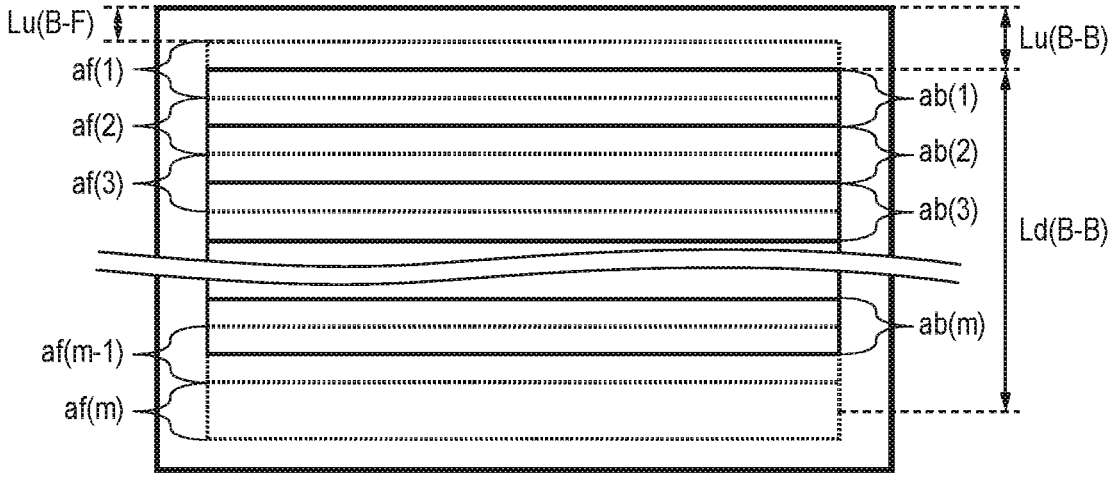

Referring to FIG. 43B, in steps S4308 and S4309, the printing density detection area LDA(B) obtained by combining the obverse and reverse surfaces of the succeeding sheet 1-B is divided to set the areas a(1) to a(m). In steps S4310 to S4312, a printing density da(i) is sequentially detected from an area a(i) on the leading edge side at the time of the printing operation of the reverse surface of the succeeding sheet 1-B. FIG. 45 shows details of processing in step S4312. In step S4501, the write positions Lu(B−F) and LU(B−B) on the obverse and reverse surfaces of the succeeding sheet 1-B are compared with each other. A case in which the write position Lu(B−F) on the obverse surface is smaller (NO in step S4501), as shown in FIG. 47B, will be exemplified but the same can apply to a case in which the write position Lu(B−F) on the obverse surface is larger (YES in step S4510) by reversing the surface (steps S4502 and S4503). In this case, the process advances to step S4504 to extract a detection area ab(j) on the reverse surface facing the printing density detection area af(i) on the obverse surface of the succeeding sheet 1-B. Referring to FIG. 47B, a portion facing an area af(1) includes a margin and an area ab(1), and a portion facing an area af(2) includes the area ab(1) and an area ab(2) and can be represented by ab(i) and ab(i−1). In step S4505, a printing density (Duty) of the combination of the obverse and reverse surfaces is calculated. Since the detection area a(i) coincides with the reference detection area af(i) on the obverse surface, the printing density (Duty) daf(i) on the obverse surface is to be added intact. Since the detection area ab(i) on the reverse surface does not coincide with the detection area a(i) on the combination of the obverse and reverse surfaces, it is necessary to determine a printing density in a specific area to be added. To do this, printing densities dab(i) and dab(i−1) of the target areas ab(i) and ab(i−1) extracted in step S4504 are compared with each other, and the larger value is to be added. That is, the obverse/reverse printing density da(i) in the area a(i) is obtained by adding daf(i) and a greater one of dab(i) and dab(i−1).

Referring back to FIG. 43B, in step S4313, it is determined whether the calculated obverse/reverse printing density da(i) exceeds a threshold d0. If the obverse/reverse printing density da(i) exceeds the threshold d0, the area is an overlapping disable area, and areas up to the immediately preceding area a(i−1) are overlapping enable areas. Therefore, the succeeding sheet caused overlapping reducing amount Y(B) is given (step S4415) by:

$$Y(B)=(m-(i-1))*L0.$$

Referring back to FIG. 42, in step S4203, the final overlapping amount Lt(B) of the preceding sheet 1-A and the succeeding sheet 1-B is set by:

$$Lt(B)=Lb(A)-Y(B).$$

According to the above-described embodiment, it is possible to increase the speed of printing while suppressing a stain on a sheet, a sheet jam, a deterioration in image quality, or the like, caused when printing sheets 1 are conveyed by making the succeeding sheet 1-B overlap the preceding sheet 1-A and high-density double-sided printing is performed.

Ninth Embodiment

Lastly, the ninth embodiment will be described with reference to FIG. 48.

Each of the above-described embodiments adopts a so-called serial method in which a printing unit including a printhead 7 is guided and supported reciprocally in the main scanning direction by guide rails. In contrast, this embodiment adopts a so-called line head method in which a printhead 70 is provided on the whole surface along a sheet width direction orthogonal to the conveyance direction.

Figure 48:
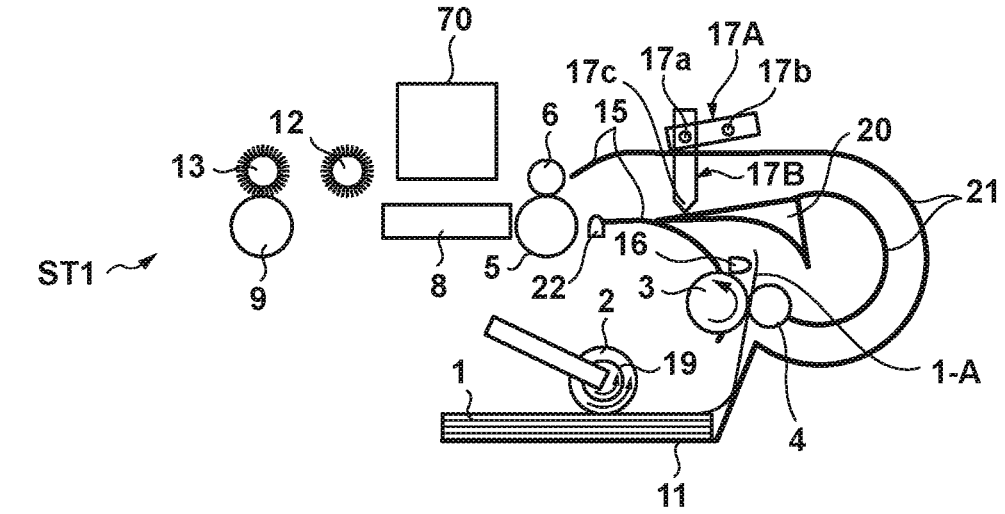
FIG. 48 is a side cross-sectional view schematically showing an apparatus configuration according to the ninth embodiment.

FIG. 48 is a schematic cross-sectional view showing the internal configuration of a printing apparatus according to this embodiment. The conveyance path of a printing sheet 1 from a feeding tray 11 to a discharge roller 9 and a conveyance configuration are the same as those of a serial printing apparatus described in each of the above embodiments. A printhead 70 is a line head in which nozzles (not shown) for discharging ink are provided on the whole surface along the sheet width direction.

In the line head method, the printing sheet 1 sent from a pickup roller 2 to a conveyance roller 5 via a feeding roller 3 is conveyed by the conveyance roller 5 at a constant speed to pass through a portion facing the line head 70. The line head 70 discharges ink to the printing sheet 1 according to the conveyance speed of the conveyance roller 5, thereby forming an image. In the line head method, an image is basically formed in one image area by only one conveyance operation, unlike the serial method. The discharge frequency of the line head 70 and the conveyance speed are changed according to the image resolution, that is, the printing quality. For example, in a high-speed printing mode, thinning printing is performed to decrease the image resolution as the conveyance speed increases. In a high-image quality mode, printing is performed to increase the image resolution as the conveyance speed decreases.

Processing of deciding an overlapping amount Lt(B) of a preceding sheet 1-A and a succeeding sheet 1-B according to this embodiment is basically the same as that shown in FIG. 24. In processing of calculating a preceding sheet caused overlapping reducing amount X(A) shown in FIG. 19, the preceding sheet caused overlapping reducing amount X(A) is obtained based on a printing density Dmax by using a function shown in FIG. 22. This function has a feature in which the value decreases as the image resolution increases or the conveyance speed of the printing sheet decreases in addition to the environmental temperature and environmental humidity, and the preceding sheet caused overlapping reducing amount X(A) is calculated using a function selected under each printing condition.

In processing of calculating a succeeding sheet caused overlapping reducing amount Y(B) shown in FIG. 10, whether each of areas a(1) to a(3) is an overlapping enable area is decided based on a printing density threshold d0. As a feature, this threshold d0 decreases as the image resolution increases or the conveyance speed of the printing sheet decreases, in addition to the environmental temperature and environmental humidity, and the succeeding sheet caused overlapping reducing amount Y(B) is calculated based on the printing density threshold d0 selected under each printing condition.

The final overlapping amount Lt(B) is calculated from the thus obtained succeeding sheet caused overlapping reducing amount Y(B) and an already calculated preceding sheet caused overlapping amount Lb(A).

According to the above-described embodiment, it is possible to increase the speed of printing while suppressing a stain on a sheet, a sheet jam, a deterioration in image quality, or the like, caused when high-density printing is performed in the printing apparatus for performing printing by the line head method.

OTHER EMBODIMENTS

Embodiments of the present invention can also be realized by a computer of a system or an apparatus that reads out and executes computer executable instructions (e.g., one or more programs) recorded on a storage medium (that may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™) a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

We claim:

1. A printing apparatus comprising:

a feeding roller configured to feed sheets, including at least a preceding sheet and a succeeding sheet;

a conveyance roller configured to convey the sheets fed by the feeding roller;

a printing unit configured to discharge ink to print on at least one sheet, of the sheets conveyed by the conveyance roller; and a conveyance control unit configured to control the feeding roller to start to feed the succeeding sheet without overlapping the preceding sheet and control the feeding roller and the conveyance roller to form an overlap state, in which a leading edge of the succeeding sheet overlaps with the preceding sheet, wherein, in a state in which the conveyance roller is conveying the succeeding sheet to a printing start position at which a printing operation is started by the printing unit, the printing unit is configured to print on an overlapping area where the preceding sheet and the succeeding sheet overlap each other, wherein the conveyance control unit forms the overlap state between the feeding roller and the conveyance roller, and wherein the conveyance control unit performs control, such that the succeeding sheet catches up with the preceding sheet, by increasing a feed amount per unit time of the feeding roller, when feeding the succeeding sheet, to be greater than a feed amount per unit time of the conveyance roller, when conveying the preceding sheet.

2. The printing apparatus according to claim 1, wherein the printing unit is configured to print on the overlapping area of the succeeding sheet.

3. The printing apparatus according to claim 1, wherein the conveyance control unit causes the feeding roller to start to feed the succeeding sheet while having an interval between a trailing edge of the preceding sheet and the leading edge of the succeeding sheet.

4. The printing apparatus comprising according to claim 1, wherein the conveyance control unit causes the feeding roller, when feeding the succeeding sheet, to rotate continuously when the conveyance roller, when conveying the preceding sheet, rotates intermittently, so that the succeeding sheet catches up with the preceding sheet.

5. The printing apparatus according to claim 1, wherein the conveyance control unit causes the feeding roller, when feeding the succeeding sheet, to rotate at a rotation speed that is greater than that of the conveyance roller, when conveying the preceding sheet, so that the succeeding sheet catches up with the preceding sheet.

6. The printing apparatus according to claim 1, wherein the printing unit further includes:

a carriage, the printhead being mounted on the carriage, configured to move in a direction that intersects a conveyance direction of the sheets; and a print control unit configured to control the conveyance roller and the printing unit to perform a printing operation for printing on the at least one sheet by repeating an operation of intermittently conveying the at least one sheet by the conveyance roller, and an operation of discharging ink by the printhead when the conveyance roller stops.

7. The printing apparatus according to claim 6, wherein, when an operation of conveying the preceding sheet stops, the conveyance control unit performs skew correction of the succeeding sheet by causing the succeeding sheet to abut against the conveyance roller.

8. A method of controlling a printing apparatus that includes a feeding roller configured to feed sheets, including at least a preceding sheet and a succeeding sheet, a conveyance roller configured to convey the sheets fed by the feeding roller, and a printing unit configured to discharge ink to print on at least one sheet, of the sheets conveyed by the conveyance roller, the method comprising the steps of:

controlling the feeding roller to start to feed the succeeding sheet without overlapping the preceding sheet;

forming an overlap state, in which a leading edge of the succeeding sheet overlaps with the preceding sheet, between the feeding roller and the conveyance roller, by controlling the feeding roller and the conveyance roller; and printing, in a state in which the conveyance roller is conveying the succeeding sheet to a printing start position at which a printing operation is started by the printing unit, on an overlapping area, where the preceding sheet and the succeeding sheet overlap each other, wherein the conveying step includes increasing a feed amount per unit time of the feeding roller, when feeding the succeeding sheet, to be greater than a feed amount per unit time of the conveyance roller, when conveying the preceding sheet, so that the succeeding sheet catches up with the preceding sheet.

9. The method according to claim 8, wherein the printing unit is configured to print on the overlapping area of the succeeding sheet.

10. The method according to claim 8, wherein, in the conveying step, the feeding roller starts to feed the succeeding sheet while having an interval between a trailing edge of the preceding sheet and the leading edge of the succeeding sheet.

11. The method according to claim 8, wherein, in the conveying step, the feeding roller, when feeding the succeeding sheet, is controlled to rotate continuously when the conveyance roller, when conveying the preceding sheet, rotates intermittently, so that the succeeding sheet catches up with the preceding sheet.

12. The method according to claim 8, wherein, in the conveying step, the feeding roller, when feeding the succeeding sheet, is controlled to rotate at a rotation speed that is greater than that of the conveyance roller, when conveying the preceding sheet, so that the succeeding sheet catches up with the preceding sheet.

13. The method according to claim 8, wherein the printing unit also includes (i) a carriage, the printhead being mounted on the carriage, configured to move in a direction that intersects a conveyance direction of the sheets, and (ii) a print control unit configured to control the printing unit, wherein the method further comprises:

performing a printing operation for printing on the at least one sheet by repeating an operation of intermittently conveying the at least one sheet by the conveyance roller, and an operation of discharging ink by the printhead when the conveyance roller stops.

14. The method according to claim 13, wherein the conveying step includes performing, when an operation of conveying the preceding sheet stops, skew correction of the succeeding sheet by causing the succeeding sheet to abut against the conveyance roller.

* * * * *